US010024150B2

(12) United States Patent
Andreychuk et al.

(10) Patent No.: US 10,024,150 B2
(45) Date of Patent: Jul. 17, 2018

(54) BOTTOM HOLE ASSEMBLY FOR WELLBORE COMPLETION

(71) Applicant: KOBOLD SERVICES INC., Calgary (CA)

(72) Inventors: Mark Andreychuk, Calgary (CA); Per Angman, Calgary (CA); Allan Petrella, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 565 days.

(21) Appl. No.: 14/542,542

(22) Filed: Nov. 14, 2014

(65) Prior Publication Data

US 2015/0129197 A1 May 14, 2015

Related U.S. Application Data

(60) Provisional application No. 61/904,054, filed on Nov. 14, 2013, provisional application No. 61/904,332, filed on Nov. 14, 2013.

(51) Int. Cl.

| | |
|---|---|
| ***E21B 43/26*** | (2006.01) |
| ***E21B 21/10*** | (2006.01) |
| ***E21B 33/129*** | (2006.01) |
| ***E21B 33/1295*** | (2006.01) |

(52) U.S. Cl.

CPC ..... *E21B 43/26* (2013.01); *E21B 21/10* (2013.01); *E21B 21/103* (2013.01); *E21B 33/1294* (2013.01); *E21B 33/1295* (2013.01)

(58) Field of Classification Search

CPC ..... E21B 21/10; E21B 21/103; E21B 33/1294

See application file for complete search history.

(56) References Cited

U.S. PATENT DOCUMENTS 3,012,611 A * 12/1961 Haines ..... C09K 8/72 166/119
4,688,634 A 8/1987 Lustig et al.
5,343,956 A 9/1994 Coronado (Continued)

FOREIGN PATENT DOCUMENTS

| | | |
|---|---|---|
| CA | 2693676 | 7/2010 |
| CA | 2738907 | 7/2011 |

*Primary Examiner* — Giovanna C. Wright
*Assistant Examiner* — Manuel C Portocarrero
(74) *Attorney, Agent, or Firm* — Parlee McClaws LLP (CGY); Sean Goodwin

(57) ABSTRACT

A Bottom Hole Assembly (BHA) tool and methods of downhole fluid management are disclosed. The BHA is deployed on a conveyance string to access a completion string and forming a tool annulus therebetween. A first assembly having a first bore fluidly connected to the conveyance string. A second assembly supports an packer for releasably sealing to the completion string, and a third assembly supporting a packer actuator thereon, the second assembly telescopically movable within the third assembly for forming a resettable packer releasably sealable to the completion string. A bypass valve is formed between the first and second assembly. Closing of the bypass valve directs fluid through a treatment port uphole of the resettable packer to the tool annulus and opening of the bypass valve bypasses fluid about the resettable packer. The packer actuator can further comprise an anchor for releasably anchoring to the completion string.

26 Claims, 46 Drawing Sheets

(56) References Cited

U.S. PATENT DOCUMENTS

| | | | | |
|---|---|---|---|---|
| 6,024,173 | A | 2/2000 | Patel et al. | |
| 6,481,497 | B2 | 11/2002 | Swor et al. | |
| 8,393,392 | B2 | 3/2013 | Mytopher et al. | |
| 2004/0238173 | A1* | 12/2004 | Bissonnette | E21B 34/14 166/307 |
| 2012/0055671 | A1* | 3/2012 | Stromquist | E21B 33/126 166/298 |
| 2012/0090858 | A1* | 4/2012 | Ingram | E21B 23/06 166/387 |
| 2012/0097398 | A1* | 4/2012 | Ravensbergen | E21B 34/102 166/308.1 |
| 2013/0014956 | A1* | 1/2013 | Hughes | E21B 23/006 166/373 |

* cited by examiner

Run-in, Packer Unset and Packer Set

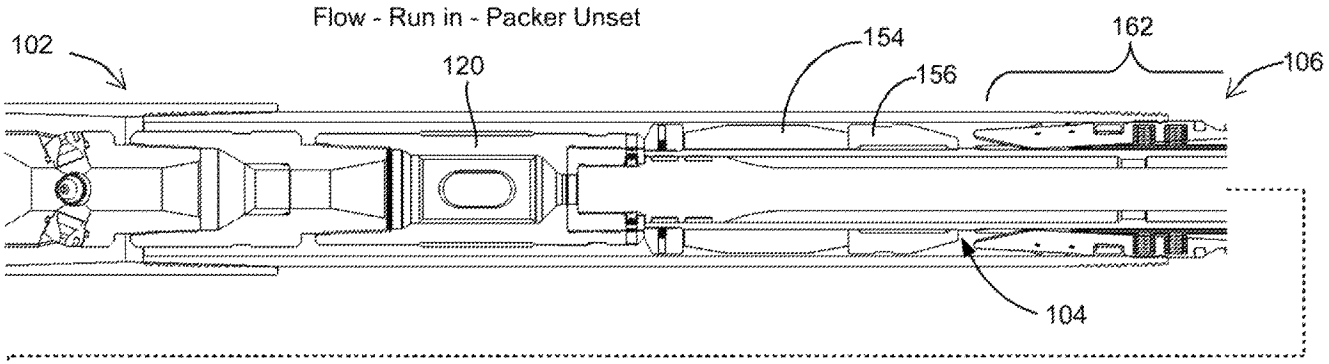
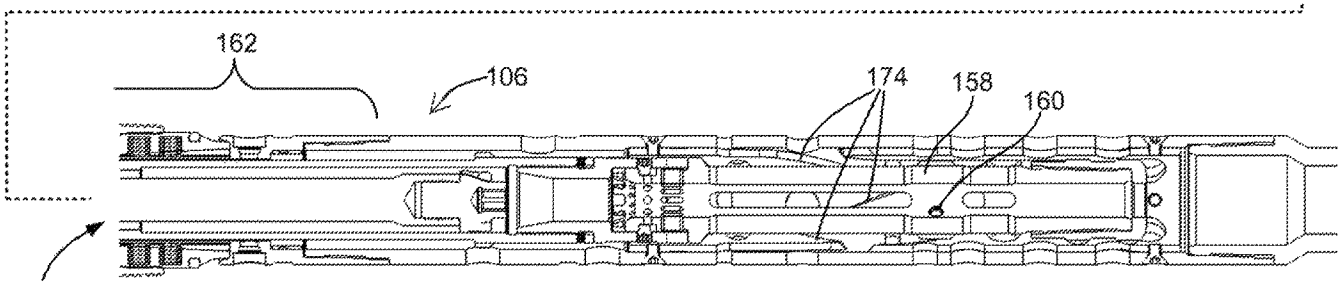
FIG. 7A
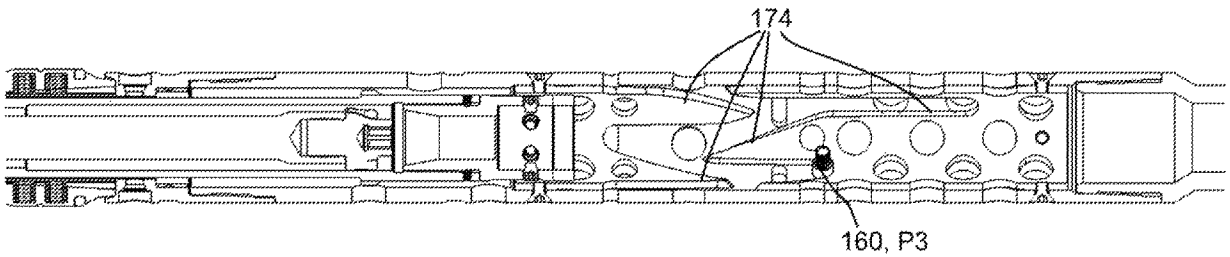
FIG. 7B

Flow - Pull up and Release

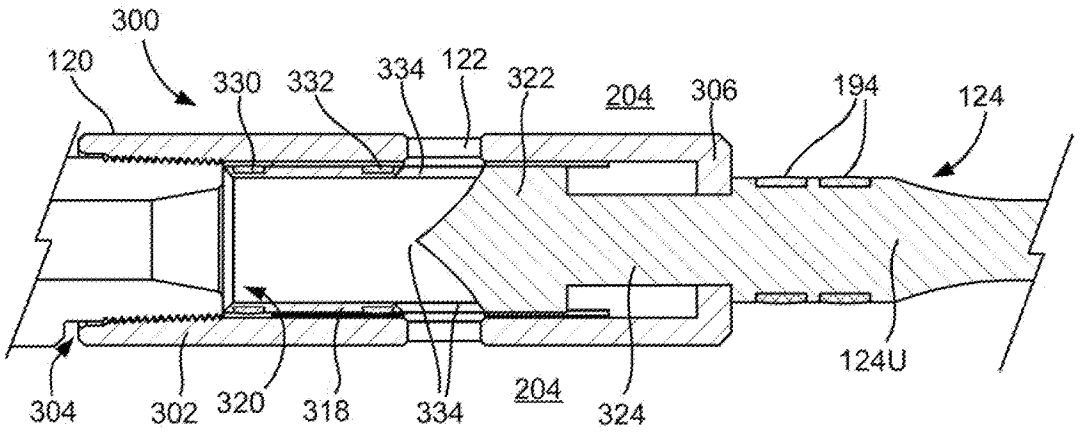
FIG. 22B
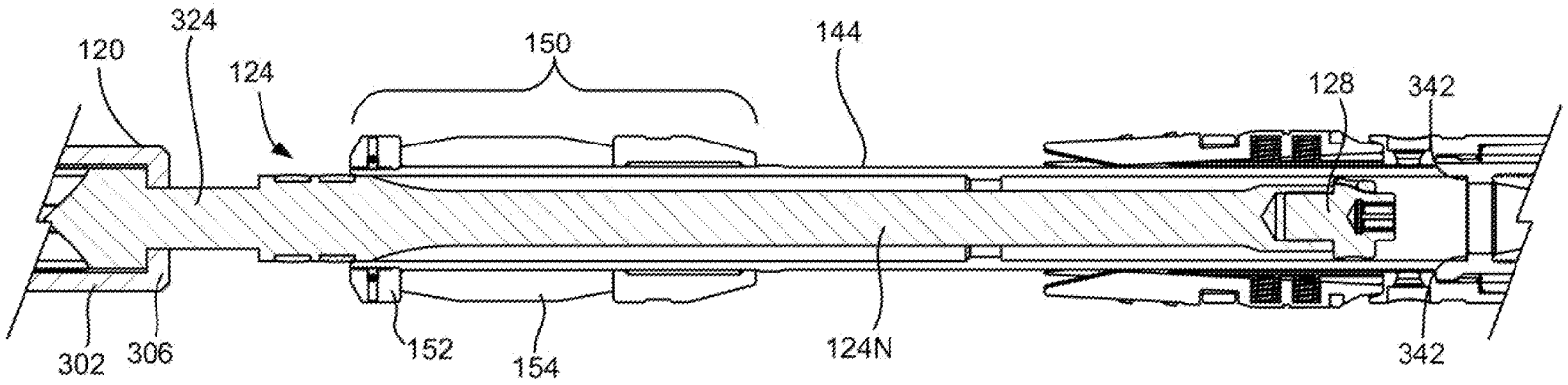

BOTTOM HOLE ASSEMBLY FOR WELLBORE COMPLETION

FIELD

Embodiments of the invention relate to apparatus and methods for completion of a wellbore and, more particularly, to apparatus and methods for completing a wellbore and fracturing a formation therethrough.

BACKGROUND

It is well known to line wellbores with liners or casing and the like and, thereafter, to create flowpaths through the casing to permit fluids, such as fracturing fluids, to reach the formation therebeyond.

One such conventional method for creating flowpaths is to perforate the casing using apparatus such as a perforating gun, which typically utilize an explosive charge to create localized openings through the casing.

Alternatively, the casing can include pre-machined ports, located at intervals therealong. The ports are typically sealed during insertion of the casing into the wellbore, such as by a dissolvable plug, a burst port assembly, a sleeve or the like. Optionally, the casing can thereafter be cemented into the wellbore, the cement being placed in an annulus between the wellbore and the casing. Thereafter, the ports are typically selectively opened by removing the sealing means to permit fluids, such as fracturing fluids, to reach the formation.

Typically, when sleeves are used to seal the ports, the sleeves are releasably retained thereover and can be actuated to slide within the casing to open and close the respective ports. Many different types of sleeves and apparatus to actuate the sleeves are known in the industry. Fluids are directed into the formation through the open ports. At least one sealing means, such as a packer, is employed to isolate the balance of the wellbore below the sleeve from the treatment fluids.

A variety of tools are known for actuating sleeves in ported subs including the use of shifting tools, profiled tools and packers. In U.S. Pat. No. 6,024,173 to Patel and assigned to Schlumberger, a shifting tool and a position locator is disclosed for locating a downhole device and engaging a packer element within moveable member and operating the device using and applied axial force to shift the member.

In Canadian Patents 2,738,907 and 2,693,676, both to NCS Oilfield Services Canada Inc., a bottom hole assembly (BHA) is deployed at an end of coiled tubing and located adjacent a ported sub by a sleeve locator. The BHA has a sealing member and an anchor such as a releasable bridge plug or well packer, which are set inside the ported sub fit for shifting a sliding sleeve and opening ports to the wellbore. From an uphole end, the BHA is connected to coiled tubing, has a fluid cutting assembly (jet cutting tool), a check valve for actuating the jet cutting tool, a bypass/equalization valve and the sealing member, the releasable anchor and the sleeve locator. A multifunction valve, including reverse circulation and pressure equalization, is positioned between the abrasive fluid jetting assembly and the sealing element. Set down on the coiled tubing closes the multifunction valve, blocking fluid communication to the tubing below the sealing member, and aligning ports in the valve for reverse circulation between the annulus and one way flow up the coiled tubing through the check valve. Pull up on the coiled tubing opens the multifunction valve to permit flow through a port in the valve between the annulus and the tubing the below the sealing member for equalization and though the port in the valve between the annulus and one way flow up the coiled tubing for reverse circulation. The check valve prevents fluid delivered through the coiled tubing from moving beyond the jetting assembly. Thus, fluid delivered through the coiled tubing is only used to cut perforations. Treatment fluid, such as for fracturing, is delivered through the annulus, between the BHA and the casing, to the ports opened by the sleeve.

As one of skill will appreciate, the volume of treatment fluid which must be pumped through the annulus is significantly larger than that which would be required to be pumped through the coiled tubing to achieve relatively the same result. Not all formations require such volumes and the cost of treatment fluids is not inconsequential to the overall costs of a fracturing operation.

There is interest in the industry for robust apparatus and methods of performing completion operations which are relatively simple, reliable and which reduce the overall costs involved.

SUMMARY

A downhole tool or bottom hole assembly (BHA) and methods of use are described herein so as to a robust and simplified assembly of components for providing a variety of, and improved, fluid management, wellbore operations, fluid treatment, pressure equalization, debris clearance and jamming recovery options. The BHA comprises three assemblies, telescopically coupled first to second and second to third, namely: a first assembly supported by the conveyance string, a second intermediate assembly, and a third downhole assembly. The first assembly is a flow control assembly comprising fluid subs and a mandrel, the second assembly supports a packer and the third assembly supports means to actuate the packer including a shifting device for selective operation of the second and third assemblies. The third assembly can include a casing or string anchor such as a slip assembly. There are several embodiments of the first flow control assembly related to the management of the fluid treatment port and whether the port is always open or selectively open and closed. One form of treatment port is a fracturing fluid port or blast port, typically arranged for handling erosive fluid flow therethrough.

In an embodiment, a downhole treatment tool deployed on a tubular conveyance string to access a completion string in a wellbore and forming a tool annulus between the treatment tool and completion string, the treatment tool comprising: a first assembly having a first bore fluidly connected to the conveyance string for receipt of treatment fluid therefrom; a second assembly supporting an packer for releasably sealing to the completion string; and a third assembly supporting a packer actuator thereon, the second assembly telescopically movable within the third assembly for forming a resettable packer releasably sealable to the completion string; and a bypass valve between the first and second assembly, the first assembly telescopically movable with the second assembly for alternately closing and opening the bypass valve wherein closing of the bypass valve directs fluid through a treatment port uphole of the resettable packer to the tool annulus and opening of the bypass valve bypasses fluid about the resettable packer. The packer actuator can further comprise an anchor for releasably anchoring to the completion string. The first assembly can further comprise a mandrel extending downhole to telescopically engage a second bore of the second assembly and form the bypass valve therebetween.

In an embodiment, the first assembly comprises a treatment port or fracturing fluid blast joint for fluid communication with the tool annulus. The first assembly can further comprise an abrasive jet sub uphole of the blast joint and a ball sub therebetween, the ball sub receiving a ball for isolation the blast joint for enabling abrasive jet operations. The ball can be retrieved with reverse circulation down the tool annulus and up the conveyance string to enable use of the blast joint once again.

Alternatively, the blast joint can be fit with a selector valve therein for opening and closing the treatment ports. The mandrel, extending between the first and second assemblies can be fit telescopically to both the first and second assemblies for actuating the selector valve open and closed and the bypass valve open and closed. An uphole end of the mandrel is connected to the selector valve wherein manipulation of the first assembly to the downhole position opens the selector valve while closing the bypass valve, and movement to the uphole position closes the selector valve while opening the bypass valve. In this embodiment, the first assembly can further comprise an abrasive jet sub uphole of selector valve, operational when the selector valve is closed and deactivated when the selector valve is open.

In another alternative embodiment the mandrel is a tubular, having a mandrel bore contiguous with the first bore, having a plug at a downhole end of the mandrel bore, and a first fluid port of a selector valve uphole of the plug. The second assembly has a second bore, a second fluid port of the selector valve and having a plug seat downhole thereof, the selector valve opening and closing of the fluid treatment port. Thus, manipulation of the first assembly to the downhole position aligns the first and second ports to open the selector valve and the plug engages the plug seat to close the bypass valve, and manipulation to the uphole position closes the selector valve while opening the bypass valve. In this embodiment, the first assembly can further comprise an abrasive jet sub uphole of selector valve, operational when the selector valve is closed and deactivated when the selector valve is open.

In another aspect, a shifting device is provided retaining the resettable packer in a run-in or ready-mode, a set mode, and a pull up or release mode. The resettable packer comprises a packer assembly telescopically coupled to an anchor assembly, the packer setting on set down of the packer assembly onto the anchor assembly, and releasable on uphole movement. A downhole end of the packer assembly comprises a slider having tone or more radially-extending, slot-engaging pegs. The anchor assembly comprises a guide housing having one or more guide slots formed therein. The pegs engage the guide slots during axial reciprocation of the slider to reposition the slider and tools connected thereto between the various shifting modes. The slider is rotatable about the axis of the packer assembly for enabling a rotational guided vector along the guide slots should the housing be non-rotatable. The guide slot has a generally axial slot profile that advances axially and rotationally between an intermediate downhole position for run-in mode, and uphole position for ready mode and guide slot cycling, and a downhole position for enabling packer actuation in set mode. The extreme downhole position is typically beyond that required to set the packer to ensure full actuation.

BRIEF DESCRIPTION OF THE DRAWINGS

FIG. 7A illustrates an enlarged view of the packer and anchor portion of the BHA of FIG. 5 shown in the run-in mode;

FIG. 7B shows the J-slot guide and a peg of BHA of FIG. 7A with the slider removed for clarity;

FIG. 10 illustrates fluid bypass of the packer and pressure equalization during run-in, pull-out and hold modes;

FIG. 11 illustrates packer set mode, isolating the wellbore above and below the BHA and fluid treatment operations through the treatment port;

FIG. 12 illustrates flushing of the packer and fluid balancing between the conveyance string and tool annulus through the treatment port;

FIG. 13 illustrates pull-up and packer release mode and fluid balancing and equalization above and below the BHA through the bypass valve;

FIG. 14 illustrates a pull-out-of-hole (POOH) mode with fluid balancing through the BHA;

FIG. 16A illustrates a handing or commencement of a run-in stage, wherein the first assembly is moving downhole towards the second assembly, collapsing the telescoping coupling therebetween;

FIG. 16B illustrates the run-in stage in which the conveyance string is pushing the BHA, the first assembly engaging the second assembly and pushing the second assembly downhole;

FIG. 16C illustrates a J-slot cycling stage, wherein the second assembly is cycled uphole for arranging the slider peg in the J-slot for set-down mode and enabling setting of the packer;

FIG. 16D illustrates the packer set stage, wherein the second assembly can telescopically collapse into the third assembly for engaging the cone and slips and compressing the packer, treatment operations being enabled;

FIG. 16E illustrates the operation of the BHA of FIG. 1A in a packer unset stage, wherein the conveyance string is pulled uphole and the mandrel's stop nut pulls the second assembly uphole for releasing the packer;

FIG. 16F illustrates a zone re-positioning or pull-out-of-hole (POOH) stage, the second assembly engaging the third assembly for pulling all three assemblies of the BHA uphole;

FIG. 18A illustrates fluid flow paths when the packer is in set mode for enabling fluid treatment of the wellbore or when fluid is flushed through the treatment fracturing ports of the blast joint;

FIGS. 22A through 34 illustrate an alternative embodiment of the BHA having an added selector valve for direct control of the treatment port and avoiding the need for a ball drop sub for initiating jet;

FIG. 22A illustrates a selector valve in the blast joint of the BHA in a closed condition;

FIG. 22B illustrates the selector valve of FIG. 22A in an open condition;

FIG. 23 illustrates a delimit shoulder between the blast joint and the mandrel for establishing range of motion of the selector valve;

FIGS. 24A through 25C illustrate the operation of the selector valve of FIG. 22A, namely FIG. 24A illustrates the run-in stage, wherein the first assembly approaches the second assembly, opening the selector valve and closing the bypass valve;

FIG. 25C illustrates the fluid pass when the selector valve of FIG. 22A is closed for flushing treatment fluid through the nozzles of the jet sub;

FIG. 26 illustrates a selector valve in the blast joint of the BHA in an open condition, according to another embodiment;

FIG. 35 illustrates the BHA in a pull-up mode with the selector valve closed and a bypass valve open, the completion string omitted for clarity;

FIG. 36 illustrates the BHA in a set down mode with the selector valve open and the bypass valve closed, the completion string omitted for clarity;

FIGS. 37, 38 and 39 are separate cross-sectional views of the three assemblies of the BHA, respectively illustrating the first tubular flow control assembly with a mandrel and bypass valve plug, the second tubular packer assembly, and the third tubular anchor assembly with attached casing collar locator;

FIG. 40 is a close up view of the BHA run into a completion string with the bypass valve in an open position;

FIG. 41 is a close up view of the bypass valve in a closed position;

FIG. 42 is an expanded view of the treatment port and bypass port interfaces of the BHA shown in the completion string and illustrating the fluid flow paths with the selector valve closed to block the treatment ports and the bypass valve open to open an flow path and equalize pressure therethrough;

FIG. 43 is an expanded view of the treatment port and bypass port interfaces of the BHA shown in the completion string and illustrating the fluid flow paths with the selector valve open to flow treatment fluid through the treatment ports or flush therethrough, the bypass valve being closed to isolate the tool annulus uphole from the wellbore below the BHA;

DETAILED DESCRIPTION

Figure 1A:
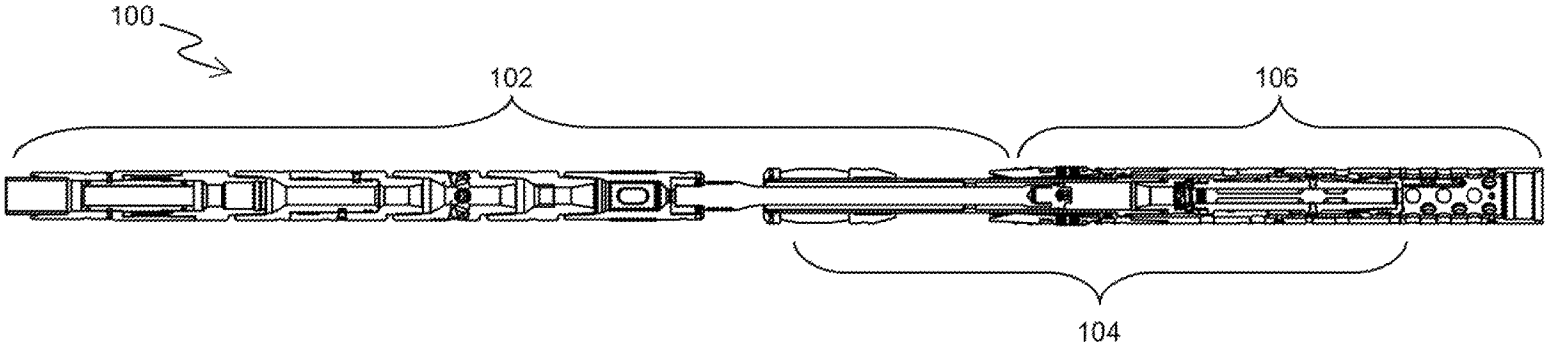
FIG. 1A illustrates a cross-sectional view of a three-assembly bottom hole assembly (BHA) in a packer-unset configuration, according to an embodiment of the present disclosure.

In embodiments described herein, a bottom hole assembly (BHA) is implemented in the completion of wells. The BHA is typically conveyed on a tubular string such as coiled tubing (CT) for deployment downhole into a wellbore. The BHA is operable in wellbores having casing or completion strings that either do not have existing perforations or operable for completion strings previously fit with ported openings and port-actuating sleeves. Typically sleeve-actuated ports are incorporated into the completion string at intervals therealong and the ports are initially closed by the sliding sleeves. Operations including fluid treatment and fracturing are performed when the sliding sleeve or sleeves are selectively actuated to open the respective ports. Each sleeve and corresponding port or ports are generally opened in a bottom-to-top of the well sequence (from a toe to a heel of the well in a horizontal well), depending on the wellbore configuration.

Operations using such a BHA in wellbores are typified by periodic repositioning of the BHA and sealing of a tool annulus between the BHA and the completion string. As in other known BHA's, such sealing is accomplished with resettable packers. Release of the BHA from the completion string and movement therein is facilitated by enabling fluid communication across the BHA for equalizing pressure in the wellbore above and below the BHA. Further, BHA operation can be implemented despite circumstances that are characterized by accumulations of debris about the BHA that can otherwise interfere with BHA movement. The BHA can either open or close port-actuating sleeves or locate an abrasive jet tool for forming ports.

Embodiments of the BHA described herein provide a robust and simplified assembly of components for providing improved performance and variety of fluid treatment, pressure equalization, debris clearance and jamming recovery options.

The BHA comprises three telescopic assemblies, telescopically coupled, namely: a first assembly supported by the conveyance string, a second intermediate assembly, and a third downhole assembly. The first assembly is a flow control mandrel, the second assembly is supports a packer and the third assembly supports a slip assembly and a shifting device for selective operation of the second and third assemblies. There are several embodiments of the first flow control assembly related to the management of the treatment port, whether is always open or selectively open.

The first assembly has a first bore contiguous with the conveyance string and includes a coupling mandrel that fits telescopically in a second bore of the second assembly. The second assembly comprises a tubular actuator sleeve that fits telescopically within a third bore of the third assembly. The third assembly is a tubular guide housing that receives the second assembly and controls the relative position of the second and third assemblies for packer setting, release and flow control associated with the BHA.

The second packer depends downhole from the first uphole assembly and the third slip assembly depends downhole from the second packer assembly. The second and third assemblies can be pulled uphole by pulling the conveyance string uphole and connected first assembly. Further, downhole manipulation of the first assembly drives the second assembly into the third assembly, controlled by the shifting device for controllably releasing and setting the packer and slips.

The second packer and third slip assemblies are telescopically manipulated relative to each other for operating the resettable packer for releasable positioning and sealing of the BHA in the completion string. Telescopic manipulation actuates the packer assembly as required for sleeve operation and fluid operations including perforation jetting or delivery of treatment fluids or for fluid flow through the BHA, the arrangement of the first, second and third assemblies being both robust and indifferent to accumulations of sand and other debris.

The first and second assemblies form a BHA bypass valve for enabling pressure equalization across the BHA and an actuator for the resettable packer. Further, in the event of an accumulation of debris, typically in the tool annulus resting upon the uphole face of the packer, the second assembly is fit with a fluid flow outlet adjacent the packer's uphole face for substantially complete fluid access thereto and clearing of such accumulations.

The second and third assemblies form two corresponding portions of the resettable packer. An uphole end of the second assembly's actuator sleeve supports the packer's upper stop and also receives set down loading from the conveyance string through a downhole shoulder on the blast joint of the uphole first assembly. A flow outlet seal between the coupling mandrel adjacent the blast joint and a bore of the actuator sleeve releasably and telescopically couple for controllable flow and pressure equalization between the tool annulus and a downhole bore of the BHA for communication with locations below the packer. The second packer assembly comprises an actuator sleeve extending into and having delimited movement within the third assembly. The actuator sleeve is movable within the guide housing, forming a resettable packer arrangement, such as a J-slot housing.

The actuator sleeve terminates in an actuator slider coupled within a J-slot guide. Unlike prior art J-slot mechanisms known to Applicants, the J-slot guide is supported in a housing that may rotate, but need not to rotate, for shifting movement. In the prior art, J-slot's housing, being closely sized to and adjacent the casing or completion string, is subject to accumulation of sand and debris between the housing and the completion string, jamming the housing and rendering the shifting device inoperable. Herein, the J-slot actuator slider is rotatable to permit the slider and guide pegs to track the non-rotating guide slots. The actuator slider is within the bore of the housing and less subject to debris-related jamming. As a result, the BHA can be released despite a jammed housing, the BHA otherwise being rendered immobilized. In the event the slider rotational coupling fails, one could fall back to conventional methodology of relying on rotation of the J-slot housing.

Embodiments of the BHA enable significantly shorter sleeves and ported sleeve subs or housings than do conventional sliding sleeves and subs. Prior art locatable sleeves, that implement a locator profile at a downhole end of the sleeve, also require longer sleeves so as to space the end of the sleeve and tool-implemented locator apparatus sufficiently from the tool's sleeve-actuating slip and packer. In other words, the sleeve must be long enough to accommodate at least the BHA's resettable packer and the BHA's locator apparatus. Further, the prior art locator, restricted to operate in the restricted diameter of the sleeve sub while maintaining the larges flow-through bore possible, are also limited in their radial engaging-load, reducing feedback and increasing the risk of failure of sleeve detection.

Herein, embodiments of the present BHA enable shortening of the sleeves to about ½ of the length of conventional prior art locator-type sleeves. Applicant understands that prior art locator-type sleeves are typically about 7-8 feet in length whereas, in embodiments disclosed herein, the sleeves are able to be shortened to about 3 feet in length. Thus, overall costs for a completion string bearing a multiplicity of sleeves can be significantly reduced. A collar locator, spaced from the ported sleeve sub and radial constraints of the BHA adjacent the resettable packer, can be more robust and exert stronger radial load with improved success of detection.

Accordingly in embodiments disclosed herein, several design choices result in a shortening of the sleeves. The resettable sealing element is positioned adjacent and downhole of the fluid treatment sub or blast joint resulting in a significant reduction in the length of the ported tubular housing and its sleeve. Further, as the present invention also locates the sleeve for operation positioning and sleeve manipulation, the BHA further comprises a collar locator, such as a conventional casing locator (CCL), which detects the collars or custom collars located a known distance uphole of the collar, rather than a bottom of the sliding sleeve, as in the prior art locator sleeve technology. Thus, the casing collar locator is used to locate the BHA based on a location of the collar adjacent and downhole of the ported sub so as to appropriately position the BHA's treatment ports at or near the ported sub's ports. Each of the ported subs and corresponding sleeves need not be as long as in the prior art and the CCL does not need to be a specialized locator dedicated to detecting a profile at the lower end of the prior art ported sub and sliding sleeve therein. The CCL is spaced below the resettable sealing element by a length of relatively inexpensive pup joint. In embodiments, the collar can be aggressively profiled to aid in positive detection by the CCL.

The first and second assemblies telescope uphole and downhole for alignment of various seals and ports for alternately enabling treatment or BHA fluid bypass. The first and second assemblies enable or activate bypass or pressure equalization and to deactivate pressure equalization so as to isolate the wellbore below the BHA during treatment operations. In one embodiment, the treatment port or blast joint, for the flow of treatment fluid therethrough, is separate and apart from the bypass valve and resettable packer actuator and enables flow of treatment fluid through the conveyance string or coiled tubing, through the tool annulus or both. In another embodiment, the treatment port is implemented through an alignment of the first and second assemblies.

Figure 1B:
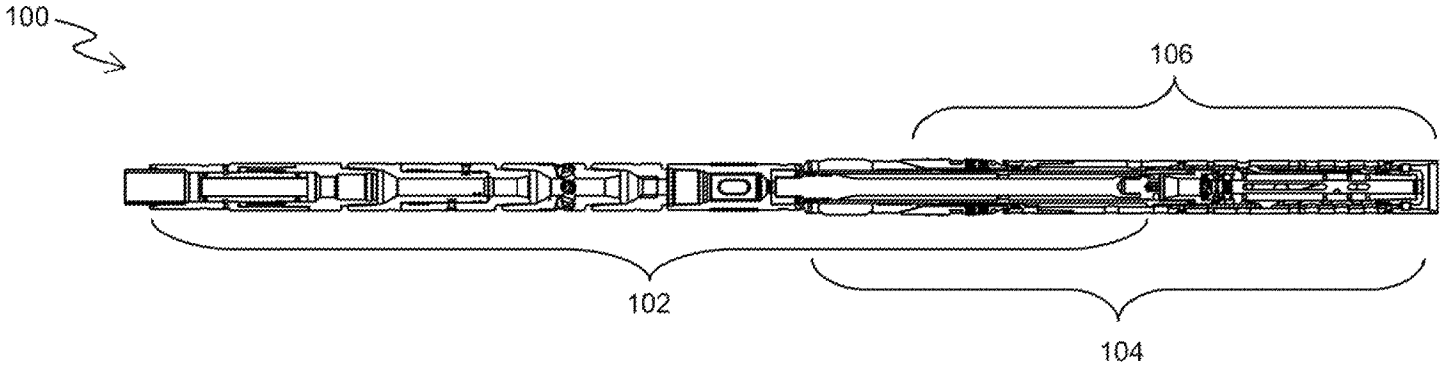
FIG. 1B illustrates the BHA of FIG. 1A in a packer-set configuration.

Turning to FIGS. 1A and 1B, a BHA 100 is illustrated for completion operations in a casing or completion string 200. The BHA 100 comprises, from an uphole end to a downhole end (i.e., from the left hand side to the right hand side of FIGS. 1A and 1B), a first flow control assembly 102 that is axially and moveably coupled to a second intermediate packer assembly 104, which in turn is axially and moveably coupled to a third downhole slip assembly 106. While not shown in FIGS. 1A and 1B, the slip assembly 106 may be further coupled to an end unit, such as that having a casing collar locator (CCL) (see CCL 990 in FIG. 35) and a bottom hole or toe assembly (See toe sub 300 in FIGS. 46A and 46B) downhole thereof.

As shown in FIG. 1A, the BHA is telescopically extended, the packer and slips being released and the bypass valve (described in more detail later) being open for fluid flow through the BHA. In FIG. 1B, the BHA is shown telescopically collapsed, the slips and packer being set and the bypass valve being closed such as when in-place for delivering treatment fluid to the wellbore above the resettable packer. The bypass valve, when closed, isolates treatment fluid from the conveyance string or the tool annulus uphole of the BHA 100 from the wellbore or tool annulus downhole of the BHA.

Figure 2:
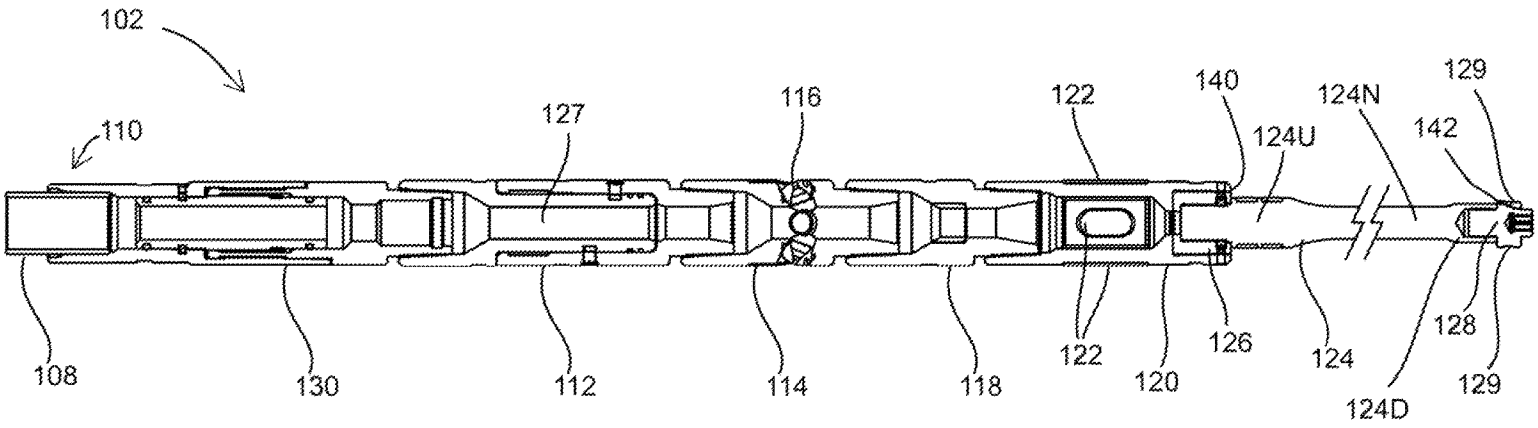
FIG. 2 illustrates the first assembly of the BHA of FIG. 1A.

As shown in FIG. 2, the flow control assembly 102 is secured to a conveyance string of coiled tubing 108 at an uphole end 110 thereof, and can further comprise a plurality of tool subs coupled one to another, including an emergency release sub 112, a fluid jetting assembly or jet sub 114 having one or more nozzles 116, a ball seat 118, and a fracturing port sub or blast joint 120 having one or more treatment fracturing ports 122. The flow control assembly 102 may also comprise other subs 130 uphole of the blast joint 120. The tool subs have a first bore 127 are in fluid communication to each other and to the coiled tubing 108 such that treatment fluid may be delivered from the surface via the coiled tubing 108 to the jet sub 114, in which treatment fluid can be delivered through the nozzles 116, or to the blast joint 120 and out of the treatment fracturing ports 122.

In this embodiment, the blast joint 120 is coupled to the uphole end of the coupling mandrel 124 via a threaded adapter 126. The coupling mandrel 124 is a substantially cylindrical member having an uphole seal portion 124U, a reduced-diameter intermediate body portion 124N, and a downhole stop portion 124D. The uphole seal portion 124U extends downhole from the blast joint 120 and has a diameter smaller than that of the blast joint, forming a downhole-facing annular shoulder 140 on the blast joint 120. The annular shoulder 140 forms an actuating shoulder of the first assembly 102 for engaging the second assembly 104. The downhole stop portion 124D of the coupling mandrel 124 comprises a stop nut 128. The stop nut 128 is splined so as to pass fluid thereby for flow along the body portion 124*n*. The stop nut 128 forms an actuating interface to the second assembly 104.

Figure 3:
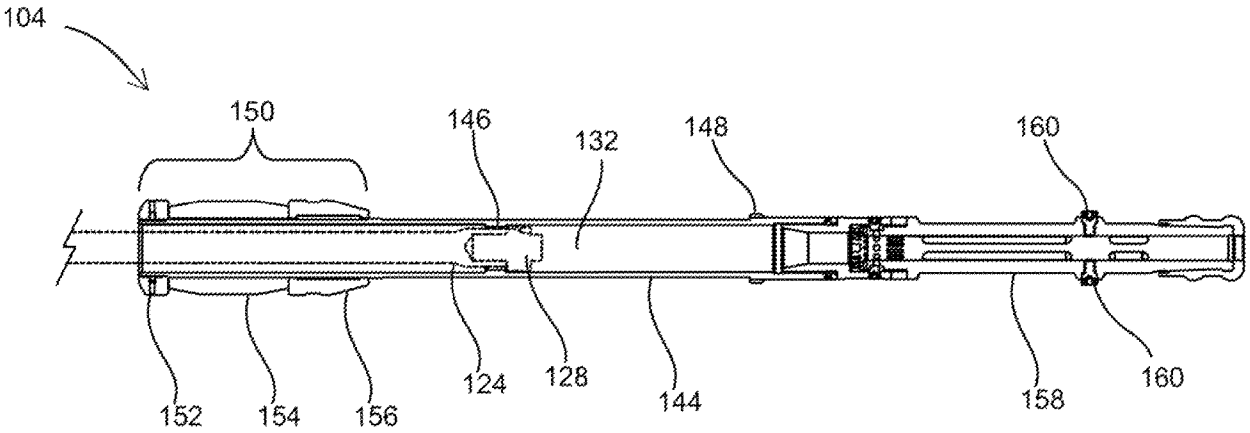
FIG. 3 illustrates the second assembly of the BHA of FIG. 1A.

As shown in FIG. 3, the second assembly 104 comprises a tubular actuator sleeve 144 having a second actuator bore 132 for axially and moveably receiving the coupling mandrel 124 therein. The actuator bore 132 of the actuator sleeve 144 comprises an annular stop shoulder 146 intermediate the length thereof, extending inwardly from the inner surface of the actuator sleeve 144. The stop nut 128 comprises three or more radially outwardly extending protrusions 129 each having an uphole shoulder 142. The protrusions 129 of the stop nut 128 extend substantially across the bore 132 of the sleeve 144 and form circumferentially-spaced fluid passages therebetween.

The diameter of the intermediate shaft portion of the coupling mandrel 124 is smaller than the inner diameter of the actuator sleeve 144 such that the coupling mandrel 124 engages the actuator sleeve 144 to form a bypass valve for pressure equalization and packer circulation operations in a simple and robust assembly.

The protrusions 129 of the stop nut 128 are configured to engage the uphole-facing shoulders 146 of the actuator sleeve 144 so as to pull the second assembly 104 uphole. The actuator sleeve 144 is coupled with the guide housing to both couple the second and third assemblies such as to pull the third assembly 106 uphole and to enable telescopic repositioning therebetween.

The actuator sleeve 144 supports a releasable packer assembly 150 thereabout, which comprises, viewed from an uphole end to a downhole end thereof, a packer upper stop 152 secured to the uphole end thereof, a packer 154 and a wedge cone 156. A J-slot slider 158 is connected, such as through threaded connection, to the downhole end of the actuator sleeve 144. The J-slot slider 158 comprises radially-extending pegs 160. The J-slot slider 158 and pegs 160 cooperate with a J-slot shift housing 170 (see FIG. 4) for enabling at least three axial positions: as run in or ready-mode, the set mode, and a pull up or release position or mode.

Figure 4:
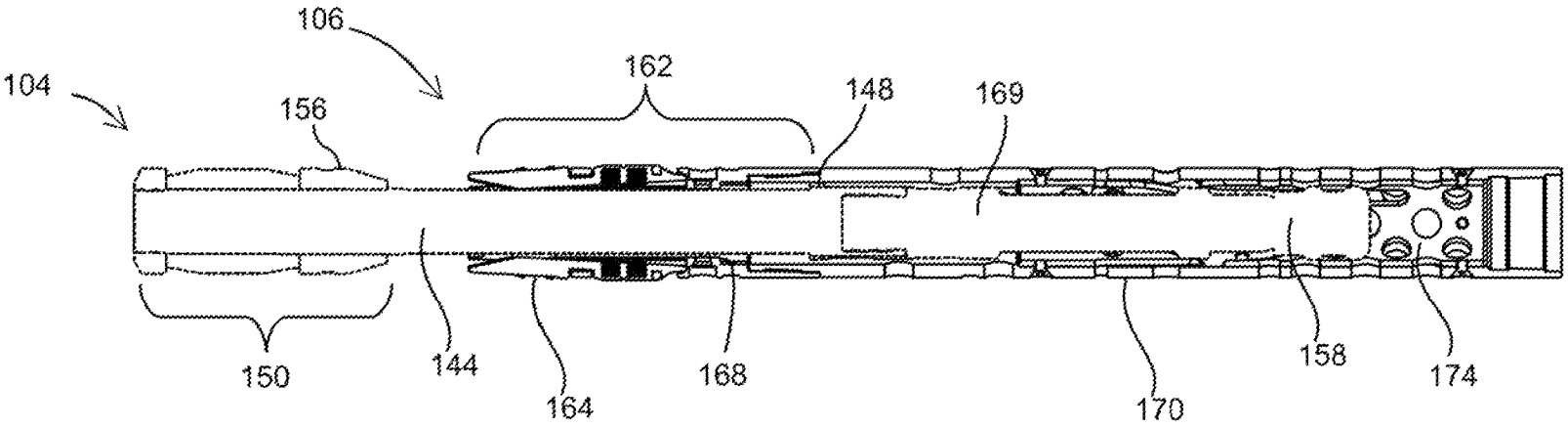
FIG. 4 illustrates the third assembly of the BHA of FIG. 1A.
Figure 5:
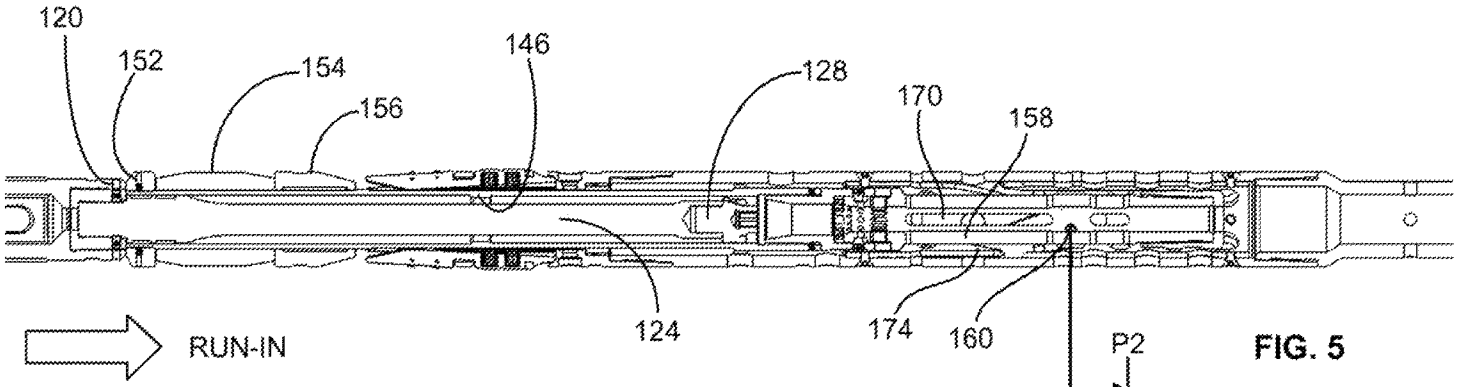
FIG. 5 illustrates a portion of the BHA of FIG. 1A in a ready-mode, run-in mode with the packer unset.
Figure 6:
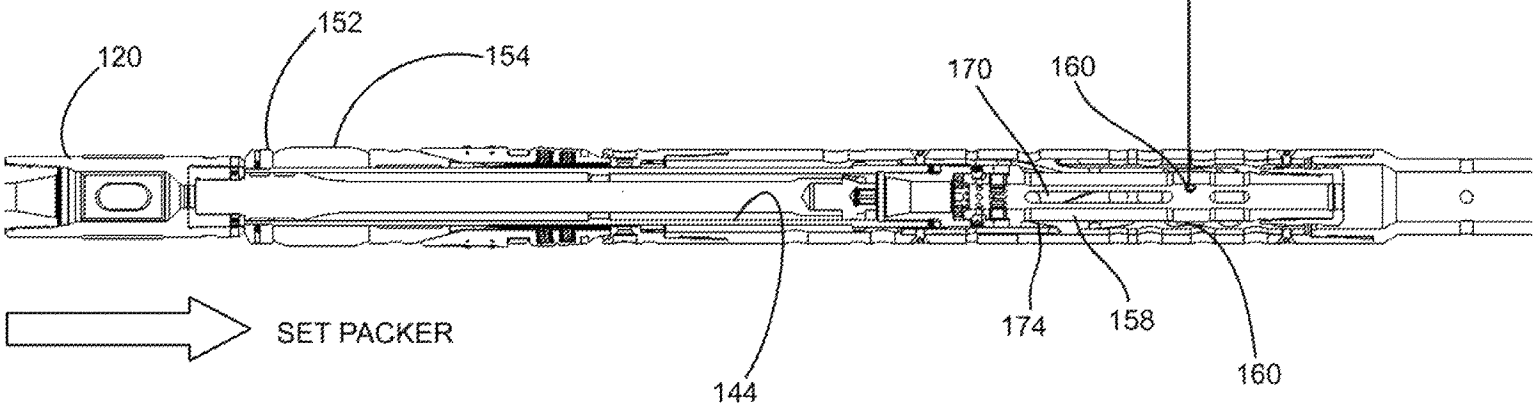
FIG. 6 illustrates a portion of the BHA of FIG. 1A in a set mode.

As shown in FIG. 4, the third assembly 106 comprises a tubular guide housing comprising a slip assembly 162 having a plurality of slips 164 arranged circumferentially about an uphole end for releasably engaging the second assembly's wedge cone 156 to set the BHA in the completion string. The guide housing has a third bore 169 further comprising an inner annular shoulder 168 for engaging the outer extrusion 148 of the actuator sleeve 144 to pull the third assembly 106 uphole (described in more detail later). The slip assembly 162 is coupled, at a downhole end thereof, to the J-slot shift housing 170 and housing therein the double start J-slot guide profile 174 for controlling the actuation of the slips 164 supported thereon. While not shown in FIG. 4, the J-slot shift housing 170 for the J-slot may be further coupled at its downhole end to a casing collar locator (CCL) (see CCL 990 in FIG. 35) and a bottom hole or toe assembly (See toe sub 300 in FIGS. 46A and 46B).

The third assembly 106 receives, from an uphole end, the actuator sleeve 144 and the J-slot slider 158 of the second assembly 104 that are both telescopically moveable therein.

With reference to FIGS. 5 through 15B, and while one might rely on BHA weight in vertical wells to avoid accidental packer actuation, more reliable means are provided for most resettable packers and particularly for horizontal wells, typically employing J-slot actuation or other suitable mode selection apparatus, for retaining the slips in the run in or ready-mode (FIG. 5), the set mode (FIG. 6), and a pull up or release mode (FIGS. 13 and 14), as is understood in the art.

Downhole and uphole movement of the second assembly 104 is delimited by the J-slot arrangement. Herein, pair of the radial extending J-slot followers or pegs 160 (see FIG. 3), are secured to extend radially from the J-slot slider 158 so as to slidably engage a J-slot profile 174 in the guide housing 170 of the third assembly 106. Also referring to FIG. 8, the double start J-slot guide profile 174 and the pegs 160 provide three operating positions, i.e., an uphole, pull up or release delimited position (PULL UP position P1), a downhole set delimited position (SET position P2) and an intermediate downhole delimited run in position (RUN IN position P3), each position corresponding to an operation stage. The J-slot slider 158 and pegs 160 therefore operates with the J-slot guide profile 174 for guiding the operation of the BHA in various operation stages.

The J-slot slider 158 is rotatably coupled to a downhole end of the second assembly 104. The slider 158 is fixed axially with respect to the second assembly 104 but is rotatable to permit the pegs 160 to track the guide slots. One form of rotational coupling is an annular groove formed in the slider 158 fixed axially using set screws, the groove rotatable about the set screws.

Figure 16A:
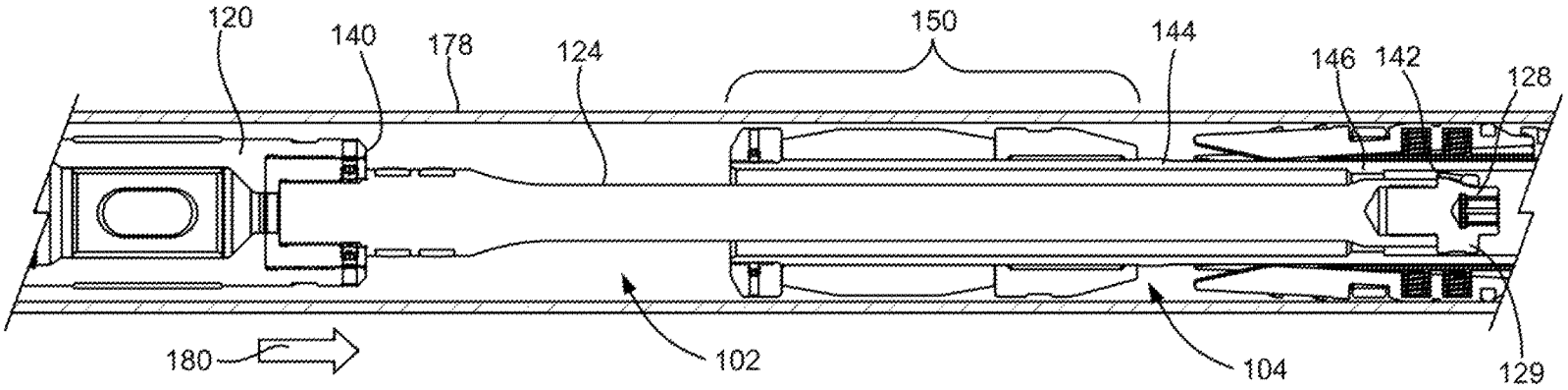
FIGS. 16A through 16F illustrate the operation of the first assembly and depending mandrel and the tubular packer assembly of the BHA of FIG. 1A from a run-in to the pull-out-of-hole modes, namely.

The three assemblies 102, 104 and 106 are telescopically moveable relative to each other in various operation stages. Turning to FIG. 16A, when running in or positioning the BHA 100 (RUN IN stage), the first assembly 102, including the blast joint 120, the coupling mandrel 124 and the stop nut 128, moves downhole in the casing 178, as indicated by the arrow 180.

Figure 16B:
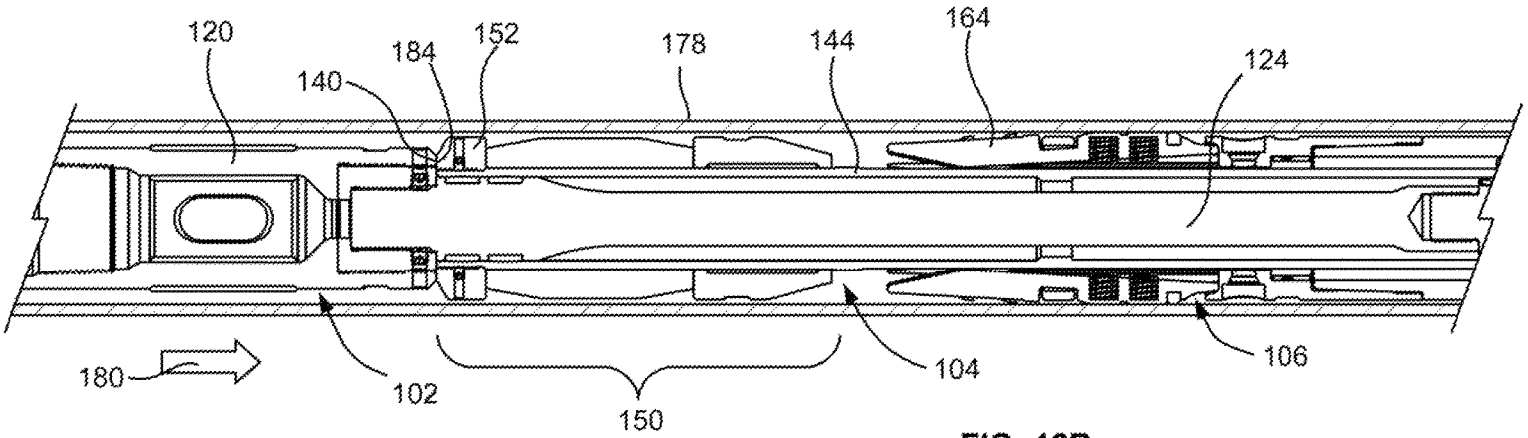

As shown in FIG. 16B, when the downhole-facing shoulder 140 of the blast joint 120 engages the uphole end 184 of the upper stop 152 of the packer assembly 150, the blast joint 120 pushes the second assembly 104 downhole towards the third assembly 106 (RUN IN stage). At this stage, the coupling mandrel 124 is fully engaged with the second assembly 104. However, as shown in FIGS. 7A and 7B, the J-slot is conditioned to the RUN IN (P1) position, and limits the telescopic movement of the second assembly sleeve or actuator sleeve 144 in to the third assembly so that the packer assembly 150 is adjacent but spaced from the slips 164, avoiding setting of the packer 154. The BHA 100 freely runs downhole and wellbore fluid can bypass the packer 154 along the tool annulus.

Such J-slot actuation provides a reliable means for avoiding accidental packer actuation, particularly for horizontal wells, although one might rely on BHA weight in vertical wells to avoid accidental packer actuation. Other means for avoiding accidental packer actuation may also be used for retaining the slips in a run in or ready-mode P3, the set mode P2, and a pull up or release mode P1, as is understood in the art.

When the BHA 100 is at the location determined by the CCL, such as at a port sleeve, the packer 154 is set.

Figure 8:
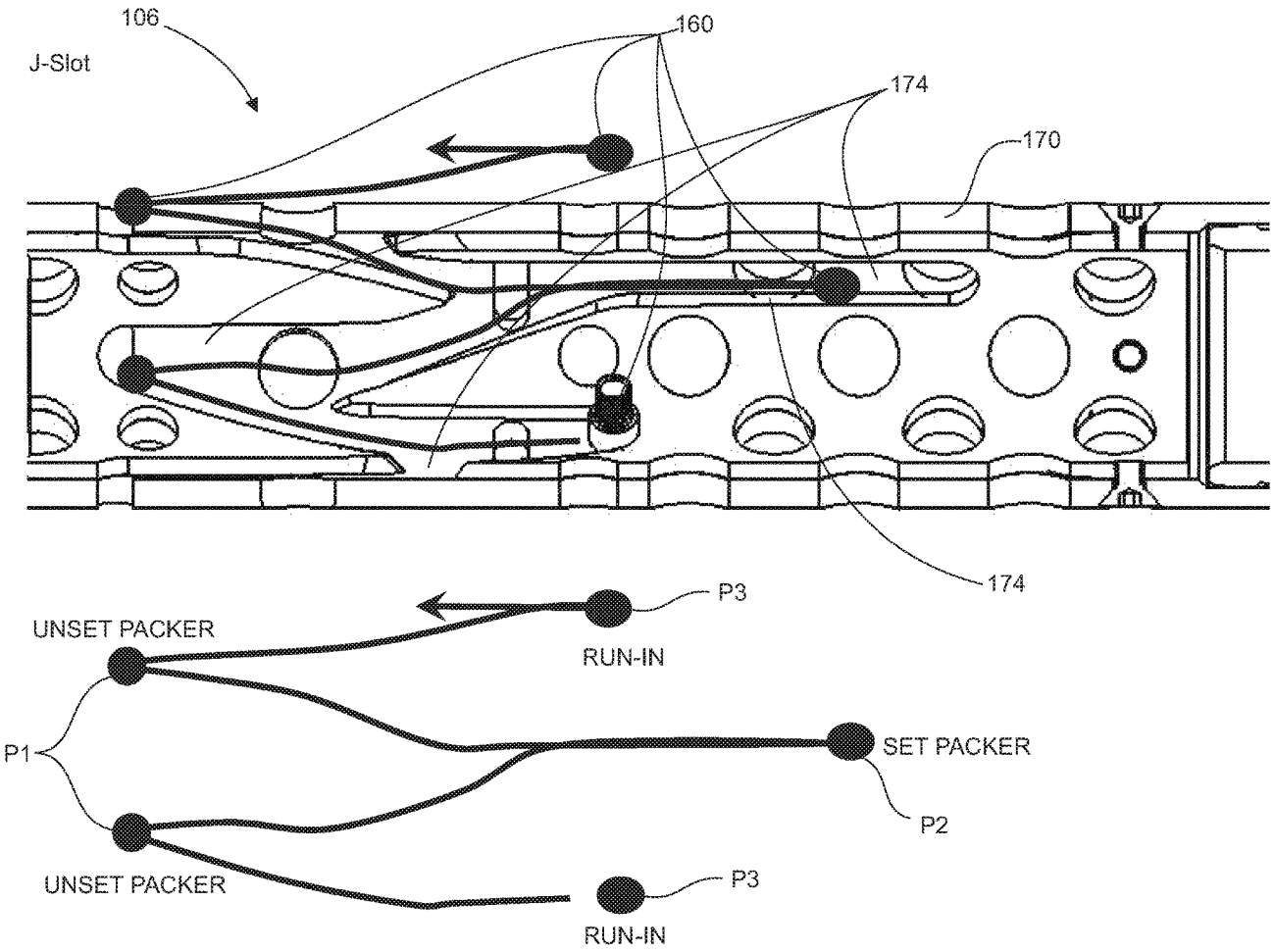
FIG. 8 shows a cross-section of the slot portion and range of peg positions in the J-slot guide for run-in, unset and packer set modes.
Figure 16C:
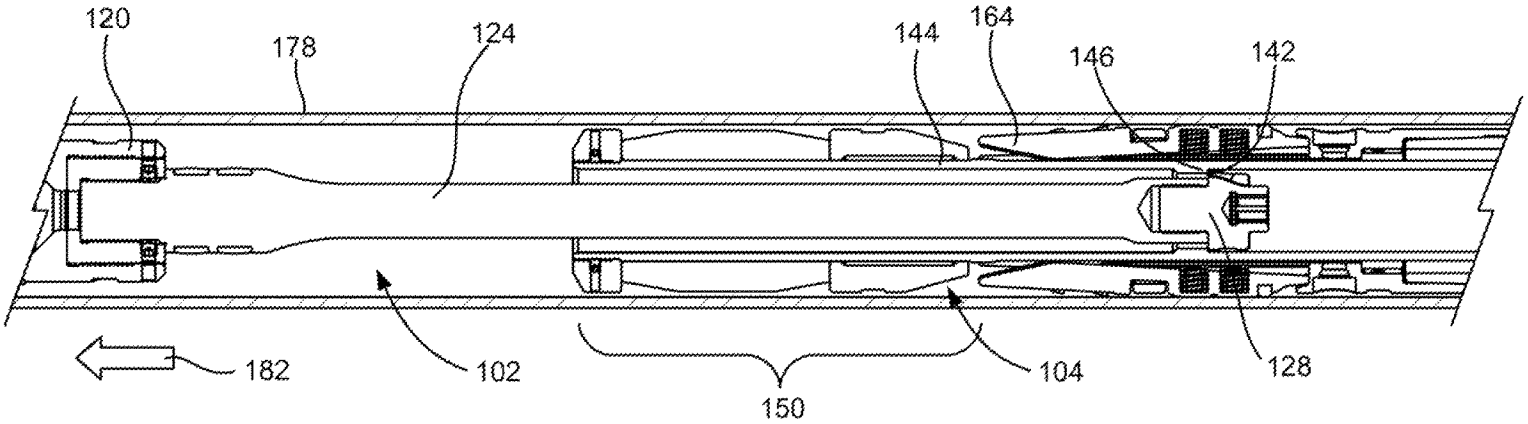

As shown in FIGS. 16C and 2, the coiled tubing 108 is pulled up to cycle the J-slot (J-SLOT CYCLING stage). As shown in FIG. 8, the peg 160 cycles from position P3 through position P1. More particularly, the lifting of the coiled tubing 108 pulls up on the coupling mandrel 124 as indicated by the arrow 182, moving it uphole. When the one or more uphole-facing shoulders 142 of the stop nut 128 engages the annular stop shoulder 146 of the actuator sleeve 144, the second assembly 104 is then also pulled uphole, thus pulling the J-slot slider 158 and pegs 160 uphole, cycling the J-slot to the PULL UP position P1.

When required, the J-slot is positioned to shift to a full set down P2 (SET) position to allow the second assembly 104 to move deeper downhole into the third assembly 106 and actuate the packer 154.

Figures 9A, 9B:
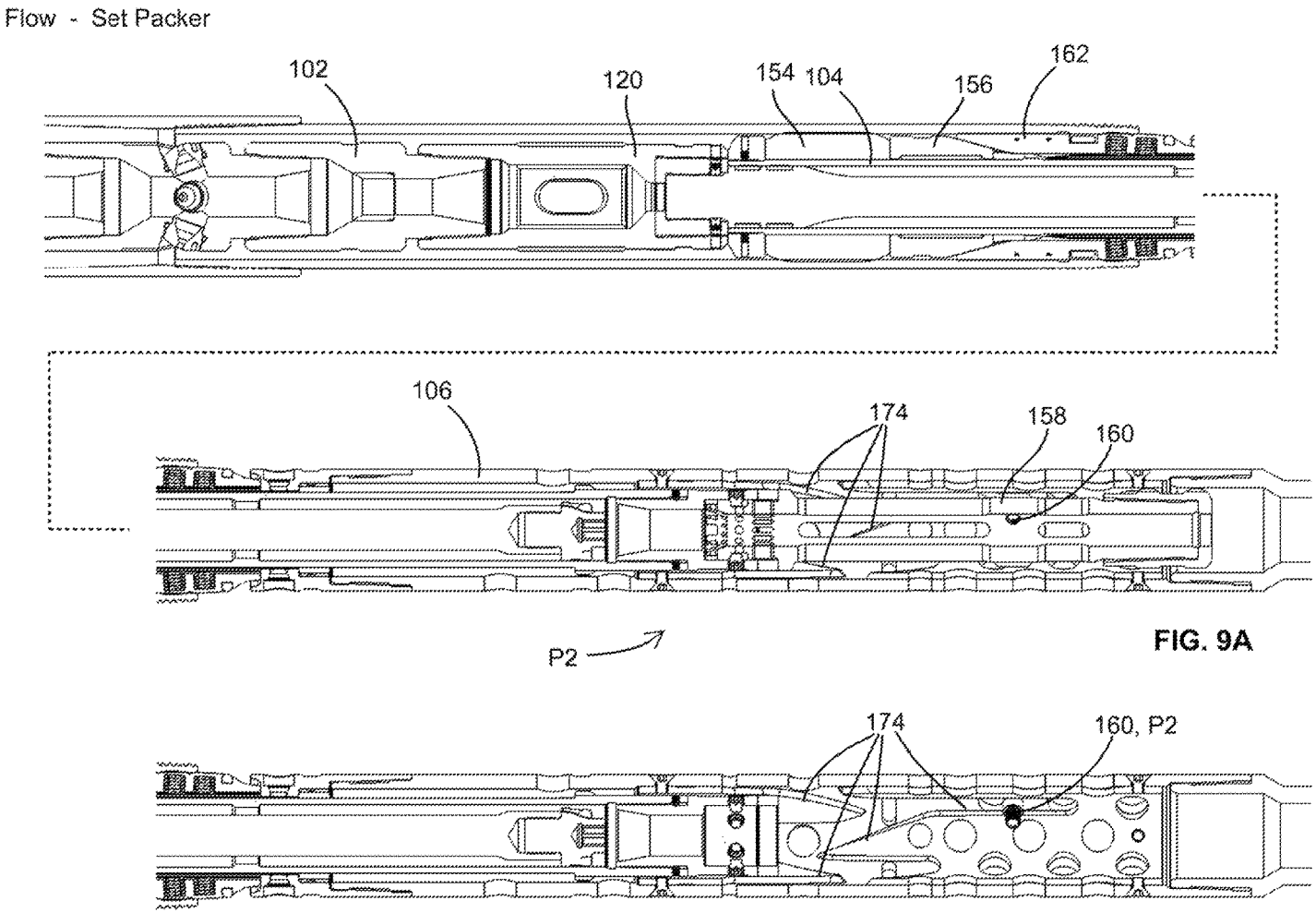
FIG. 9A illustrates an enlarged view of the packer and anchor portion of the BHA of FIG. 5 in a packer set mode.
FIG. 9B shows the J-slot guide and a peg of BHA of FIG. 9A with the slider removed for clarity.
Figure 10:
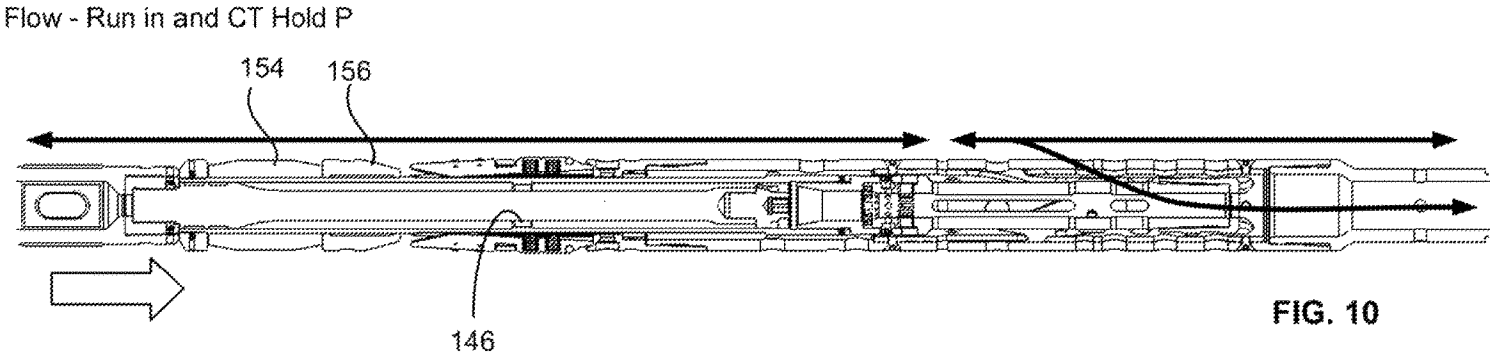
FIGS. 10 through 14 are cross-sectional views of the BHA of FIG. 1A illustrating various BHA configuration and the fluid flow modes resulting therefore. More particularly.
Figure 11:
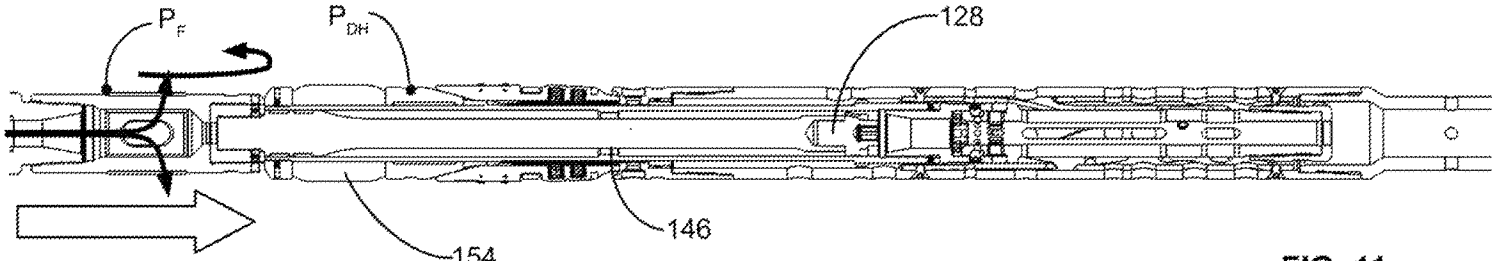
Figure 12:
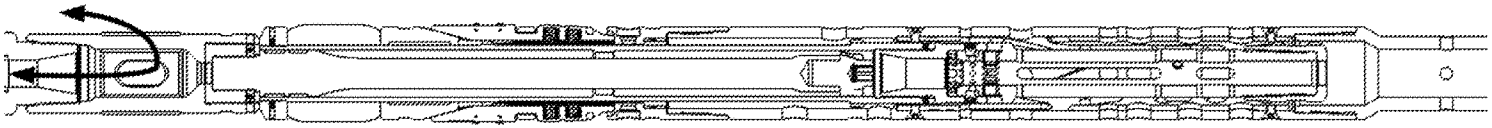
Figure 13:
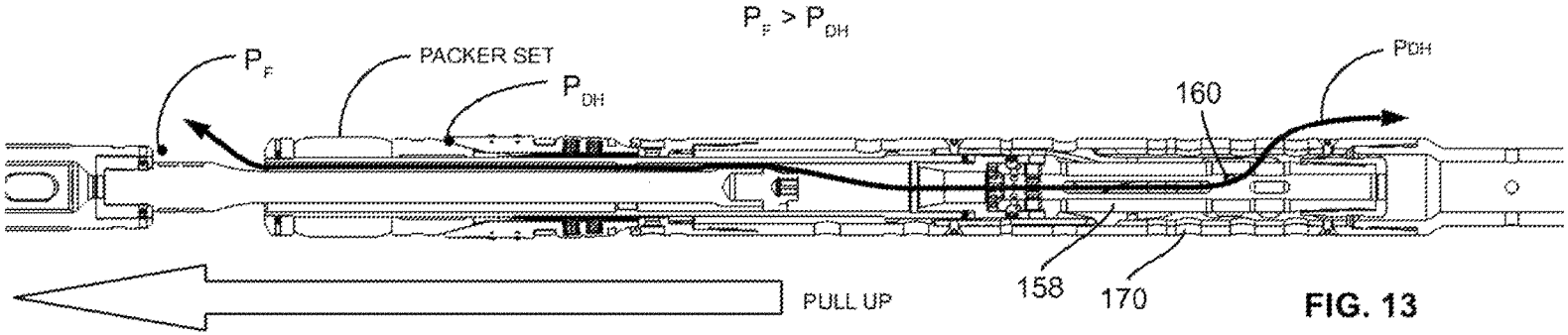
Figure 14:
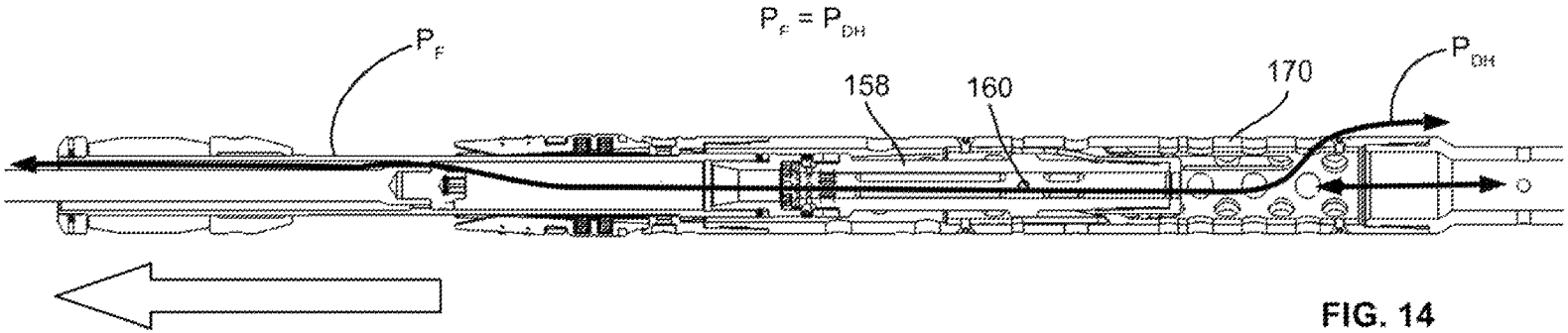
Figures 15A, 15B:
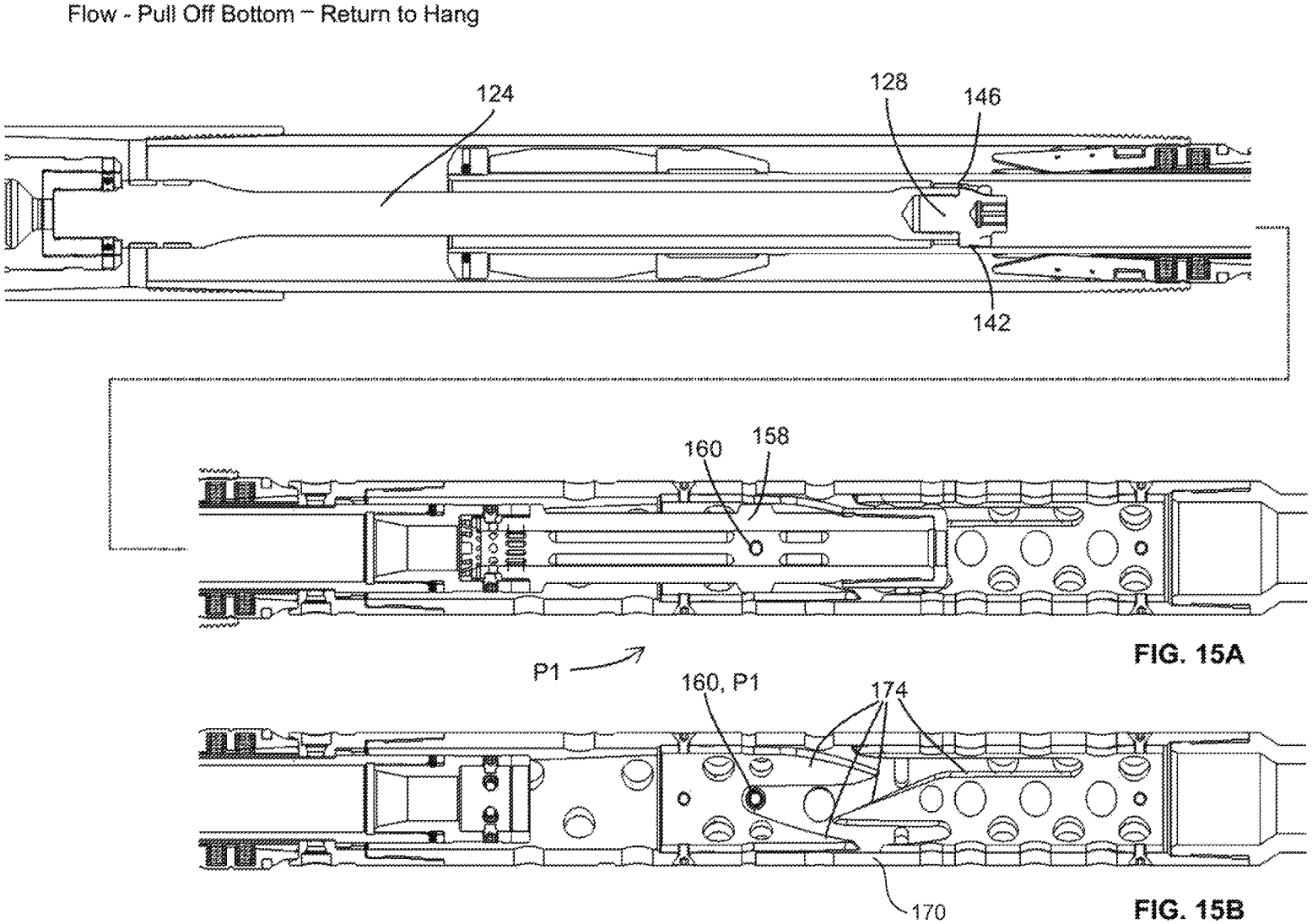
FIG. 15A illustrates an enlarged view of the packer and anchor portion of the BHA of FIG. 5 in a packer pull-up or release mode.
FIG. 15B shows the J-slot guide and a peg of BHA of FIG. 9A with the slider removed for clarity.
Figure 16D:
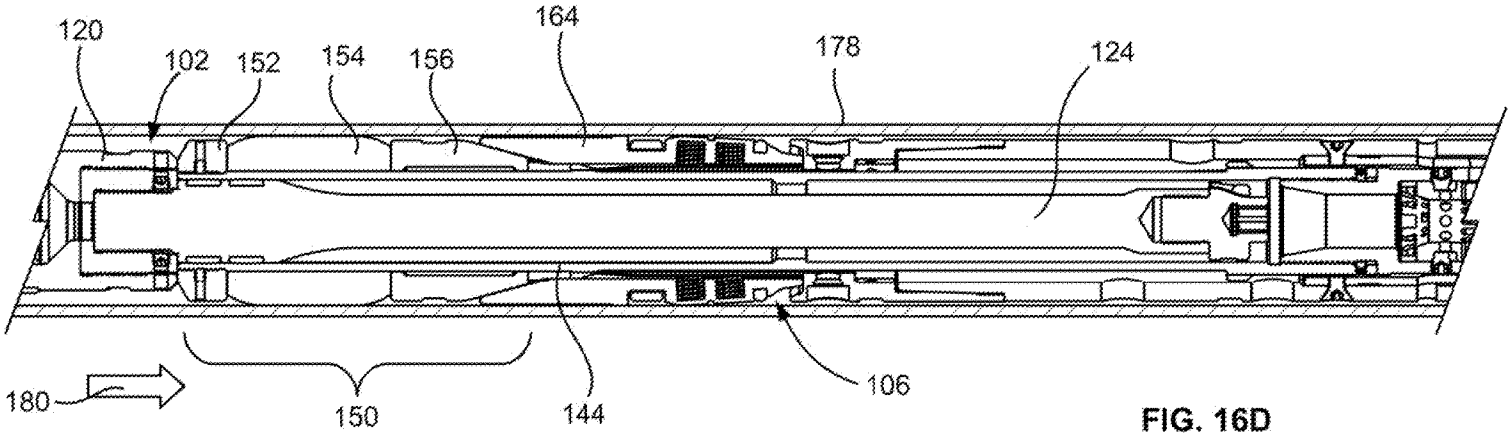

As shown in FIG. 16D, and FIGS. 9A and 9B, after cycling the J-slot, the coiled tubing 108 can again move downhole as indicated by the arrow 180, driving the blast joint 120 of the first assembly 102 to re-engage the upper stop 152 of the packer assembly 150. The upper stop 152, secured to the actuator sleeve 144, drives the actuator sleeve 144 downhole. As shown in FIGS. 9A and 9B, the pegs 160 are free to move downhole to the P2 position. Before the pegs 160 bottom out in the J-slot, the wedge cone 156 comes into contact with the slips 164. The actuator sleeve 144 moves relative to the J-slot shift housing 170, moving downhole and the wedge cone 156 drives the slips 164 radially outward, actuating the slips 164 to engage the completion string 200, such as at a ported sleeve sub 202 for a sleeve 204 of interest (PACKER SET stage). Once the slips set, movement of the set BHA can operate to shift such sleeves 204 for opening or closing operation.

Actuated slips 164 arrest further downhole movement of the J-slot housing 170 and of the wedge cone 156. Further set down weight applied from the coiled tubing 108 compresses the packer 154 sandwiched between the upper stop 152 and the wedge cone 156, actuating the packer 154 to radially expand and seals the completion string. Typically a set down load of several thousand pounds is required to set the packer.

Those skilled in the art appreciate that other means or shifting tools compatible with the sleeve may alternatively be used to shift the sleeve including collets and profiled sleeves. Those skilled in the art appreciate that the slips 164 and packer 156 can also be used to engage the casing 178 and seal the wellbore below the BHA for securing the BHA therein.

Figure 16E:
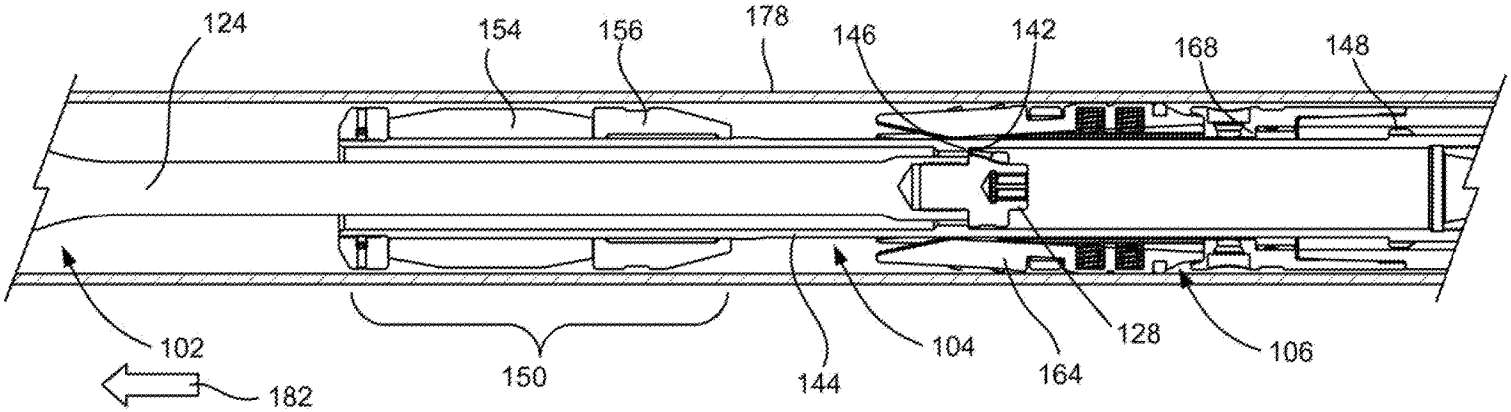
Figure 16F:
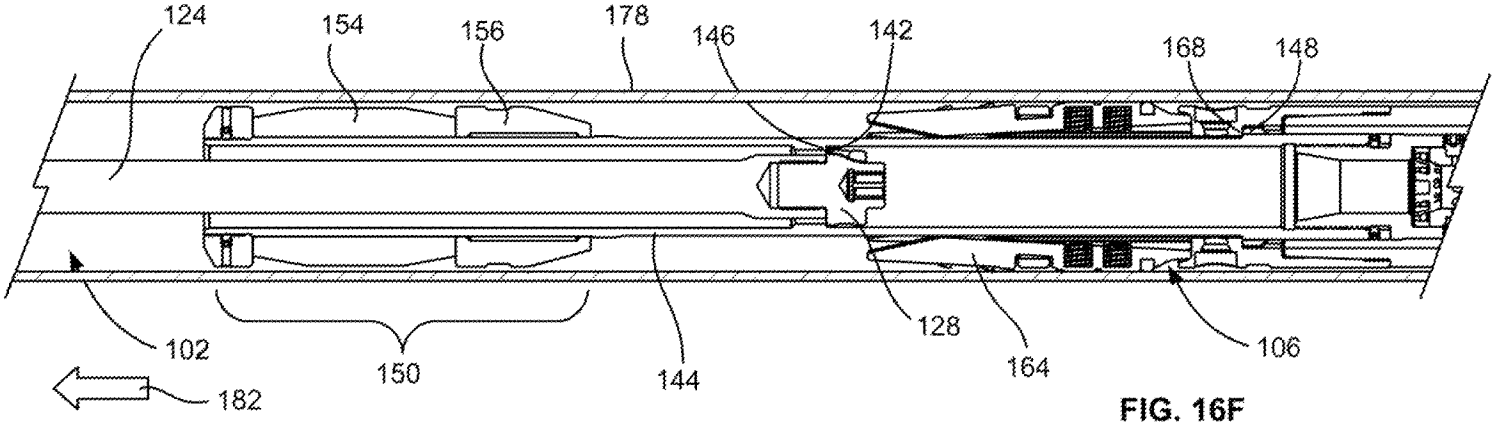

As shown in FIGS. 16E and 16F, in a pull out of hole (POOH) stage the first, second and third assemblies telescopically extend, providing for fluid flow management (discussed later below) and BHA movement management.

The first assembly 102, including the coupling mandrel 124 and the stop nut 128, is pulled uphole as indicated by the arrow 182. When the one or more uphole-facing shoulders 142 of the stop nut 128 engages the annular stop shoulder 146 of the actuator sleeve 144, the second assembly 104 is also pulled uphole, disengaging the wedge cone 156 from the slips 164. With the uphole movement of the second assembly 104, the one or more outer extrusions 148 of the actuator sleeve 144 engage the inner annular shoulder 168 of the third assembly 106, pulling the third assembly 106 uphole.

As described above, the uphole/downhole motion of the first assembly 102 relative to the second assembly 104 is delimited. The downhole motion of the first assembly 102 relative to the second assembly 104 is delimited by the engagement of the downhole-facing shoulder 140 of the blast joint 120 and the uphole end 184 of the upper stop 152 of the packer assembly 150, at which time the first assembly 102 pushes the second assembly 104 downhole.

The uphole motion of the first assembly 102 relative to the second assembly 104 is delimited by the engagement of the uphole-facing shoulders 142 of the stop nut 128 at the downhole end of the coupling mandrel 124, and the annular stop shoulder 146 of the actuator sleeve 144, at which time the first assembly 102 pulls the second assembly 104 uphole.

The downhole motion of the second assembly 104 relative to the third assembly 106 is delimited by the J-slot. J-slot followers or pegs 160 engage a J-slot guide profile 174 (see also FIG. 8) in the third assembly 106. A double start J-slot guide profile 174 and a pair of pegs 164 can provide three operating positions, i.e., an uphole, pull up or release delimited position, a downhole set delimited position and an intermediate downhole delimited run in position. The actuator sleeve 144 and the J-slot slider 158 with radial extending pegs 160 are slidably movable relative to the third assembly 106 supporting the slips 164, J-slot housing 170 and J-slot guide profile 174.

At the run in stage, the downhole motion of the second assembly 104 relative to the third assembly 106 is delimited by the conditioning of the J-slot at the run-in position P3, at which time the second assembly 104 pushes the third assembly 106 downhole. At the packer-set stage, the J-slot is conditioned to the downhole set position P2, and the wedge cone 156 of the packer assembly 150 engages the slips 164, setting the packer 154.

The uphole motion of the second assembly 104 relative to the third assembly 106 is delimited by the engagement of the one or more outer extrusions 148 of the actuator sleeve 144 and the inner annular shoulder 168 of the third assembly 106, at which time the second assembly 104 pulls the third assembly 106 uphole.

The three-assembly BHA 100 provides advantages in fluid flow management.

With reference to FIGS. 17A to 17D, the coupling mandrel 124 of the first assembly 102 and the actuator sleeve 144 form a bypass valve 190 for controlling the fluid communication between the tool annulus 204 uphole of the packer assembly 150, and the interior space 202 of the BHA 100 downhole of the packer assembly 150. Here, the tool annulus 204 refers to the annulus between the casing or completion string 200 and the BHA 100.

The uphole seal portion 124U of the coupling mandrel 124 has a diameter equal to or slightly smaller than the inner diameter of the actuator sleeve 144 for allowing the uphole seal portion 124U to fit into the uphole bore of the actuator sleeve 144 and telescopically move therein. The uphole seal portion 124U comprises at least one seal element 194 for sealably engaging the inner surface of the actuator sleeve 144 to seal the uphole bore of the actuator sleeve 144, closing the bypass valve 190.

The coupling mandrel 124 tapers from its uphole seal portion 124U to form a reduced-diameter intermediate body portion 124N having a diameter smaller than the inner diameter of the actuator sleeve 144. An annulus formed between the intermediate body portion 124N of the coupling mandrel 124 and the actuator sleeve 144 then forms a fluid channel or equalization flow annulus 198.

Figure 17A:
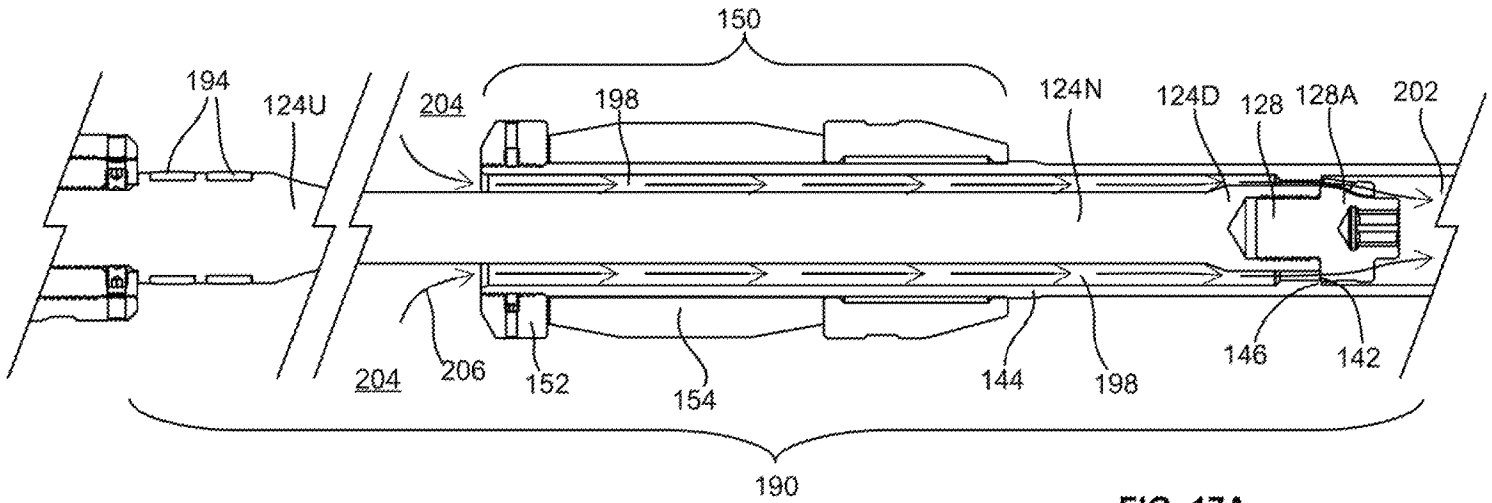
FIG. 17A is an expanded cross-sectional view of the coupling mandrel and the second assembly of FIG. 1A and the bypass valve formed therebetween, illustrating the bypass valve in an open condition.
Figure 17C:
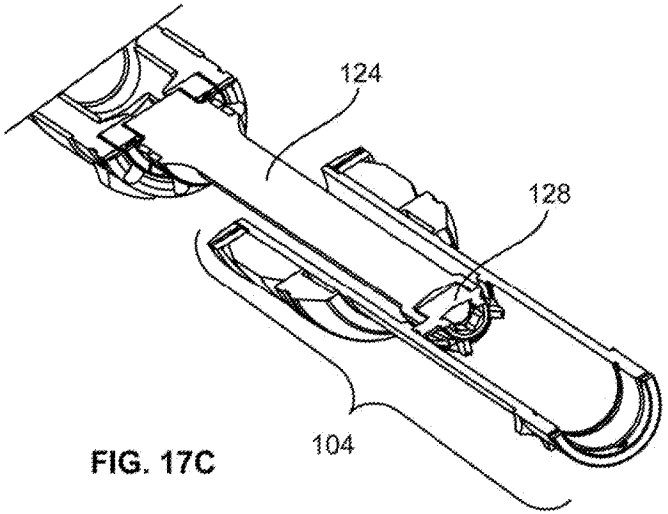
FIG. 17C is a cross-sectional, perspective view of a portion of first assembly's mandrel and second assembly telescopic coupling in pull-up mode.
Figure 17B:
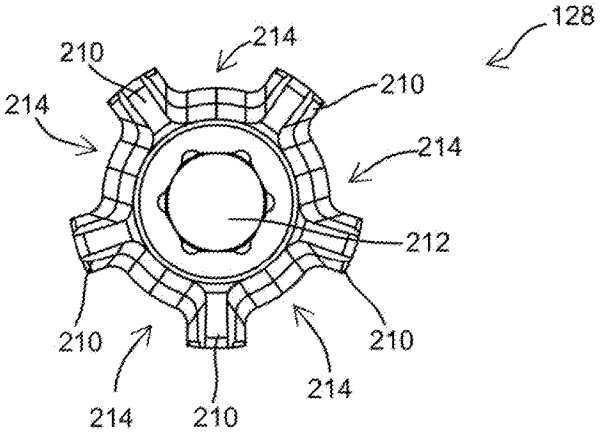
FIG. 17B is an uphole view of a stop nut of the coupling mandrel of FIG. 17A.

The stop nut 128 has a downhole end 128A of a diameter equal to or slightly smaller than the inner diameter of the actuator sleeve 144, but larger than the inner diameter of the inwardly extruding annular stop shoulder 146 for telescopically moving in the sliding sleeve and for pulling the sling sleeve 144 uphole by engaging the stop nut 128 with the annular stop shoulder 146. The downhole end 128A of the stop nut 128 is ported, such as a spline configuration, for fluid communication between the equalization flow annulus 198 and the interior space 202 of the actuator sleeve 144 downhole to the stop nut 128, even when the stop nut 128 is engaged with the annular stop shoulder 146. FIG. 17B illustrates the front view of a stop nut 128 in one embodiment, and FIG. 17C is a cut-off, perspective view of the stop nut 128 and the coupling mandrel 124 received in the second assembly 104. As can be seen, the stop nut 128 has a star-like profile with five (5) extrusions 210 radially outwardly extruding from a central portion 212. The gaps 214 between adjacent extrusions 210 fluidly connect the equalization flow annulus 198 to the interior space 202 of the actuator sleeve 144 downhole to the stop nut 128.

Figure 17D:
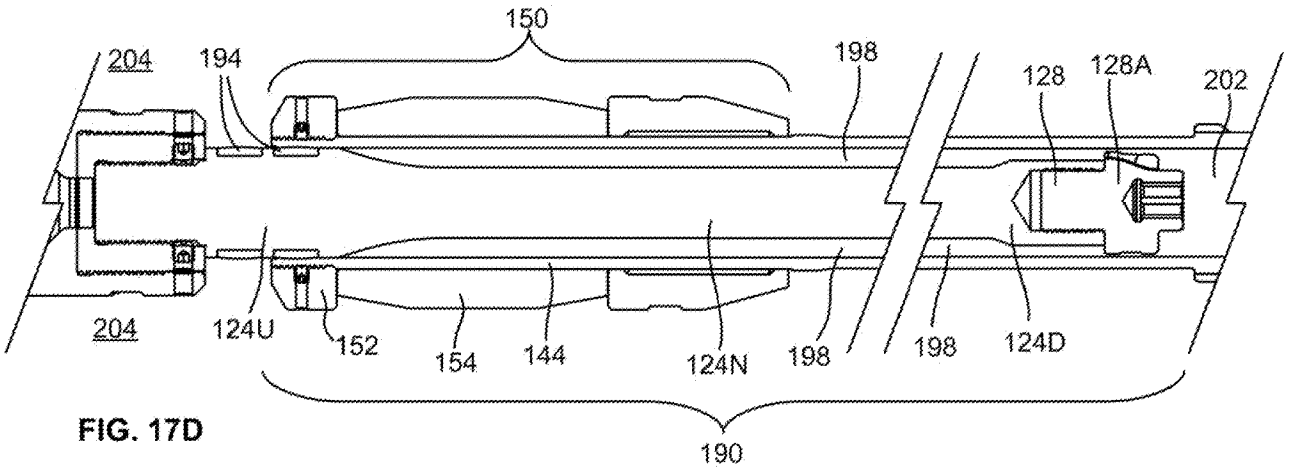
FIG. 17D illustrates the bypass valve of FIG. 17A in a closed condition.

Referring to FIG. 17D, the bypass valve 190 is closed when the uphole seal portion 124U of the coupling mandrel 124 is in contact with the upper stop 152. At least one seal element 194 sealably engages the inner surface of the actuator sleeve 144, blocking the tool annulus 204 uphole of the packer assembly 144 from the interior space 202 of the actuator sleeve 144 and the tool annulus 204 downhole of the packer assembly 150.

Referring back to FIG. 17A, the bypass valve 190 is open when the coupling mandrel 124 is spaced from the packer assembly 150 such that the uphole seal portion 124U of the coupling mandrel 124 is not in contact with the upper stop 152. When the bypass valve 190 is open, a flow passage bypassing the packer assembly 150 is formed between the tool annulus 204 uphole of the packer assembly 144 and the interior space 202 of the actuator sleeve 144 (e.g., as indicated by arrows 206), equalizing pressure therebetween and aiding in cleaning functions and the release of the packer 154.

The action of the bypass valve 190 in various operation stages is now described.

During RUN IN, the blast joint 120 engages the upper stop 152 of the packer assembly 150 without setting the packer 154, and the by-pass valve 190 is closed (see FIG. 16B). At this stage, the BHA 100 moves freely through the completion string as fluid flows along the annulus therebetween. Because the bypass valve 190 is closed, any fluid in the tool annulus 204 cannot travel therethrough. However, the fluid can still pass the packer 154 as the packer 154 is not set.

In the PULL UP stage, the BHA 100 is moving uphole, e.g., moving about 100 meters uphole to a new location. With reference to FIGS. 1A and 16E, as the blast joint 120, and so the uphole seal portion 124U of the coupling mandrel 124, are spaced from the upper stop 152, the bypass valve 190 is open. The fluid therefore can flow along the tool annulus 204, and can also flow through the BHA 100, e.g., flowing in and out of ports in the J-slot housing 170, through the downhole bore of the actuator sleeve 144, around the coupling mandrel 124, through the equalization flow annulus 198, and out of the uphole opening of the actuator sleeve 144 immediately adjacent the upper stop 152 of the packer assembly 150, clearing any accumulated debris.

Figure 18A:
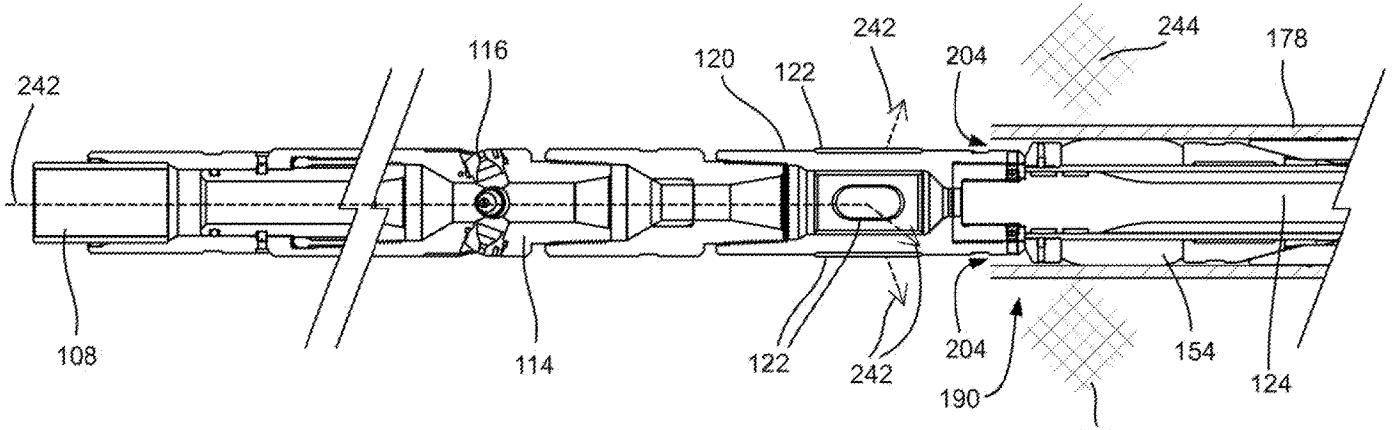
FIGS. 18A though 20B are enlarged views of the first flow control assembly and second packer assembly in various operational modes. More particularly.

At the SET stage, the J-slot is cycled and the blast joint 120 is set down on the uphole stop of the resettable packer (FIG. 16D). The blast joint 120 is fluidly connected to the coiled tubing 108. As shown in FIG. 18A, when the packer 154 is set, the blast joint 120 delivers treatment fluid 242, via the treatment fracturing ports 122, to open ports in the casing 178 and to the formation 244 therebeyond.

In various embodiments, fracturing of the formation may be performed through the BHA 100, i.e., from coiled tubing 108 to the blast joint 120, as described above, through the tool annulus 204 between the BHA 100 and casing 178, or through both the BHA 100 and the tool annulus 204.

Applying treatment fluid 242 to the formation 244 through the BHA 100 reduces the overall volume of treatment fluid required. During fracturing, a small amount of treatment fluid 242 may leak or pass from the coiled tubing 108 to the tool annulus 204 through the nozzles 116 of the jet sub 114. However, the overall loss of fluid is small compared to that delivered through the frac head. Advantageously, the small amount of fluid exiting the nozzles 116 may further clear any debris, such as cement, accumulated in the tool annulus 204, which may be in the tool annulus 204 following opening of the sliding sleeve.

In low volume frac operations, fluid can be saved by pumping down the coiled tubing 108 through the BHA 100. In higher flow rate frac operations, larger amounts of fracturing fluids can be delivered down the tool annulus 204. Even larger amounts of the fracturing fluid can be delivered simultaneously through both the tool annulus 204 and the coiled tubing 108.

When treatment fluid is delivered to the open ports or perforations (not shown) through one of the tool annulus 204 or the coiled tubing 108, the other can act as a "dead leg". For example, when the treatment fluid is delivered through the tool annulus 204, a minimal, constant amount of fluid can be delivered through the coiled tubing 108 to act as the "dead leg", maintaining pressure within the coiled tubing 108. The pressure to maintain the constant fluid delivery is monitored from surface and can be used for calculating fracture extension pressure or failure to deliver treatment fluid, such as resulting from debris buildup in the tool annulus 204, as is understood by those of skill in the art.

Similarly, when treatment fluid is delivered to the frac head or blast joint 120 through the coiled tubing 108, the tool annulus 204 can be used as the "dead leg", a minimal, constant amount of fluid being delivered thereto for maintaining pressure within the tool annulus 204, the pressure is monitored at surface and used for calculating fracture extension pressure or failure to deliver treatment fluid as described above.

During and after treatment, an uphole pressure $P_F$ above the set packer 154 is significantly higher than downhole pressure $P_{DH}$ below the set packer 154.

Figure 18B:
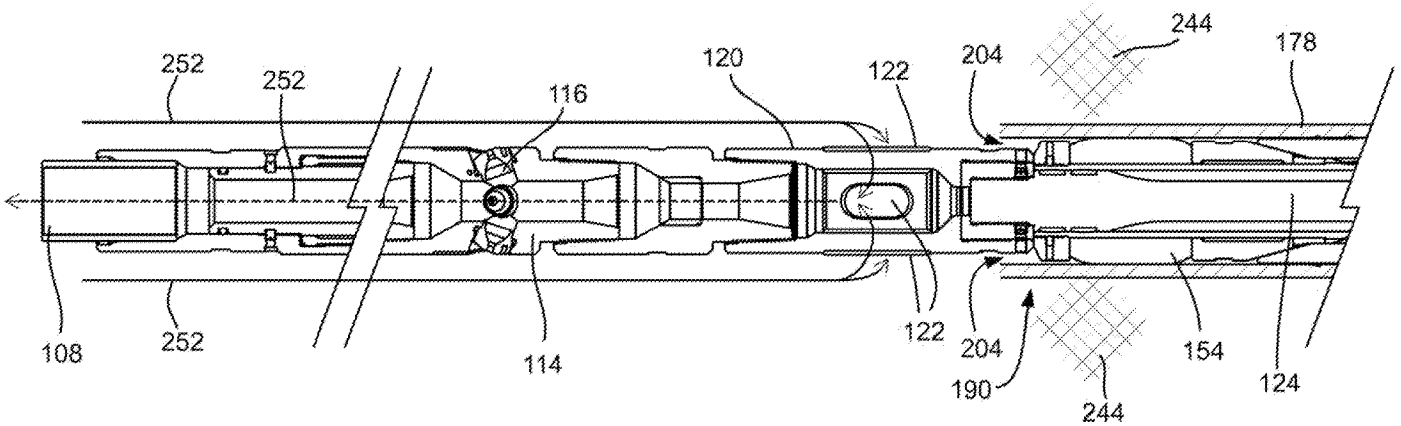
FIG. 18B illustrates the fluid path when fluid reverse circulation is conducted, such as for clearing accumulated debris at the tool annulus packer interface area.

With reference to FIG. 18B, where clearing of accumulated debris is desired or required, reverse circulation of fluids to surface is possible. To clear accumulated debris, the minimal, constant fluid delivered through either the tool annulus 204 or the coiled tubing 108 as "dead leg" is stopped and a fluid 252 is delivered through either the tool annulus 204 or the coiled tubing 108 for reverse circulating the fluid and debris to surface. In the example of FIG. 18B, the fluid 252 is delivered through the tool annulus 204 while the packer 154 is set. The fluid 252 enters the blast joint 120 through the treatment fracturing ports 122 and circulates to surface through the coiled tubing 108. Any debris that the fluid 252 encounters will be circulated to surface through the coiled tubing 108.

If, alternatively, fluid 252 is delivered through the coiled tubing 108, the fluid 252 and any debris encountered will be circulated to surface through the tool annulus 204.

After fracturing, the pressure is first equalized above and below the packer 154. Then, the packer 154 is released, and the BHA 100 is moved from interval to interval within the wellbore. The pressure is equalized through the equalization flow annulus 198 of the bypass valve 190, actuated by movement of the coiled tubing 108 and the first assembly 102.

Figure 19:
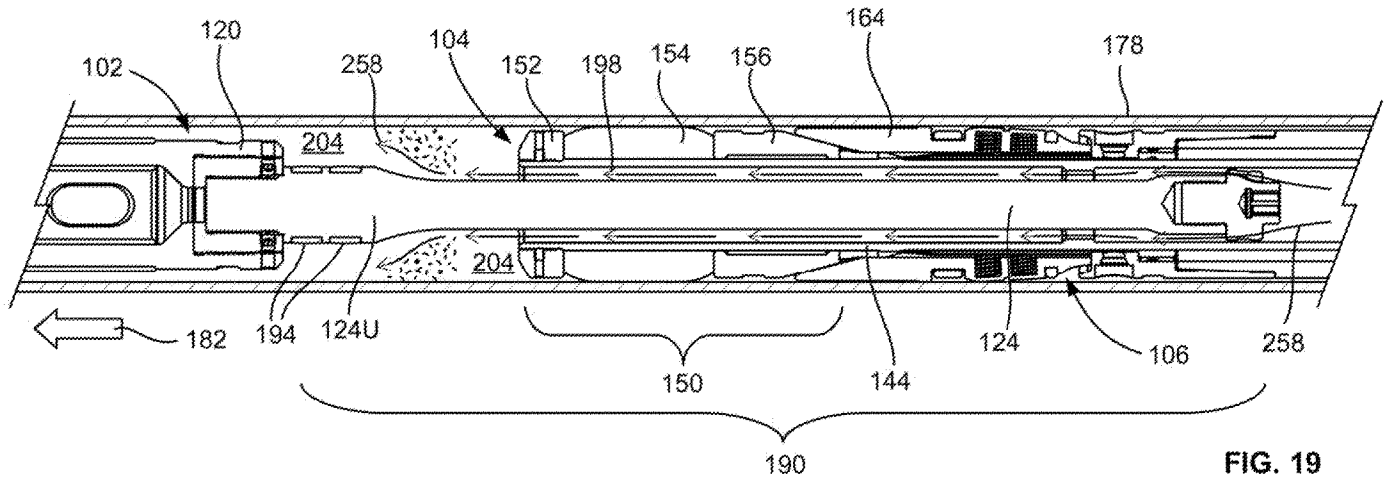
FIG. 19 illustrates pressure equalization and simultaneous debris clearing at the uphole packer area upon opening the bypass valve before releasing the packer.

FIG. 19 illustrates the pressure equalization. As shown, the coiled tubing 108 is lifted up, pulling the blast joint 120 and the coupling mandrel 124 sufficiently uphole to release the seal 194 about the uphole seal portion 124U of the coupling mandrel 124 from the uphole bore of the actuator sleeve 144, opening the bypass valve 190 such that the equalization flow annulus 198 is in fluid communication with the tool annulus 204. At this moment, the packer 154 remains set.

After the bypass valve 190 is open, fluid flow 258 is established through the actuator sleeve 144. The flow 258 passes immediately adjacent the uphole stop 152 of the packer assembly 150, washing any accumulated debris.

Once the pressure is equalized above and below the packer 154, the coiled tubing 108 is further lifted up. The slips 164 and packer 154 are then released, and the BHA 100 is lifted in the wellbore to the next interval to be fractured.

In casing that does not have a sliding sleeve positioned at an identified zone of interest, or where there is a failure to shift an existing sliding sleeve, perforations can be cut in the casing using the fluid jetting apparatus or jet sub. The BHA is located in the wellbore as previously described, and the slips and packer are set against the unshifted sleeve or against bare casing (not shown). The slips and packer sealing element may already be set in the failed ported sub and are adjacent some portion of the casing at, or uphole of, the ported sub. Alternatively, the BHA is set in bare casing.

Figure 20A:
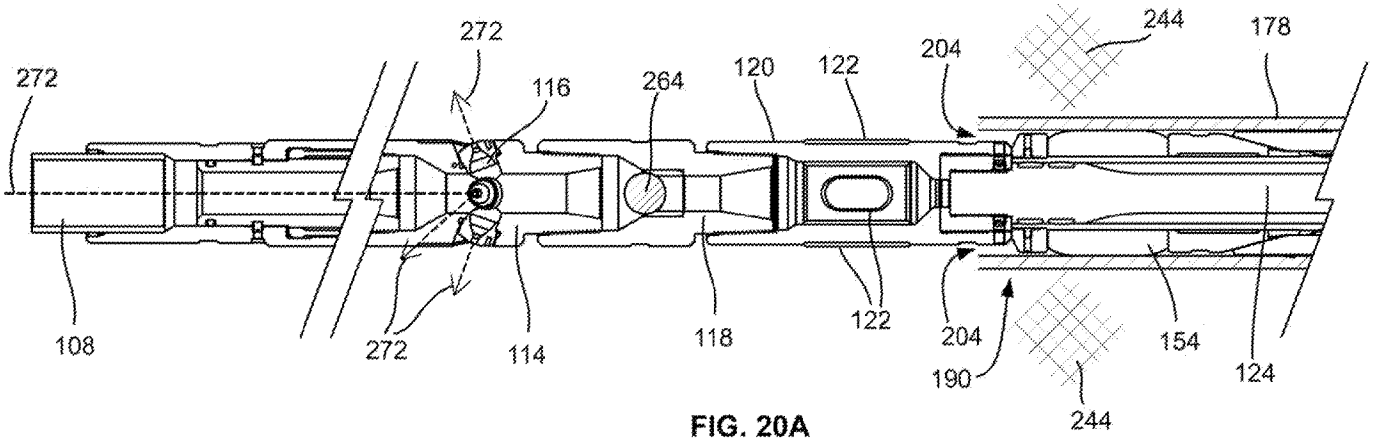
FIG. 20A illustrates the fluid path when a ball drop blocks the fluid bore to the treatment ports for enabling abrasive jetting through an uphole jet sub.

As shown in FIG. 20A, The BHA 100 seals the tool annulus 204 below the blast joint 120 for treatment operations. As described before, in this embodiment, a ball seat 118 is located in the BHA 100 uphole of the blast joint 120 and downhole of the jet sub 114. Normally, fluid can pass through the ball seat 118 for typical operations including delivery of fluid to shift sleeves, or delivery of treatment fluid to the blast joint 120.

To use the jet sub 114, a ball 264 is dropped, as is conventionally known for prior art sleeve shifting operations, and seats in the ball seat 118 to prevent further downhole flow of fluid therebelow, forcing fluid through the nozzles 116 of the jet sub 114, as indicated by the arrows 272. Jetting fluid, such as an abrasive fluid, is delivered to the jet sub 114 through the coiled tubing 108 to exit the nozzles 116 and cut perforations in the casing.

Figure 20B:
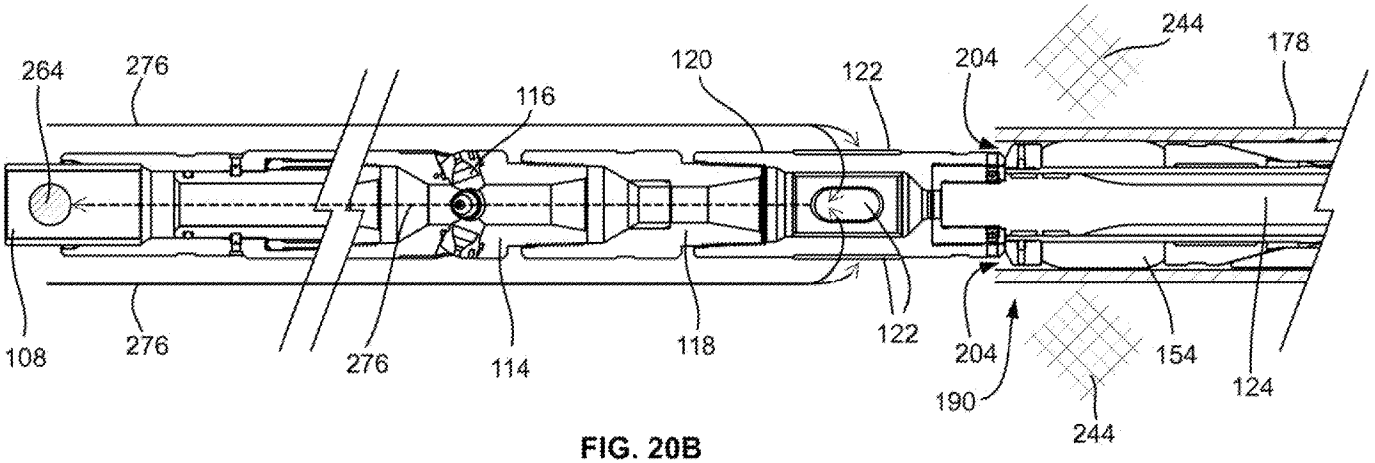
FIG. 20B illustrates the fluid path for ball recovery after the abrasive jetting.

After fluid jetting, the ball 264 is released from the ball seat 118 and up the coiled tubing 108. One method of releasing the ball 264 is by reverse circulation to move the ball 264 to surface. As shown in FIG. 20B, fluid flows through the string annulus 204, as indicated by arrows 27, and enters the treatment fracturing ports 122. The fluid then flows uphole in the BHA 100 and urges the ball 264 to the surface.

Another method of releasing the ball 264 is to release or remove the ball 264 through pressure or flow management to a storage trap, a form of which is not shown in the drawing. For example, a release mechanism can be used to permit the ball 264 to be forced through the ball seat 118, and the released ball 264 thereafter is retained in a ball cage (not shown) positioned downhole from the blast joint 120. In yet a further embodiment, the ball 364 can be reverse circulated out of the ball seat 118, yet retained downhole and out of the flow of fluid, such as in a recess.

Referring to FIG. 18A again, after releasing the ball 264, treatment fluid can again be directed through the coiled tubing 108, the tool annulus 204 or both to the open perforations and the formation therebeyond. Thereafter the formation is fractured through either the blast joint 120 or through the tool annulus 204, both of which can now access the formation, without further moving the BHA 100 within the wellbore.

The BHA 100 can include other components for respective operability and recovery.

For example, if the BHA 100 become stuck downhole, such as through sanding off or non-release of the packer, the coiled tubing 108 can be released from the BHA 100 through a hydraulic release or disconnect. A first disconnect tubular is fit concentrically over a second disconnect tubular. One of the two tubulars is fit with a collet. Collet fingers extend from a second, downhole tubular connected to the BHA 100. The collet fingers extend into a bore of the first uphole tubular. The bore is fit with an annular retaining recess for receiving collet tips at the distal end of the collet fingers, axially retaining the two tubulars together. As the collet fingers are radially flexible, they are temporarily retained using a disconnect piston fit into a collet bore. The piston is stepped having a first larger diameter retaining portion for retaining the connect tips in the annular retaining recess (retaining position) and a second smaller diameter release portion, which when aligned with the collect tips (release position), permitting the tips to release from the annular retaining recess and permitting separation of the first and second tubulars. The piston is secured in the retaining position using shear pins. The piston is shifted from the retaining to the release position using a ball drop and fluid pressure to shear the shear pins.

The coiled tubing 108 can also be released from the BHA 100 through a mechanical release or disconnect. A first disconnect tubular or crossover sub is fit concentrically within a second disconnect tubular or release sub. The two tubulars are connected using shear pins for retaining the two subs together in a retaining position. Pull up load is adjusted as necessary to shear the pins and shift the tubulars to the release position.

In bottom hole situations, at the toe of the wellbore, and with the packer 154 set on a sleeve for shifting, downhole fluid is trapped and impedes the movement of the BHA 100. Accordingly, a toe sub having a fluid chamber is provided for receiving the limited amount of trapped fluid to permit a few inches of travel, e.g., 0.5 foot in axial displacement. The fluid chamber or reservoir is initially closed during run in and other manipulation so as to be available only when needed. The chamber has a fluid inlet port that is blocked using a shear plug. The shear plug has a downhole piston face that develops sufficient actuating force when the toe sub is set down, to shear shear pins and release the shear plug. Fluid flow can enter the toe sub, pass through the hollow shear plug and into the fluid chamber. A perforated sparger or silencer discharges toe fluid into a reservoir annulus about the silencer.

Figure 21A:
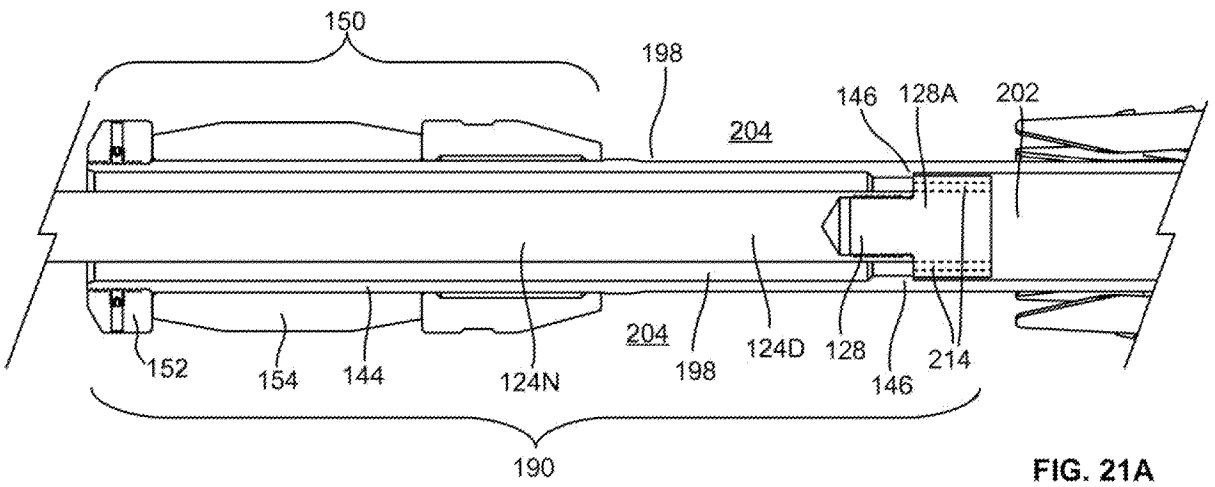
FIG. 21A illustrates a cross-sectional view of the mandrel and a stop nut with flow passages therethrough, according to an alternative embodiment.
Figure 21B:
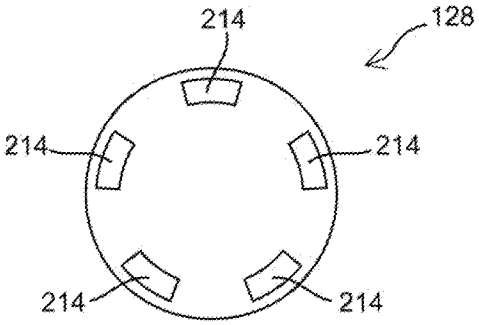
FIG. 21B is an uphole view of the stop nut of FIG. 21A.

Those skilled in the art appreciate that other embodiments of the BHA are readily available. For example, FIGS. 21A and 21B show the stop nut 128 in an alternative embodiment. Rather than a castellated configuration, the stop nut 128 in this embodiment has a cylindrical downhole end 128A of a diameter equal to or slightly smaller than the inner diameter of the actuator sleeve 144, but larger than the inner diameter of the inwardly extruding annular stop shoulder 146 for telescopically moving in the sliding sleeve and for pulling the actuator sleeve 144 uphole by engaging the stop nut 128 with the annular stop shoulder 146. The downhole end 128A of the stop nut 128 is ported to have one or more fluid passages 214 therein for fluid communication between the equalization flow annulus 198 and the interior space 202 of the actuator sleeve 144 downhole to the stop nut 128, even when the stop nut 128 is engaged with the annular stop shoulder 146.

In another embodiment, the blast joint 120 comprises a selector valve for selectively opening and closing the treatment fracturing ports 122.

Figure 22A:
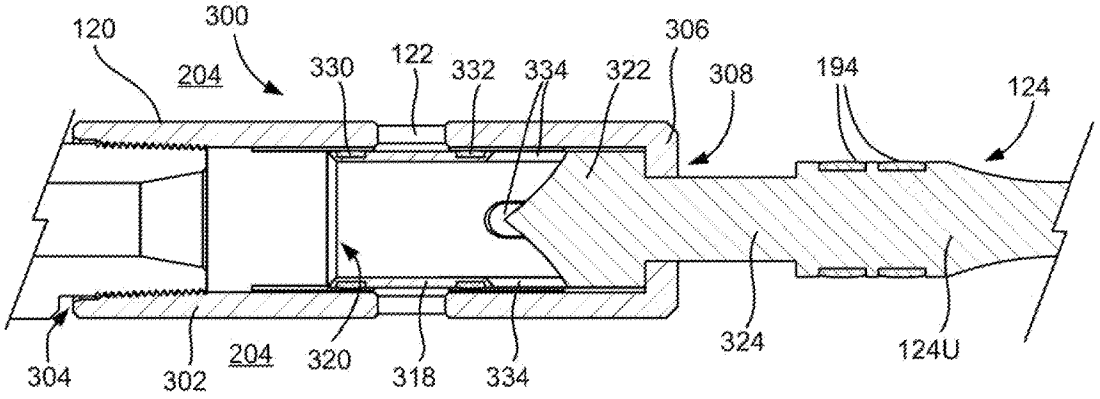

As shown in FIGS. 22A and 22B, the blast joint 120 in this embodiment comprises a tube housing 302 ported with one or more treatment fracturing ports 122, preferably lined or otherwise hardened to lessen the effect of erosion treatment fluids and abrasives. The housing 302 comprises an uphole opening 304 coupled a tool sub, and a downhole wall 306 having a bore 308 at the center thereof for receiving a rod 324 slidingly passing therethrough. In this embodiment, the downhole wall 306 of the housing 302 has a diameter substantively larger than that of the uphole seal portion 124U of the coupling mandrel 124, and the bore 308 has a diameter substantively smaller than that of the uphole seal portion 124U of the coupling mandrel 124 such that the housing 302, when moving downhole, may engage the coupling mandrel 124 and the second assembly (not shown) and push them downhole (described in more detail later).

The housing 302 receives therein a ported frac sleeve 318 axially moveable therein between a closed position (FIG. 22A) and an open position (FIG. 22B), forming the selector valve 300 for opening and closing the treatment fracturing ports 122. The frac sleeve 318 has an outer diameter the same as or slightly smaller than the inner diameter of the housing 302, and is ported with one or more ports 334 that are aligned with the treatment fracturing ports 122 when the frac sleeve 318 is at the open position.

The frac sleeve 318 comprises an open uphole end 320 in fluid communication with the tool subs uphole thereof, and a closed downhole end 322 coupled to the rod 324. The rod 324 slidingly passes through the bore 308 of the housing 302, and is concentrically coupled to the uphole seal portion 124U of the coupling mandrel 124. Dependent upon the choice of materials, the rod 324 can be coupled to the coupling mandrel 124 through suitable connections, such as through a threaded connection.

As shown in FIG. 22A, the selector valve 300 is closed when the frac sleeve 318 is at the closed position delimited by the frac sleeve 318 seating against the downhole wall 306 of the housing 302. The ports 334 are misaligned with the treatment fracturing ports 122, preventing fluid communication between the BHA 100 and the tool annulus 204 via the treatment fracturing ports 122.

As shown, the frac sleeve 318 is fit with axially spaced annular seals 330 and 332 at respective positions thereon such that, when the frac sleeve 318 is at the closed position, the seals 330 and 332 straddle the one or more treatment fracturing ports 122 and sealably engages the inner surface of the housing 302 to close the selector valve 300.

As shown in FIG. 22B, the selector valve 300 is open when the frac sleeve 318 is at the open position delimited by the housing 302 engaging the uphole seal portion 124U of the coupling mandrel 124. The ports 334 are aligned with the treatment fracturing ports 122, allowing fluid communication between the BHA 100 and the tool annulus 204 via the treatment fracturing ports 122.

As shown in FIG. 23, in this embodiment, the actuator sleeve 144 also comprises an uphole-facing annular delimit shoulder 342 on the inner surface thereof at a position about the downhole end of the stop nut 128 when the frac sleeve 318 is at the open position, for preventing the frac sleeve 318 from shifting to the closed position.

The selector valve 300 opens or closes the treatment fracturing ports 122 by the relative axial movement between the blast joint 120 and the coupling mandrel 124. When the blast joint 120 is moving uphole, the frac sleeve 318 is moving downhole relative to the housing 302, closing the selector valve 300. When the frac sleeve 318 moves to the closed position, it seats against the downhole wall 306 of the housing 302, and the blast joint 120 pulls the coupling mandrel 124 uphole and resetting the packer 154 (see FIG. 22A).

When the blast joint 120 is moving downhole, the frac sleeve 318 is moving uphole relative to the housing 302, opening the selector valve 300. The frac sleeve 318 moves to the open position when the housing 302 engages the uphole seal portion 124U of the coupling mandrel 124. The blast joint 120 then pushes the coupling mandrel 124 downhole and setting the packer 154 (see FIG. 22B). When the selector valve 300 is open, the delimit shoulder 342 of the actuator sleeve 144 engages the stop nut 128 to prevent the frac sleeve 318 from moving downhole and closing the selector valve 300.

Figure 24A:
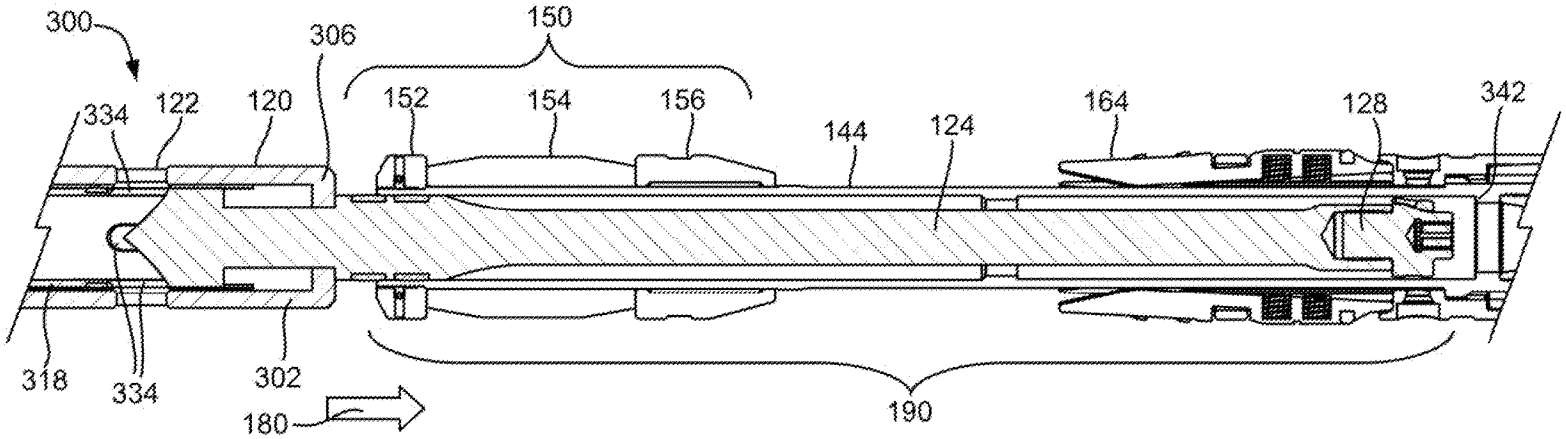

As shown in FIG. 24A, in the RUN IN stage, the coiled tubing (not shown) actuates the blast joint 120 to move downhole, as indicated by the arrow 180. The frac sleeve 318 of the coupling mandrel 124 is displaced uphole relative to the housing 302. When the housing 302, or equivalently the blast joint 120, engages the uphole seal portion 124U of the coupling mandrel 124, the ports 334 on the frac sleeve 318 are aligned with respective treatment fracturing ports 122, opening selector valve 300. The blast joint 120 pushes the coupling mandrel 124 downhole to seat in the actuator sleeve 144 and closes the bypass valve 190.

Figure 24B:
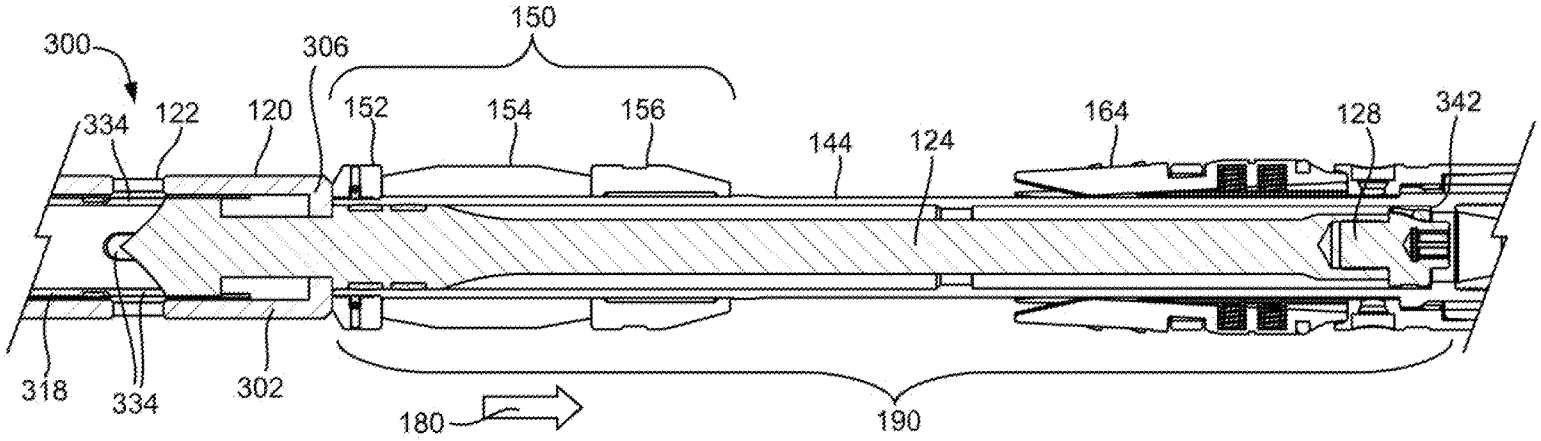
FIG. 24B illustrates the run-in stage, wherein the blast joint engages the second assembly and pushes the second assembly downhole.

As shown in FIG. 24B, when the blast joint 120 engages the packer upper stop 152, the blast joint 120 also pushes the second assembly 104, including the packer assembly 150 and the actuator sleeve 144, downhole, as indicated by the arrow 180. The delimit shoulder 342 engages the stop nut 128 to ensure that the selector valve 300 remain open. The bypass valve 190 remains closed.

Figure 24C:
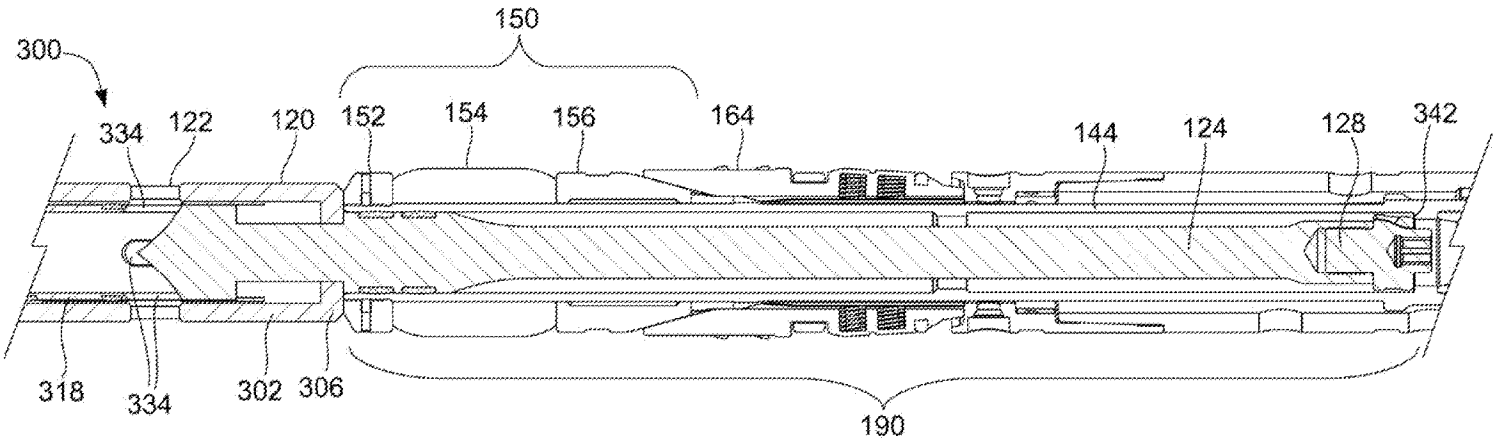
FIG. 24C illustrates the setting of the slips and compression of the packer, the selector vale open for treatment operations.

As shown in FIG. 24C, after cycling the J-slot, the blast joint 120 pushes the second assembly 104 to the SET position such that the wedge cone 156 engages the slips 164 and sets the packer 154. The selector valve 300 remains open, and the bypass valve 190 remains closed. Treatment fluid is then flushed through the treatment fracturing ports 122.

Figure 24D:
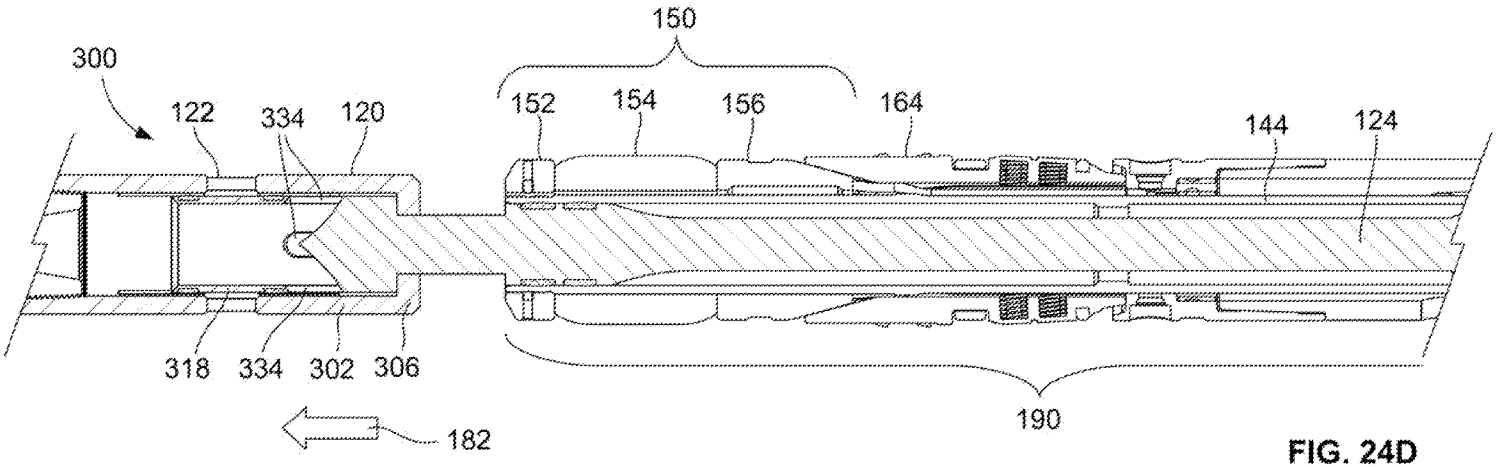
FIG. 24D illustrates the pull-up stage, wherein the blast joint is moved uphole, closing the selector valve and prior to pulling the coupling mandrel uphole from the second assembly for opening the bypass valve.

As shown in FIG. 24D, after fracturing, the coiled tubing (not shown) is pulled up, pulling the blast joint 120 uphole, as indicated by the arrow 182. The housing 302 shifts uphole relative to the frac sleeve 318 until the frac sleeve 318 seats against the downhole end of the housing 302, closing the selector valve 300 and pulling the coupling mandrel 124 uphole.

Figure 24E:
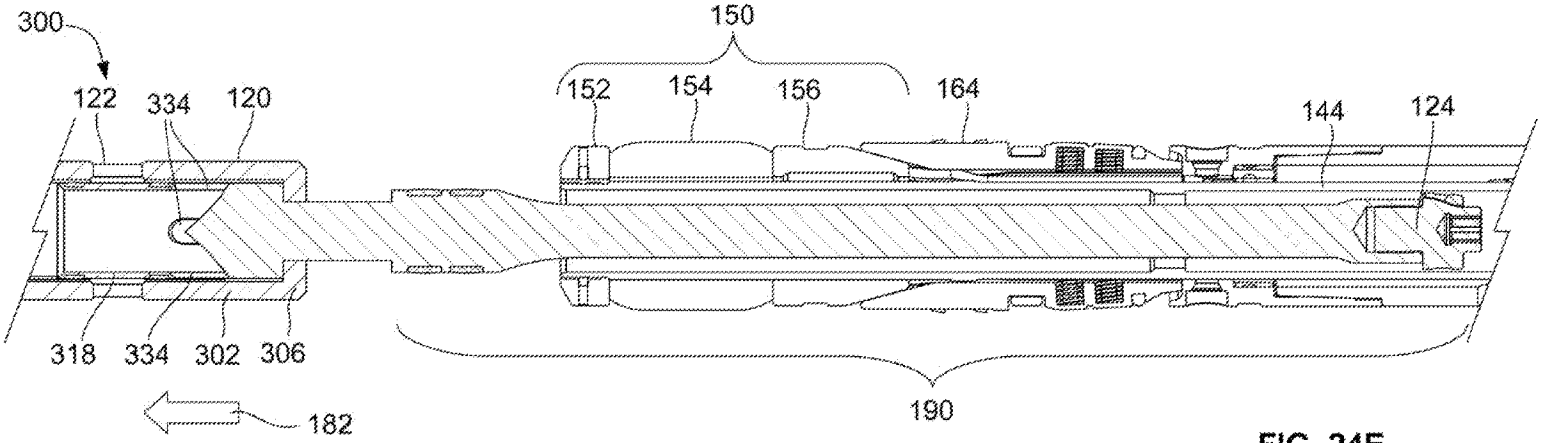
FIG. 24E illustrates continuation of the pull-up or POOH stage, wherein the blast joint pulls the coupling mandrel from the second assembly and opening of the bypass valve.

As shown in FIG. 24E, the blast joint 120 further pulls the coupling mandrel 124 uphole to unseat the coupling mandrel 124 from the actuator sleeve 144, opening the bypass valve 190 for pressure equalization and packer release. The selector valve 300 remains closed.

In various embodiments, fracturing of the formation may be performed through the BHA 100, i.e., from coiled tubing 108 to the blast joint 120, as described above, through the tool annulus 204 between the BHA 100 and casing 178, or through both the BHA 100 and the tool annulus 204.

The selector valve 300 facilitates the fracturing, clearing of accumulated debris and abrasive jetting.

Figure 25A:
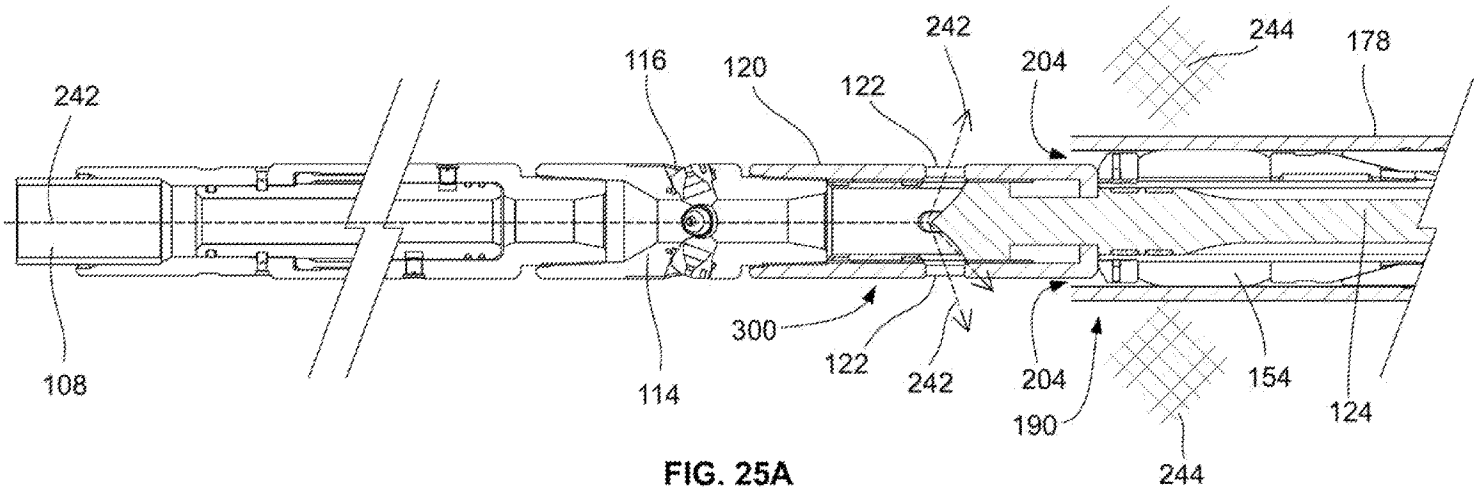
FIG. 25A illustrates the packer set mode and open selector valve and showing fluid flow for wellbore treatment or for flushing of the tool annulus through the open treatment ports of the blast joint.

Referring to FIG. 25A, the blast joint 120 is in fluid communication with the coiled tubing 108. When the packer 154 is set, the selector valve 300 is open. The blast joint 120 delivers treatment fluid 242, via the treatment fracturing ports 122, to open ports in the casing 178 and to the formation 244 therebeyond.

Figure 25B:
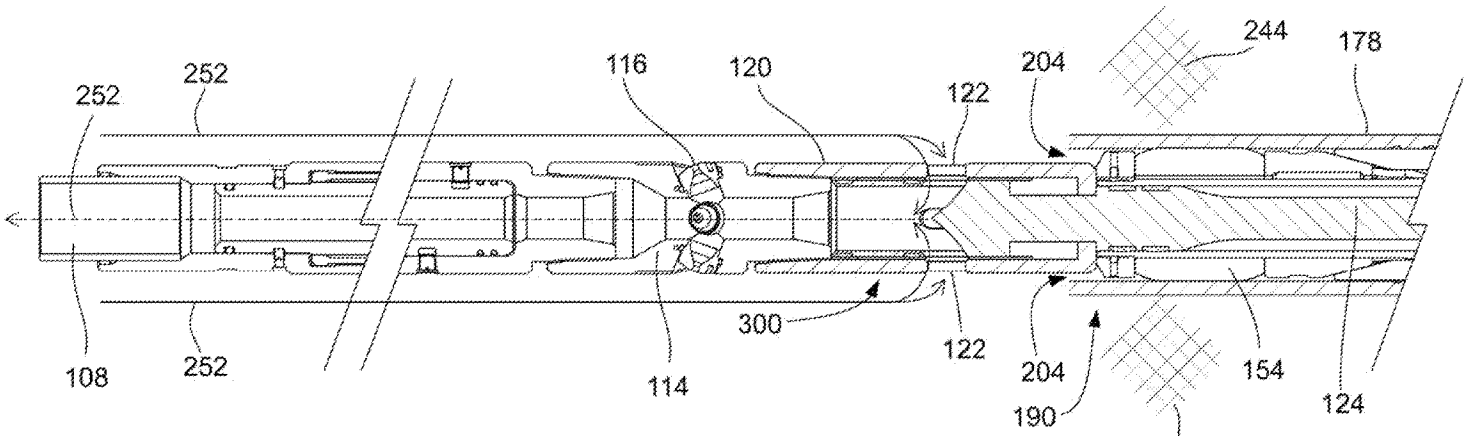
FIG. 25B illustrates reverse circulation through the selector valve.

As shown in FIG. 25B, for clearing of accumulated debris using reverse circulation, the fluid 252 is delivered through the tool annulus 204 while the packer 154 is set. As the selector valve 300 is open, the fluid 252 enters the blast joint 120 through the treatment fracturing ports 122, and circulates to surface through the coiled tubing 108. Any debris that the fluid 252 encounters will be circulated to surface through the coiled tubing 108.

Alternatively, fluid 252 may be delivered through the coiled tubing 108. As the selector valve 300 is open, the fluid 252 enters the tool annulus 204 through the treatment fracturing ports 122. The fluid 252 and any debris encountered will be circulated to surface through the tool annulus 204.

After fracturing, the pressure is first equalized above and below the packer 154. Then, the packer 154 is released, and the BHA 100 is moved from interval to interval within the wellbore. As described above, the pressure is equalized through the equalization flow annulus 198 of the bypass valve 190, actuated by movement of the coiled tubing 108 and the first assembly 102.

Figure 25C:
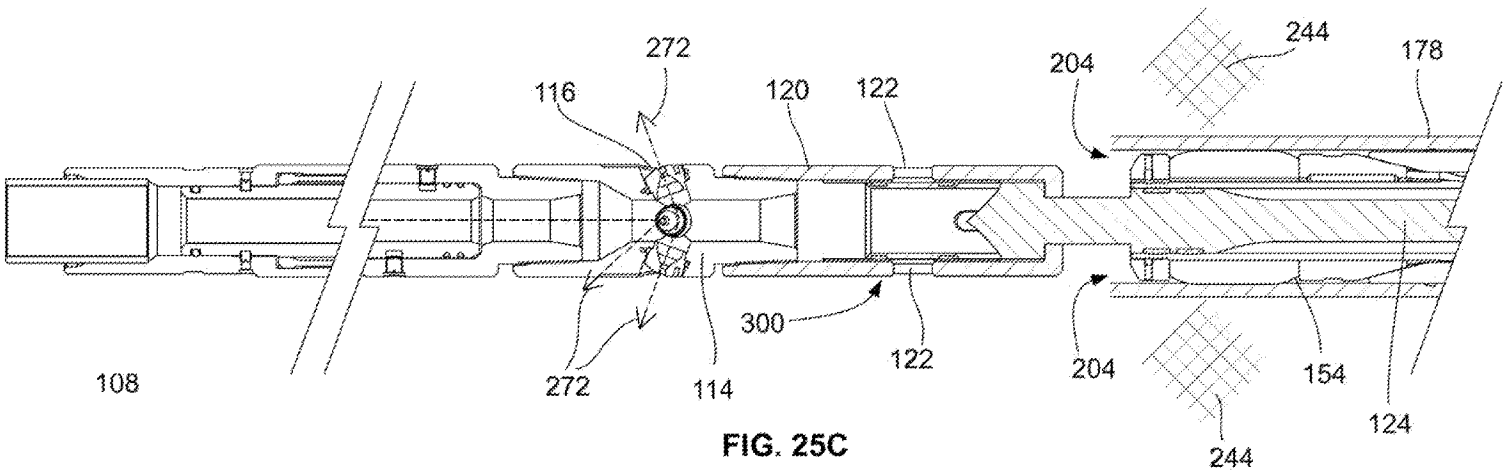

As shown in FIG. 25C, The BHA 100 seals the tool annulus 204 below the blast joint 120 for treatment operations. To use the jet sub 114, the coiled tubing 108 is lifted up, pulling the blast joint 120 uphole to close the selector valve 300, forcing fluid through the nozzles 116 of the jet sub 114, as indicated by the arrows 272. The need for delivery and subsequent recovery of an abrasive jet actuating ball is eliminated. Jetting fluid, such as an abrasive fluid, is delivered to the jet sub 114 through the coiled tubing 108 to exit the nozzles 116 and cut perforations in the casing.

Figure 26:
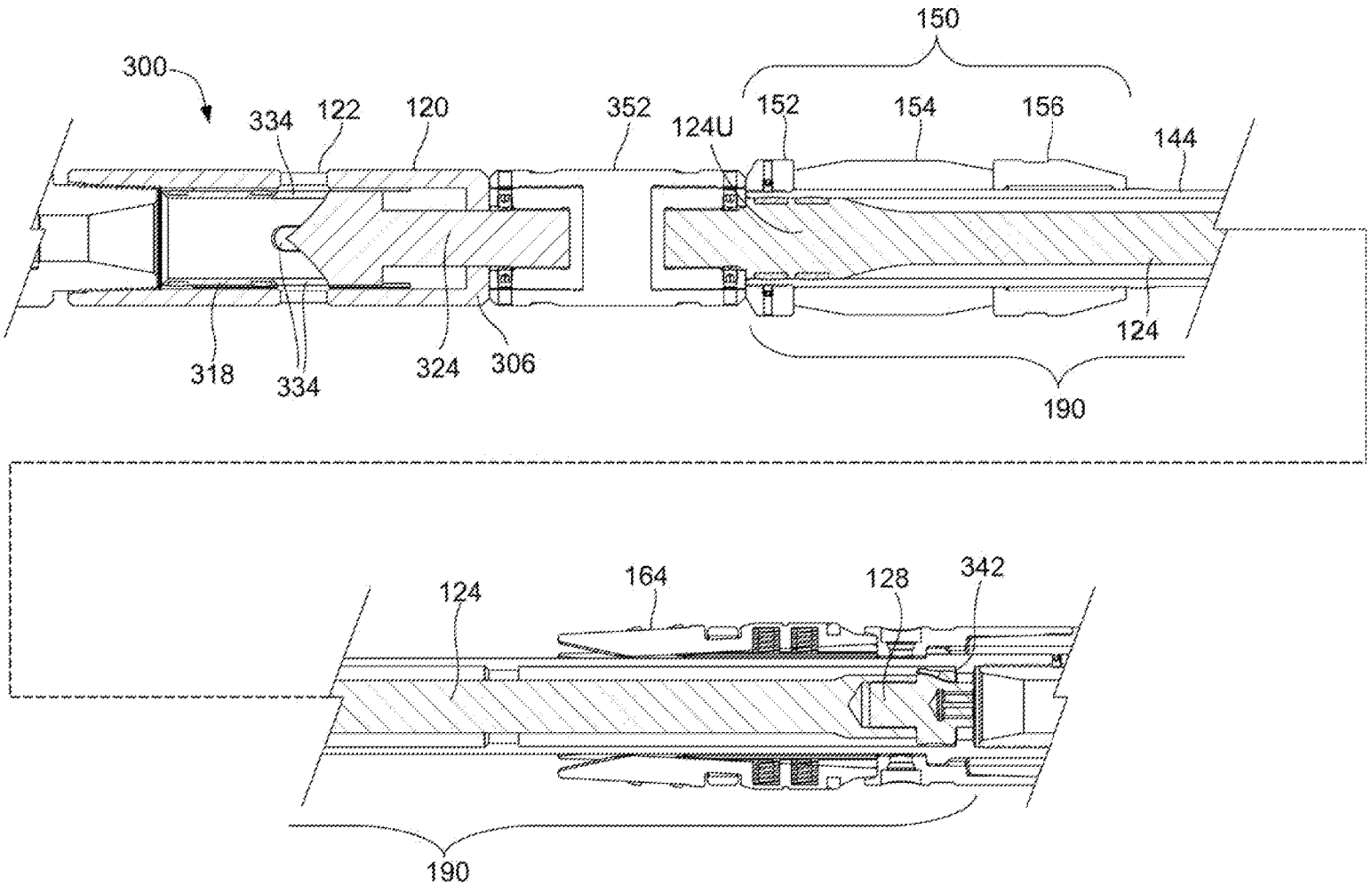

In above embodiment, the blast joint 120 engages the packer upper stopper 152 to push the second assembly 104 downhole and shut off the bypass valve 190. In an alternative embodiment, the blast joint 120 does not directly engage the packer upper stopper 152. As shown in FIG. 26, the blast joint 120 and the coupling mandrel 124 are the same as that of FIGS. 22A to 25C, except that, in this embodiment, the rod 324 and the coupling mandrel 124 are coupled together by a coupling 352 using suitable means such as threads. The coupling 352 is intermediate the blast joint 120 and the packer upper stop 152 and has a diameter substantially comparable to that of the blast joint 120 and the packer upper stop 152 such that the blast joint 120 may push the coupling 352, which in turn pushes the packer upper stop 152 for setting the packer 154.

Figure 27A:
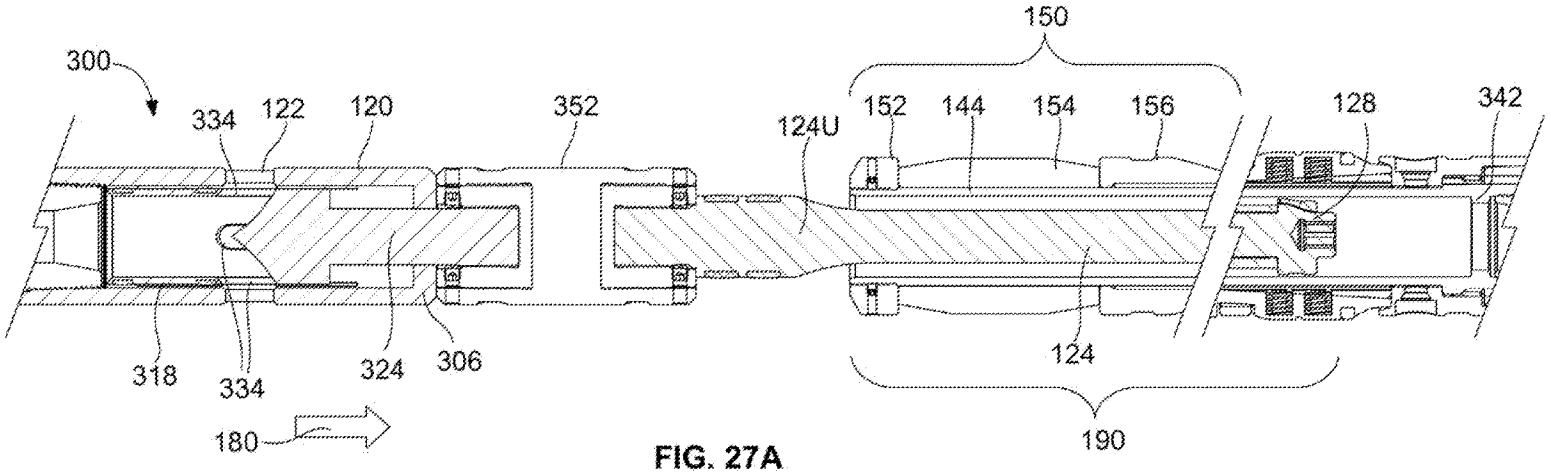
FIG. 27A illustrates the operation of the selector valve of FIG. 26 in the RUN IN stage, wherein the blast joint is pushing, via a coupling, the coupling mandrel towards the second assembly.

For example, as shown in FIG. 27A, during RUN IN, the blast joint 120 moves downhole, as indicated by the arrow 180. The frac sleeve 318 is displaced uphole relative to the blast joint 120. When the blast joint 120 engages the coupling 352, the frac sleeve 318 arrives to the open position such that the ports 334 on the frac sleeve 318 are aligned with respective treatment fracturing ports 122, opening selector valve 300. The blast joint 120 pushes, via the coupling 352, the coupling mandrel 124 downhole to seat in the actuator sleeve 144 and closes the bypass valve 190.

After the coupling 352 engages the packer upper stop 152, the blast joint 120 pushes both the coupling mandrel and the second assembly 104, including the packer assembly 150 and the actuator sleeve 144, downhole. The delimit shoulder 342 engages the stop nut 128 to ensure that the selector valve 300 remain open. The bypass valve 190 remains closed.

Figure 27B:
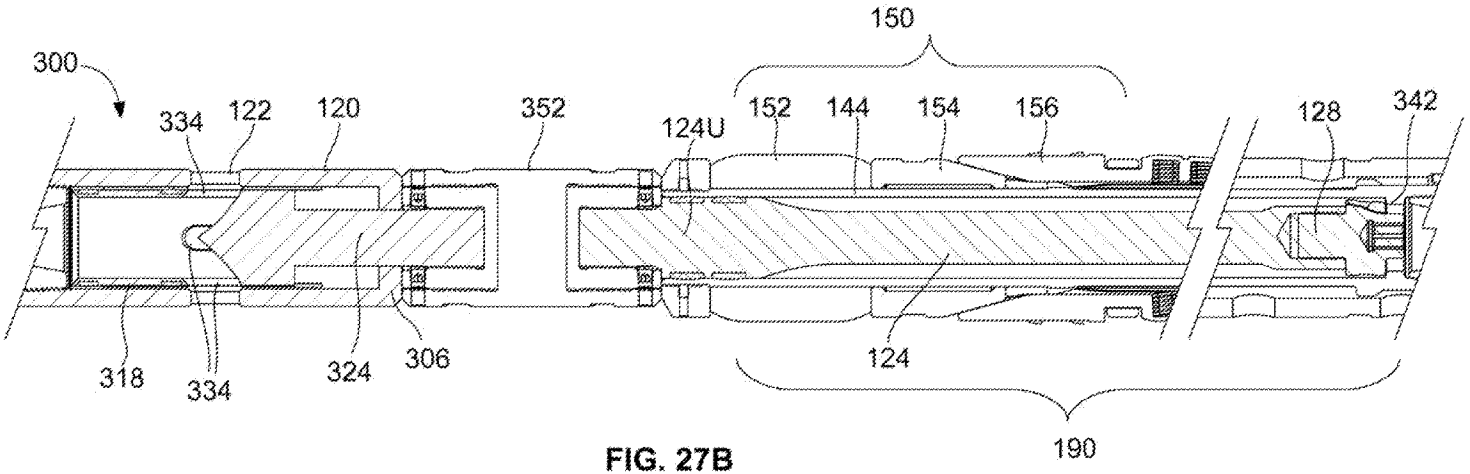
FIG. 27B illustrates the operation of the selector valve of FIG. 26 in the PACKER SET stage, wherein the blast joint pushes, via the coupling, the second assembly downhole.

As shown in FIG. 27B, after cycling the J-slot, the blast joint 120 pushes, via the coupling 352, the second assembly 104 to the SET position such that the wedge cone 156 engages the slips 164 and sets the packer 154. The selector valve 300 remains open, and the bypass valve 190 remains closed. Treatment fluid is then flushed through the treatment fracturing ports 122.

Figure 27C:
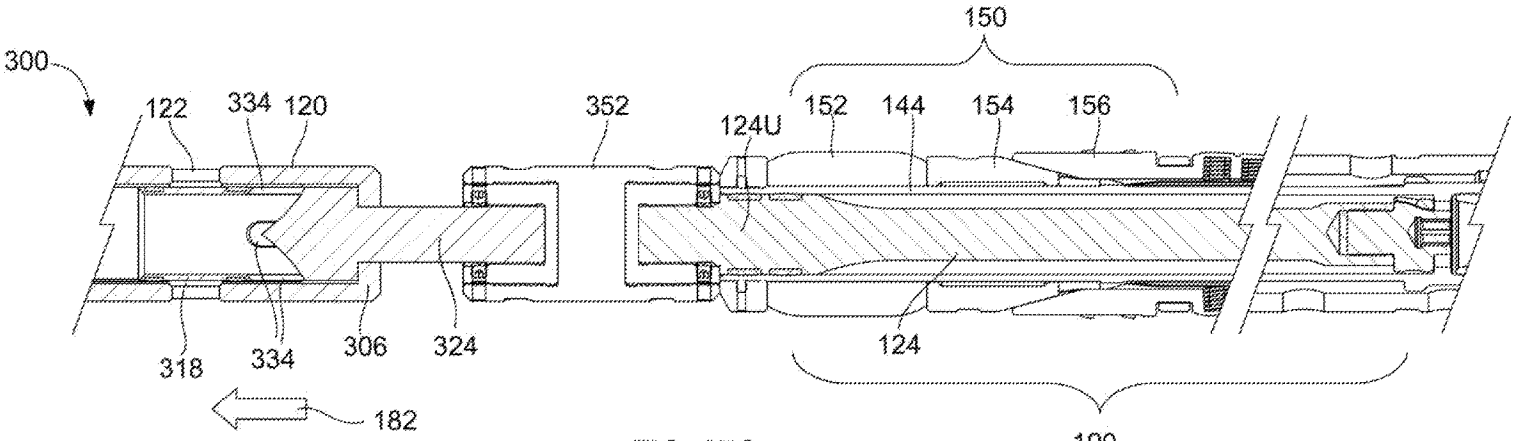
FIG. 27C illustrates the operation of the selector valve of FIG. 26 in the POOH stage, wherein the blast joint is moving uphole to close the selector valve before pulling the coupling mandrel uphole and opening the bypass valve.

As shown in FIG. 27C, after fracturing, the coiled tubing (not shown) is pulled up, pulling the blast joint 120 uphole, as indicated by the arrow 182. The frac sleeve 318 shifts downhole relative to the blast joint 120, moving to the closed position and closing the selector valve 300. When the downhole wall 306 of the blast joint 120 engages the frac sleeve 318, the blast joint 120 pulls the coupling mandrel 124 uphole.

Figure 27D:
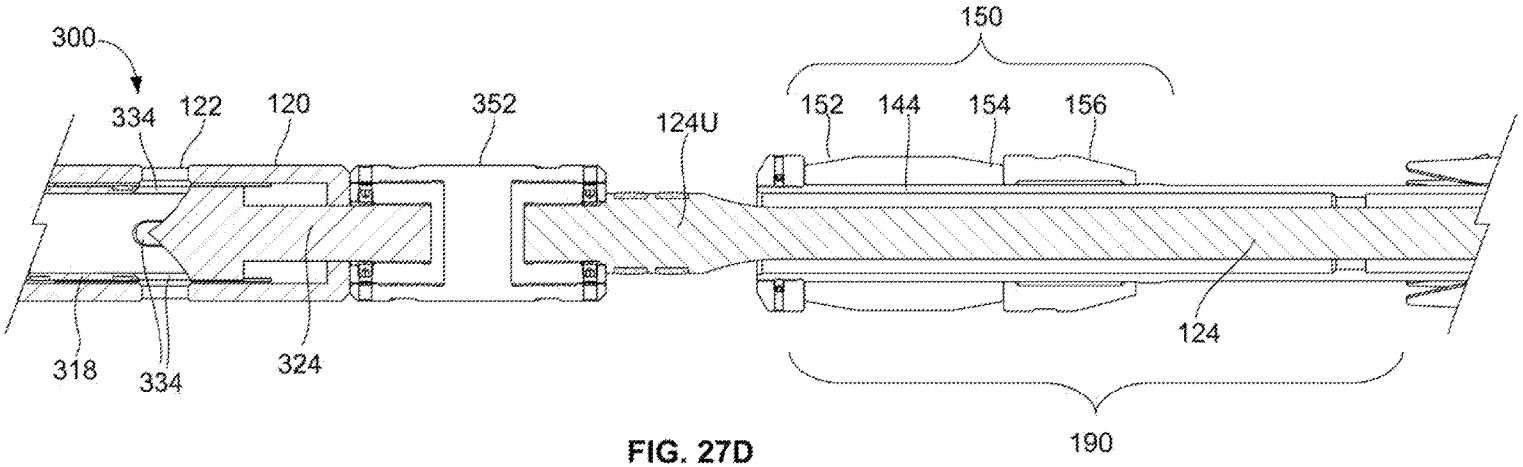
FIG. 27D illustrates the operation of the selector valve of FIG. 26 in the POOH stage, wherein the blast joint pulls the coupling mandrel uphole and opens the bypass valve.

As shown in FIG. 27D, the blast joint 120 further pulls the coupling mandrel 124 uphole to unseat the coupling mandrel 124 from the actuator sleeve 144, opening the bypass valve 190 for pressure equalization and packer release. The selector valve 300 remains closed.

The selector valve 300 facilitates the fracturing, clearing of accumulated debris and abrasive jetting. The fluid flow in various situations is similar to that of FIGS. 25A to 25C, and thus is not described here.

In above embodiments, the blast joint 120 shifts downhole to open the selector valve 300 and shifts uphole to shut off the selector valve 300. In yet another embodiment, the blast joint shifts uphole to open the selector valve and shifts downhole to shut off the selector valve. In this embodiment, the selector valve permits abrasive jetting while the packer is set, avoiding debris and the like flowing down over and about an unset packer.

As shown in FIGS. 28A to 28D, in this embodiment, the blast joint 120 comprises a tube housing 402, preferably lined or otherwise hardened to lessen the effect of erosion treatment fluids and abrasives. The housing 402 is ported to have one or more treatment fracturing ports 122 and one or more debris clearance holes 410. The housing 402 also comprises an uphole opening 424 coupled a tool sub, and a downhole wall 406 having a bore 408 at the center thereof for receiving a rod 424 slidingly passing therethrough. The downhole wall 406 of the housing 402 has a diameter substantively larger than that of the uphole seal portion 124U of the coupling mandrel 124, and the bore 408 has a diameter substantively smaller than that of the uphole seal portion 124U of the coupling mandrel 124 such that the housing 402, when moving downhole, may engage the coupling mandrel 124 and the second assembly 104 and push them downhole.

The housing 402 receives therein a port release piston 412 axially moveable therein between a downhole, open position (FIG. 28A) and an uphole, closed position (FIG. 28B), forming the selector valve 400 for opening and closing the treatment fracturing ports 122 and the debris clearance holes 410. In this embodiment, the actuator sleeve 144 does not comprise a delimit shoulder about the stop nut of the coupling mandrel.

The port release piston 412 is a hollow tube having an uphole wall 414 and an open downhole end for receiving a rod 424 axially moveable therein. The port release piston 412 may be divided to an uphole portion 412A and a downhole portion 412B. The uphole portion 412A has an outer diameter smaller than the inner diameter of the housing 402. Thus, the annulus space 416 between the uphole portion 412A and the housing 402 forms a fluid passage in fluid communication with the interior space of the housing 402 and in turn in fluid communication with the coiled tubing through the subs uphole of the blast joint 120. The uphole portion 412A has a length such that, when the port release piston 412 is at the open position, i.e., seating against the downhole wall of the housing 406, the fluid passage 416 is in fluid communication with the treatment fracturing ports 122 and debris clearance holes 410 of the housing 402.

The downhole portion 412B has an outer diameter the same as or slightly smaller than the inner diameter of the housing 402, and is fit with seals (not shown) for straddling the treatment fracturing ports 122 and debris clearance holes 410 to sealably engage the inner surface of the housing 302 and close the selector valve 400 when the port release piston 412 is at the closed position (described in more detail later). The inner diameter of the downhole portion 412B is smaller than that of the uphole portion 412A to form a stop shoulder 418. The downhole portion 412B also comprises an annular recess 420 on its inner surface for engaging a latch of the rod 424.

As shown, the rod 424 has a diameter generally the same as or slightly smaller than the inner diameter of the downhole portion 412B of the port release piston 412. The rod 424 has a radially expanded uphole head 426 having a diameter generally the same as or slightly smaller than the inner diameter of the uphole portion 412A of the port release piston 412. Therefore, the rod 424 is axially moveable relative to the port release piston 412 between the uphole wall 414 and the stop shoulder 418. The rod 424 also comprises an annular extrusion 430 for engaging the annular recess 420 of the port release piston 412. The downhole end of the rod 424 extends out of the bore 408 and is coupled to the coupling mandrel 124 via suitable means.

The extrusion 430 of the rod 424 engages the recess 420 of the port release piston 412 to form a detent or releasable latch for temporarily retaining the port release piston 412 axially to the rod 424 such that the expanded head 426 of the rod 424 engages the top shoulder 418 of the port release piston 412, and the port release piston 412 and the rod 424 are moving uphole/downhole together. The releasable latch can be one or a variety of robust devices to resist the fluid pressures including detents, collets and restraining pistons and the like.

When the extrusion 430 of the rod 424 and the recess 420 of the port release piston 412 are engaged, they may be disengages by displacing the port release piston 412 uphole relative to the housing 402 and flushing a fluid stream downhole to the uphole end wall 414 of the port release piston 412 with a pressure greater than a predefined threshold pressure; such a threshold pressure may be a pressure greater than or equal to a jet fluid pressure used during operation. The port release piston 412 is then unlatched from the rod 424 and is displaced downhole relative to the housing 402.

When the extrusion 430 of the rod 424 and the recess 420 of the port release piston 412 are disengaged, they may be engages by pulling the blast joint 120 uphole. With the weight of the downhole components, e.g., the coupling mandrel 124, holing the rod 424, the port release piston 412 is pulled uphole by the housing 302. When the stop shoulder 418 of the port release piston 412 engages the expanded head 426 of the rod 424, the extrusion 430 of the rod 424 engages the recess 420 of the port release piston 412, latching the port release piston 412 and the rod 424.

Figure 28A:
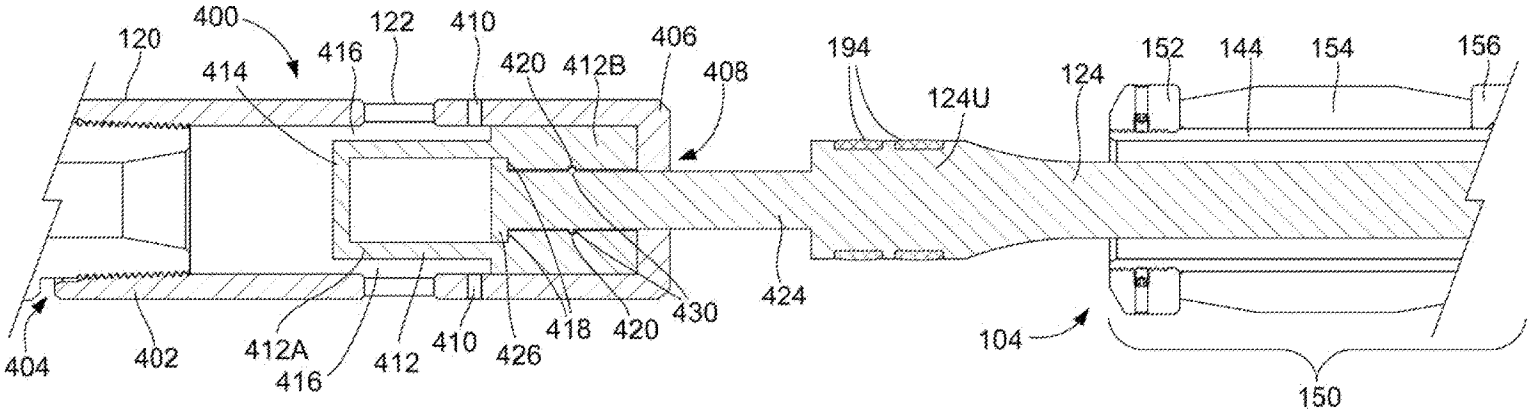
FIG. 28A illustrates a selector valve in the blast joint of the BHA in a latched and open condition, according to yet another embodiment.

As shown in FIG. 28A, when the blast joint 120 is moving uphole, the port release piston 412 is displaced downhole relative thereto. The extrusion 430 of the rod 424 and the recess 420 of the port release piston 412 are engaged. The selector valve 400 is in a latched and open condition when the port release piston 412 is shifted to the open position delimited by the port release piston 412 seating against the downhole wall 406 of the housing 402, causing the fluid passage 416 in fluid communication with the treatment fracturing ports 122 and the debris clearance hole 410. Further uphole movement of the blast joint 120 pulls the port release piston 412, which in turn pulls the coupling mandrel 124 uphole to open the bypass valve 190.

Figure 28B:
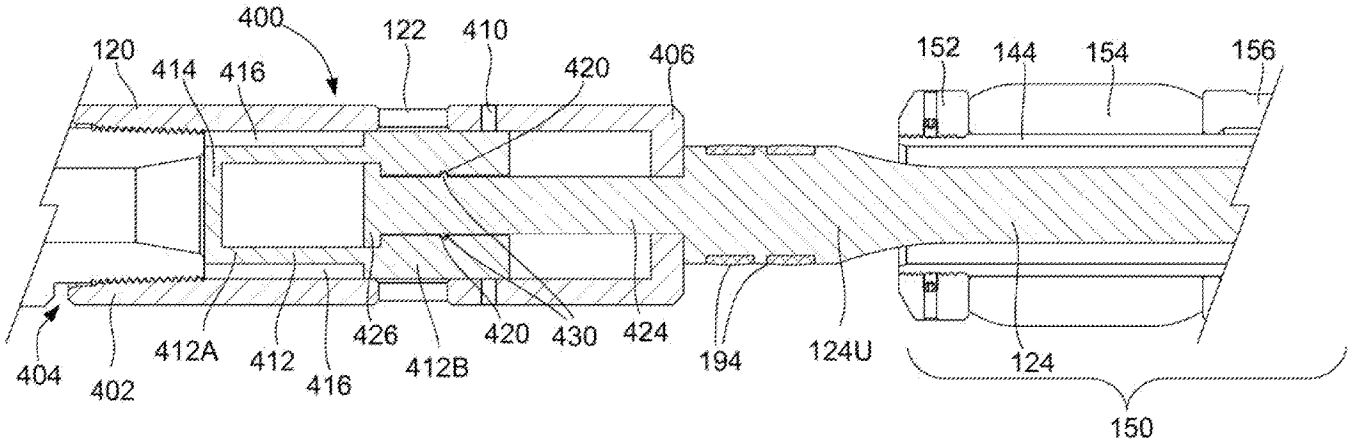
FIG. 28B illustrates the selector valve of FIG. 28A in a latched and closed condition.
Figure 28C:
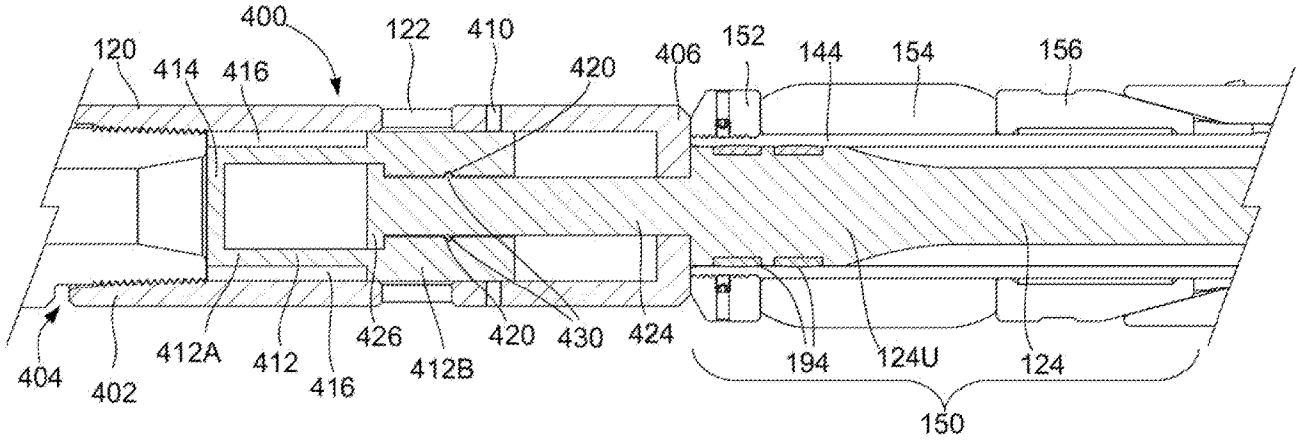
FIG. 28C illustrates the selector valve of FIG. 28A in a latched and closed condition when the packer is set.

As shown in FIG. 28B, when the blast joint 120 is moving downhole, the port release piston 412 is displaced uphole relative thereto. The extrusion 430 of the rod 424 and the recess 420 of the port release piston 412 are engaged. The selector valve 400 is in a latched and closed condition when the port release piston 412 is shifted to the closed position delimited by the blast joint 120 engaging the coupling mandrel 124. The downhole portion 412B of the port release piston 412 blocks the treatment fracturing ports 122 and the debris clearance hole 410. Although not shown, suitable seal(s) may be used to reliably block the treatment fracturing ports 122 and the debris clearance hole 410. The blast joint 120 continues to move downhole and pushes the coupling mandrel 124 downhole into the actuator sleeve 144 and closes the bypass valve 190. As shown in FIG. 28C, after the blast joint 120 engages the packer upper stop 152, further downhole movement of the blast joint 120 also pushes the second assembly 104 downhole and sets the packer 154 (after J-slot cycling).

After the selector valve 400 is in the latched and closed condition and the packer 154 is set, abrasive jetting may then be conducted at normal fluid flow and jet fluid pressure via the jetting assembly (not shown in FIG. 28B, see jet sub 114 and nozzles 116 in FIG. 29B) uphole of the blast joint 120. The jet fluid pressure acts on the port release piston 412 and generates force thereon, but is insufficient to overcome the releasable latch 420/430. Therefore, the treatment fracturing ports 122 and the debris clearance hole 410 remain closed and jetting continues effectively.

Figure 28D:
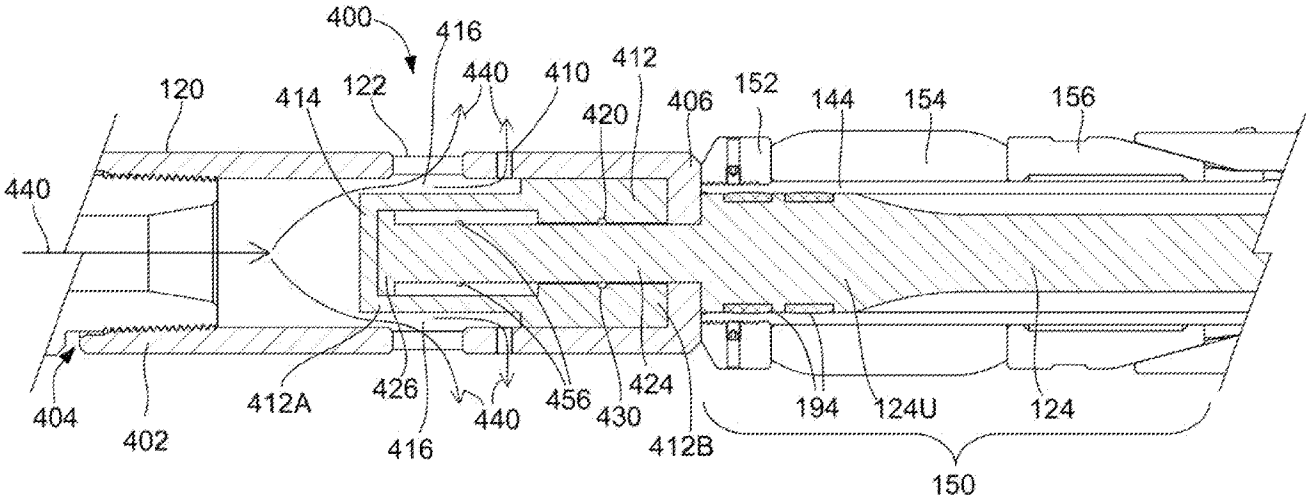
FIG. 28D illustrates the selector valve of FIG. 28A in an unlatched and open condition when the packer is set.

As shown in FIG. 28D, after jetting, the fluid rate of the fluid flow pumping from the coiled tubing down to the jetting assembly or jet sub can be temporarily raised to increase the fluid pressure. As the jetting assembly sub is in fluid communication with the blast joint 120, the pressure applied to the uphole wall 414 of the port release piston 412 is also increased. When the pressure exceeds the predefined threshold pressure, the fluid forces latch 420/430 to release, and causes the port release piston 412 to shift downhole to the open position. The selector valve 400 is then in an unlatched and open condition, allowing fluid to flush through the treatment fracturing ports 122 and the debris clearance holes 410, as indicated by arrows 440, for treating the newly formed jet openings, and for flushing the uphole end of the port release piston 412 in preparation for the next pull up cycle.

The selector valve 400 in this embodiment provides operators a method of choosing abrasive jetting or blast joint fracturing using controlled fluid rate after setting the packer, allowing switch from abrasive jetting to blast joint fracturing without unsetting the packer or moving the BHA. An advantage of this method is that, as one does not need to move the BHA to switch from abrasive jetting to blast joint fracturing, this method reduces the risk of not completing the abrasive jet cuts due to moving the BHA during the abrasive jet cut process.

In the embodiments of FIGS. 22A to 27D, the treatment fracturing ports 122 are closed when the frac sleeve 318 seats against the downhole wall 306 of the housing 302. In some other embodiments, the tube housing 302 comprises an annular stop on the inner surface thereof adjacent the downhole wall 306 such that the treatment fracturing ports 122 are closed when the frac sleeve 318 is displaced downhole and seats against the annular stop.

Similarly, in the embodiment of FIGS. 28A to 28D, the treatment fracturing ports 122 and debris clearance holes 410 are open when the port release piston 412 seats against the downhole wall 406 of the housing 402. In another embodiment, the housing 402 comprises an annular stop on the inner surface thereof adjacent the downhole wall 406 such that the treatment fracturing ports 122 and debris clearance holes 410 are open when the port release piston 412 is displaced downhole and seats against the annular stop.

Although in some of above embodiments, the blast joint 120 comprises one or more debris clearance holes. In an alternative embodiment, the blast joint does not comprise any debris clearance hole.

In above embodiments, the selector valve comprises a sliding sleeve or port release piston received in the blast joint. In some other embodiments, the selector valve may comprise a sliding sleeve on the outer surface of the blast joint.

Figure 29A:
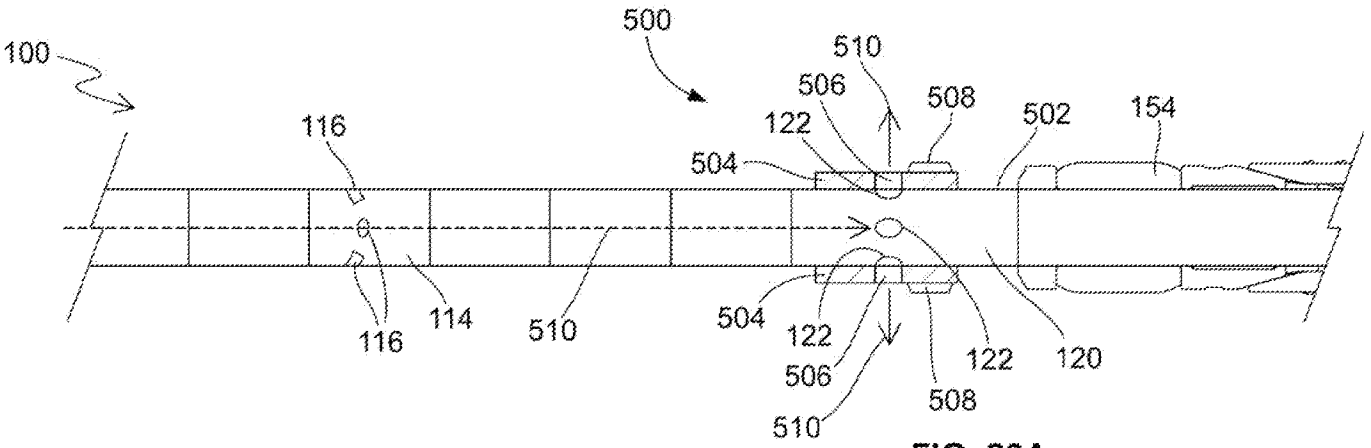
FIG. 29A illustrates a selector valve in the blast joint of the BHA in an open condition, according to still another embodiment.
Figure 29B:
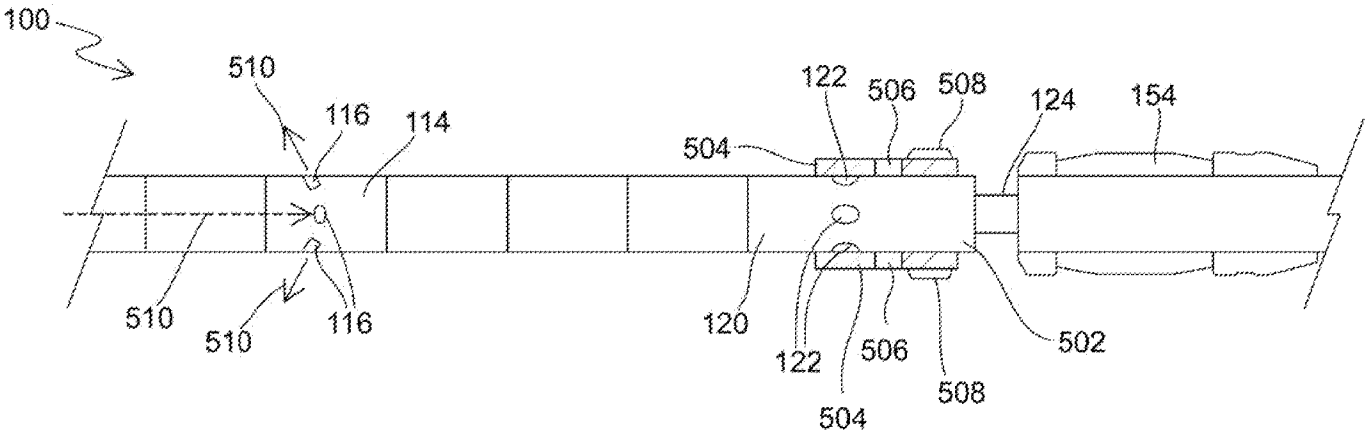
FIG. 29B illustrates a selector valve of FIG. 29A in a closed condition.

FIGS. 29A and 29B illustrate a selector valve 500 having an external sliding sleeve 504 on the outer surface of a blast joint 120. As shown, the blast joint 120 comprises a tube housing 502, preferably lined or otherwise hardened to lessen the effect of erosion treatment fluids and abrasives. The housing 502 is ported to have one or more treatment fracturing ports 122. The housing 502 also comprises an uphole opening coupled a tool sub, and a downhole end coupling to the coupling mandrel 124, same as the housing of the blast joint in FIG. 1A.

An external sliding sleeve 504 is fit about the housing 502 on its outer surface, forming the selector valve 500. The sliding sleeve 504 is axially moveable between an open position (FIG. 29A) and a closed position (FIG. 29B), and is ported to having one or more ports 506 such that, when the sliding sleeve 504 is at the open position, the ports 506 of the sliding sleeve 504 are aligned with the treatment fracturing ports 122 of the housing 502, and when the sliding sleeve 504 is at the closed position, the ports 506 of the sliding sleeve 504 are misaligned with the treatment fracturing ports 122 of the housing 502. The sliding sleeve 504 also comprises one or more drag blocks 508 for effecting actuation.

As shown in FIG. 29A, while running in-hole or after the downhole movement of the BHA 100 to set the packer 154, the drag blocks 508 restrain the external sliding sleeve 504 such that the sliding sleeve 504 moves uphole relatively to the housing 502 to the open position. Ports 506 of the sliding sleeve 504 are aligned with the treatment fracturing ports 122 of the housing 502, and the selector valve 500 is then open. Fluid treatment 510, such as fracturing, may be conducted through the treatment fracturing ports 122.

As shown in FIG. 29B, during pull up of the BHA 100, the drag blocks 508 restrain the external sleeve 504 such that the sliding sleeve 504 moves downhole relative to the housing 502 to the closed position. The treatment fracturing ports 122 of the housing 502 are blocked by the sliding sleeve 504, and the selector valve 500 is closed. Although not shown, suitable seal(s) may be used to reliably block the treatment fracturing ports 122. The jet sub 114 can be operated as a jetting assembly to flush the fluid 510 from the nozzles 116.

Figure 30A:
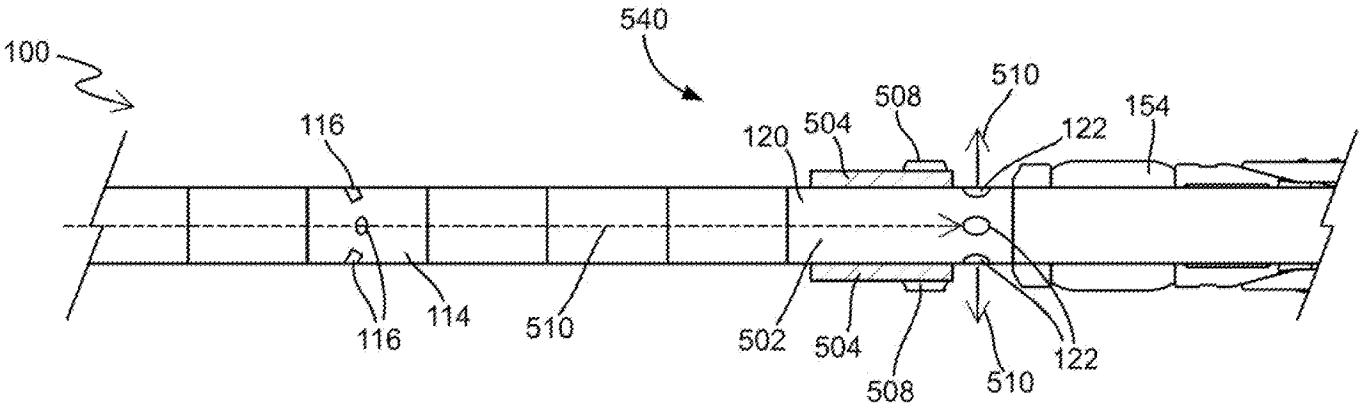
FIG. 30A illustrates a selector valve in the blast joint of the BHA in an open condition, according to yet still another embodiment.
Figure 30B:
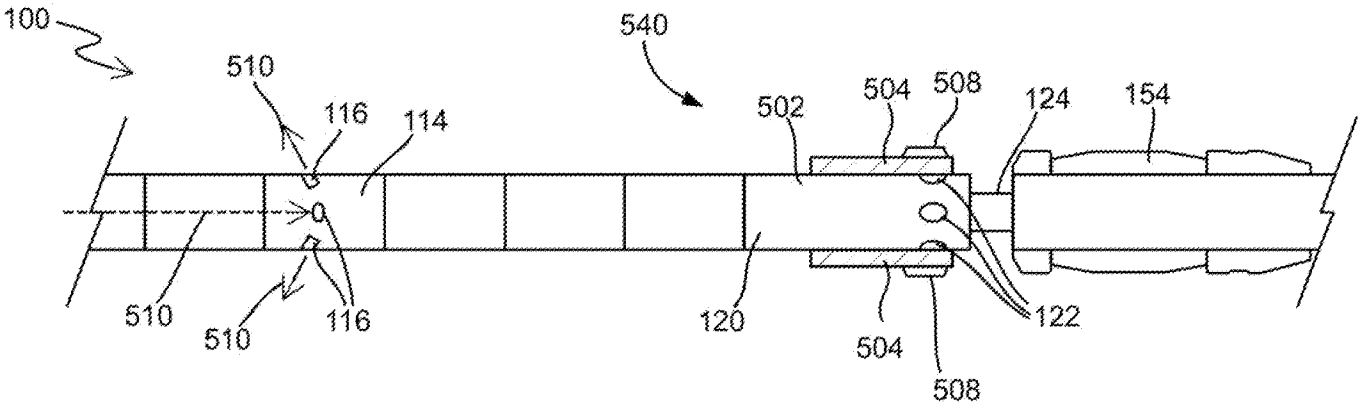
FIG. 30B illustrates a selector valve of FIG. 30A in a closed condition.

FIGS. 30A and 30B illustrate a selector valve 540 having an external sliding sleeve 504 on the outer surface of a blast joint 120, according to another embodiment. Similar to the embodiment of FIGS. 29A and 29B, the blast joint 120 comprises a tube housing 502, preferably lined or otherwise hardened to lessen the effect of erosion treatment fluids and abrasives. The housing 502 is ported to have one or more treatment fracturing ports 122. The housing 502 also comprises an uphole opening coupled a tool sub, and a downhole end coupling to the coupling mandrel 124, same as the housing of the blast joint in FIG. 1A.

An external sliding sleeve 504 is fit about the housing 502 on its outer surface, forming the selector valve 500. The sliding sleeve 504 is axially moveable between an open position (FIG. 30A) and a closed position (FIG. 30B) such that, when the sliding sleeve 504 is at the open position, the treatment fracturing ports 122 of the housing 502 are uncovered from the sliding sleeve 504, and when the sliding sleeve 504 is at the closed position, the treatment fracturing ports 122 of the housing 502 are covered and sealably blocked by the sliding sleeve 504. Although not shown, suitable seal(s) may be used to reliably block the treatment fracturing ports 122. The sliding sleeve 504 also comprises one or more drag blocks 508 for effecting actuation. The operation of the selector valve 540 is similar to that of the selector valve 500 of FIGS. 29A and 29B.

In above embodiments, the blast joint comprises a selector valve for selectively opening and closing the treatment fracturing ports. Those skilled in the art appreciate that, in some other embodiments, the jetting assembly sub may comprises a similar selector valve for selectively open and close jet nozzles.

In yet another embodiment, a tool sub of the BHA comprises both abrasive jetting assembly and fracturing ports, and uses a selector valve to selectively use the abrasive jetting assembly or use the fracturing ports. A separate abrasive jetting assembly sub is therefore not required.

Figure 31A:
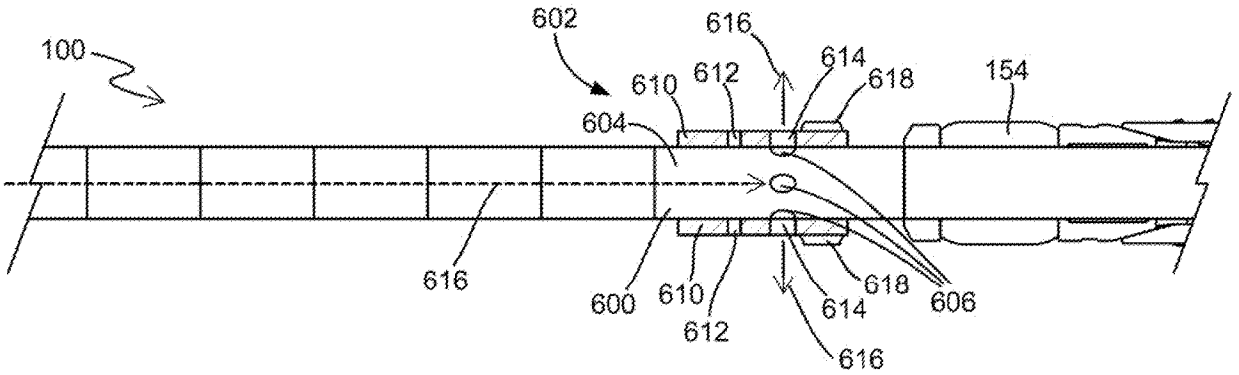
FIG. 31A illustrates a tool sub of the BHA having both abrasive jetting nozzles and fracturing ports, and a selector valve for selectively using the abrasive jetting nozzles or fracturing ports, according to another embodiment, wherein the selector valve opens the fracturing ports and closes the jetting nozzles.
Figure 31B:
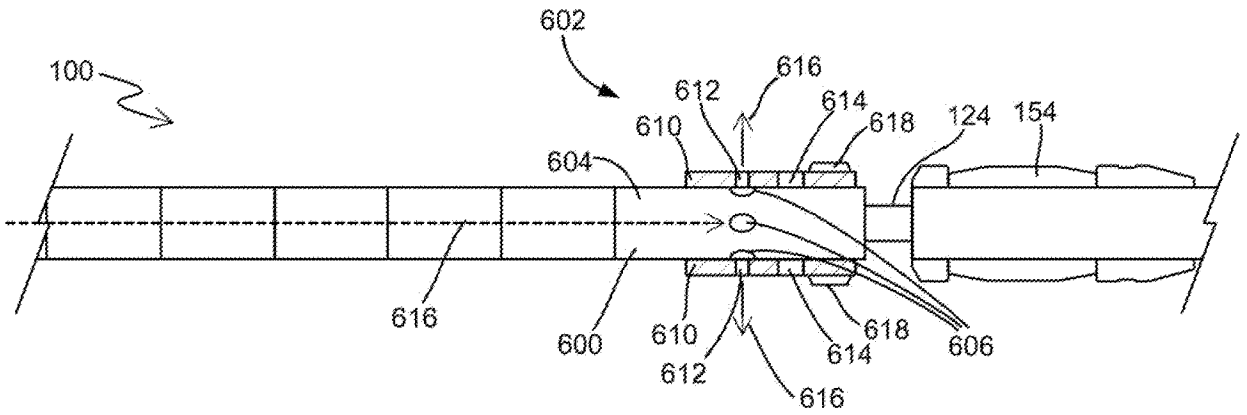
FIG. 31B illustrates the tool sub of FIG. 31A, wherein the selector valve opens the jetting nozzles and closes the fracturing ports.

As shown in FIGS. 31A and 31B, in this embodiment, the BHA 100 comprises an abrasive jet/fracturing sub 600 having a selector valve 602. The abrasive jet/fracturing sub 600 comprises a tub housing 604, preferably lined or otherwise hardened to lessen the effect of erosion treatment fluids and abrasives. The housing 604 is ported to have one or more selector ports 606. The housing 604 also comprises an uphole opening coupled a tool sub, and a downhole end coupling to the coupling mandrel 124, same as the housing of the blast joint in FIG. 1A.

An external sliding sleeve 610 is fit about the housing 604 on its outer surface, forming the selector valve 602. The sliding sleeve 610 is axially moveable between a fracturing position (FIG. 31A) and a jetting position (FIG. 31B). The sliding sleeve 610 is ported to have one or more jetting nozzles 612, and one or more treatment fracturing ports 614. In the example of FIGS. 31A and 31B, the jetting nozzles 612 are uphole of the treatment fracturing ports 614. When the sliding sleeve 610 is at the fracturing position, the selector ports 606 of the housing 604 are aligned with the treatment fracturing ports 614 of the sliding sleeve 610, and the jetting nozzles 612 are sealably covered by the sliding sleeve 610. Then, fracturing may be conducted as indicated by the arrows 616 in FIG. 31A, when, e.g., the packer 154 is set. When the sliding sleeve 610 is at the jetting position, the selector ports 606 of the housing 604 are aligned with the jetting nozzles 612 of the sliding sleeve 610, and the treatment fracturing ports 614 are sealably covered by the sliding sleeve 610. Then, abrasive jet cutting may be conducted as indicated by the arrows 616 in FIG. 31B, when, e.g., the packer 154 is unset. The sliding sleeve 610 also comprises one or more drag blocks 618 for effecting actuation.

Although not shown, suitable seal(s) may be used to reliably block the treatment fracturing ports 614 and the jetting nozzles 612 when the sliding sleeve 610 is at the jetting position and the fracturing position, respectively.

Figure 32A:
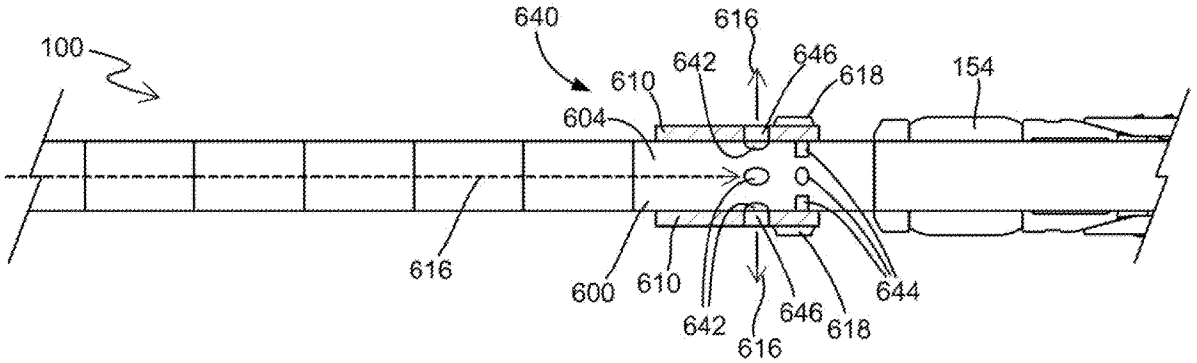
FIG. 32A illustrates a tool sub of the BHA having both abrasive jetting nozzles and fracturing ports, and a selector valve for selectively using the abrasive jetting nozzles or fracturing ports, according to yet another embodiment, wherein the selector valve opens the fracturing ports and closes the jetting nozzles.
Figure 32B:
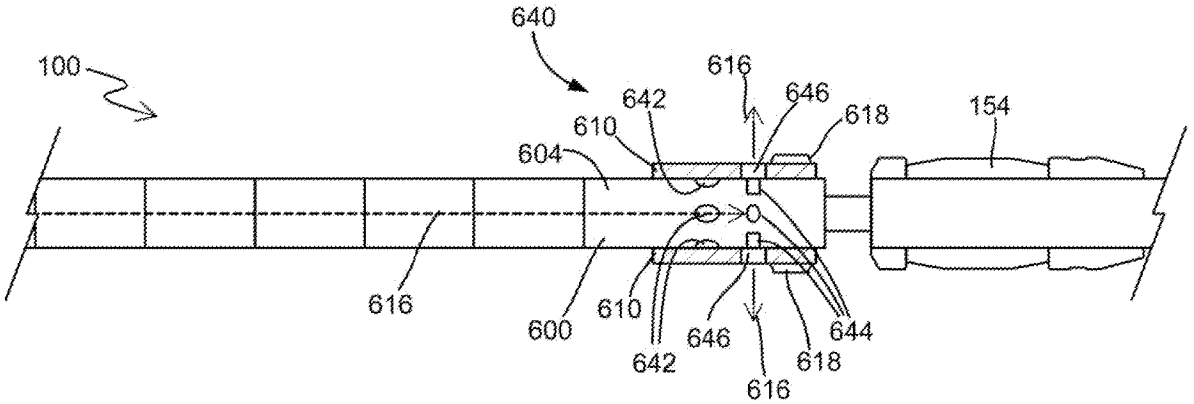
FIG. 32B illustrates the tool sub of FIG. 32A, wherein the selector valve opens the jetting nozzles and closes the fracturing ports.

As shown in FIGS. 32A and 32B, in another embodiment, the BHA 100 comprises an abrasive jet/fracturing sub 600 having a selector valve 640. In this embodiment, the abrasive jet/fracturing sub 600 comprises a tub housing 604, preferably lined or otherwise hardened to lessen the effect of erosion treatment fluids and abrasives. The housing 604 is ported to have one or more treatment fracturing ports 642, and one or more jetting nozzles 644. In the example of FIGS. 32A and 32B, the treatment fracturing ports 642 are uphole of the jetting nozzles 644. The housing 604 also comprises an uphole opening coupled a tool sub, and a downhole end coupling to the coupling mandrel 124, same as the housing of the blast joint in FIG. 1A.

An external sliding sleeve 610 is fit about the housing 604 on its outer surface, forming the selector valve 640. The sliding sleeve 610 is axially moveable between a fracturing position (FIG. 32A) and a jetting position (FIG. 32B). The sliding sleeve 610 is ported to have one or more selector ports 646. When the sliding sleeve 610 is at the fracturing position, the selector ports 646 of the sliding sleeve 610 are aligned with the treatment fracturing ports 642 of the housing 604, and the jetting nozzles 644 are sealably covered by the sliding sleeve 610. Then, fracturing may be conducted, indicated by the arrows 616 in FIG. 32A, when, e.g., the packer 154 is set. When the sliding sleeve 610 is at the jetting position, the selector ports 646 of the sliding sleeve 610 are aligned with the jetting nozzles 644 of the housing 604, and the treatment fracturing ports 642 are sealably covered by the sliding sleeve 610. Then, abrasive jet cutting may be conducted, indicated by the arrows 616 in FIG. 32B, when, e.g., the packer 154 is unset. The sliding sleeve 610 also comprises one or more drag blocks 618 for effecting actuation.

Although not shown, suitable seal(s) may be used to reliably block the treatment fracturing ports 642 and the jetting nozzles 644 when the sliding sleeve 610 is at the jetting position and the fracturing position, respectively.

Figure 33A:
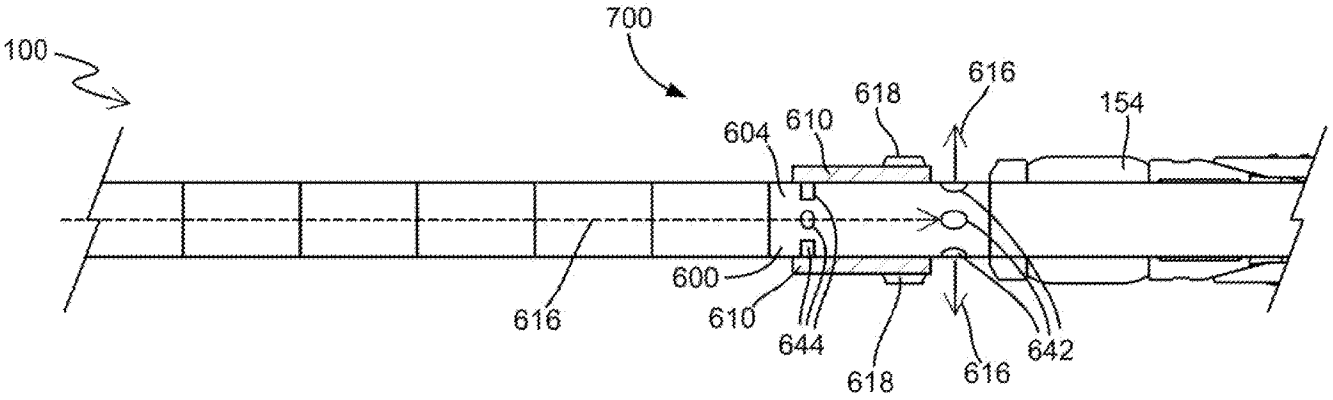
FIG. 33A illustrates a tool sub of the BHA having both abrasive jetting nozzles and fracturing ports, and a selector valve for selectively using the abrasive jetting nozzles or fracturing ports, according to still another embodiment, wherein the selector valve opens the fracturing ports and closes the jetting nozzles.
Figure 33B:
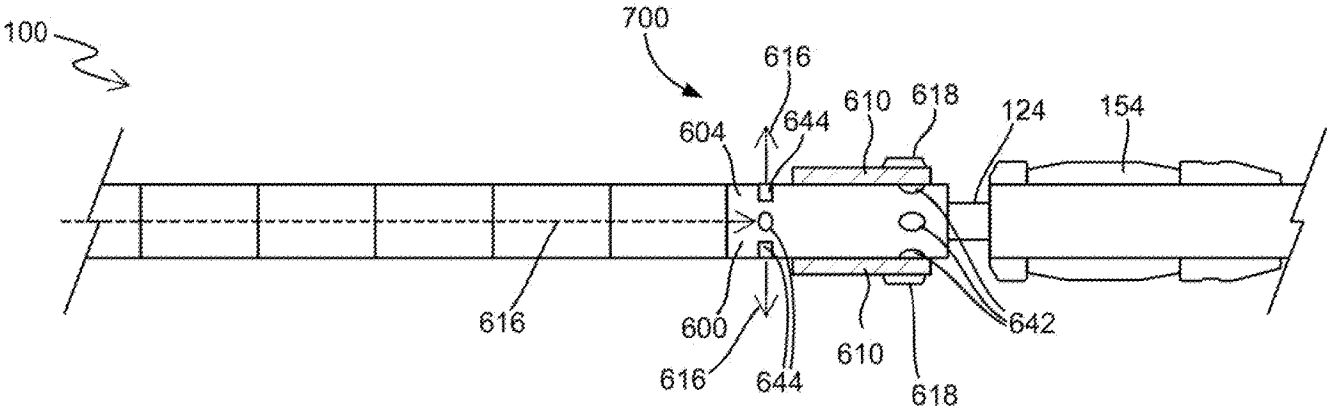
FIG. 33B illustrates the tool sub of FIG. 33A, wherein the selector valve opens the jetting nozzles and closes the fracturing ports.

As shown in FIGS. 33A and 33B, in another embodiment, the BHA 100 comprises an abrasive jet/fracturing sub 600 having a selector valve 700. In this embodiment, the abrasive jet/fracturing sub 600 comprises a tube housing 604, preferably lined or otherwise hardened to lessen the effect of erosion treatment fluids and abrasives. The housing 604 is ported to have one or more treatment fracturing ports 642, and one or more jetting nozzles 644. In the example of FIGS. 33A and 33B, the treatment fracturing ports 642 are downhole of the jetting nozzles 644. The housing 604 also comprises an uphole opening coupled a tool sub, and a downhole end coupling to the coupling mandrel 124, same as the housing of the blast joint in FIG. 1A.

An external sliding sleeve 610 is fit about the housing 604 on its outer surface, forming the selector valve 700. The sliding sleeve 610 is axially moveable between a fracturing position (FIG. 33A) and a jetting position (FIG. 33B) such that, when the sliding sleeve 610 is at the fracturing position, the treatment fracturing ports 642 of the housing 604 are uncovered from the sliding sleeve 610, and the jetting nozzles 644 are sealably covered by the sliding sleeve 610. Then, fracturing may be conducted, indicated by the arrows 616 in FIG. 33A, when, e.g., the packer 154 is set. When the sliding sleeve 610 is at the jetting position, the jetting nozzles 644 are uncovered from the sliding sleeve 610, and the treatment fracturing ports 642 are sealably covered by the sliding sleeve 610. Then, abrasive jet cutting may be conducted, indicated by the arrows 616 in FIG. 33B, when, e.g., the packer 154 is unset. The sliding sleeve 610 also comprises one or more drag blocks 618 for effecting actuation.

Although not shown in the drawings, suitable seal(s) may be used to reliably block the treatment fracturing ports 642 and the jetting nozzles 644 when the sliding sleeve 610 is at the jetting position and the fracturing position, respectively.

Figure 34A:
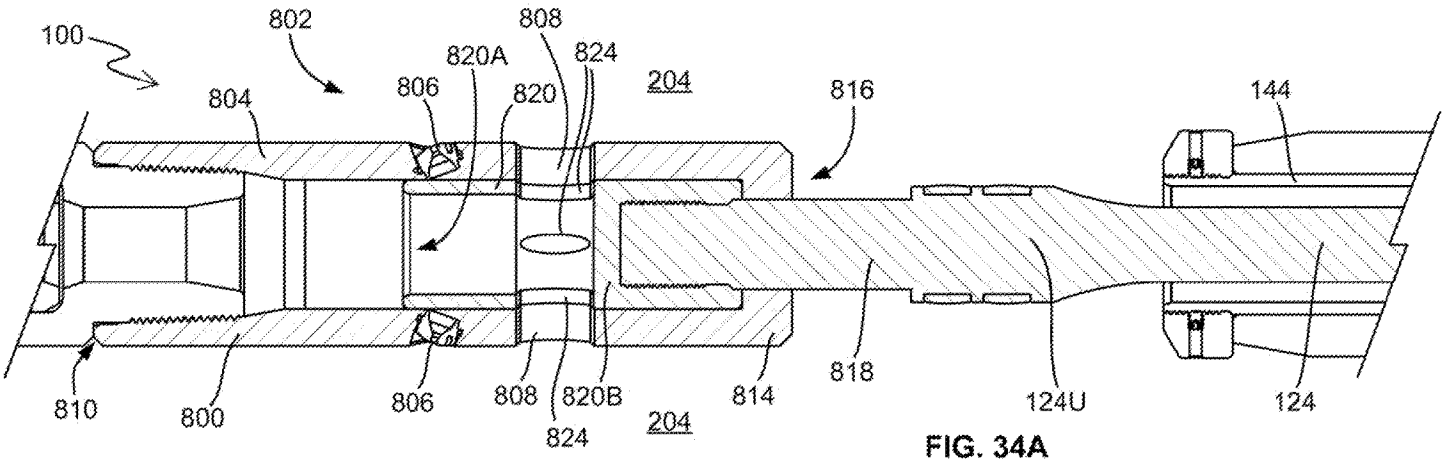
FIG. 34A illustrates a tool sub of the BHA having both abrasive jetting nozzles and fracturing ports, and a selector valve for selectively using the abrasive jetting nozzles or fracturing ports, according to yet still another embodiment, wherein the selector valve opens the fracturing ports and closes the jetting nozzles.
Figure 34B:
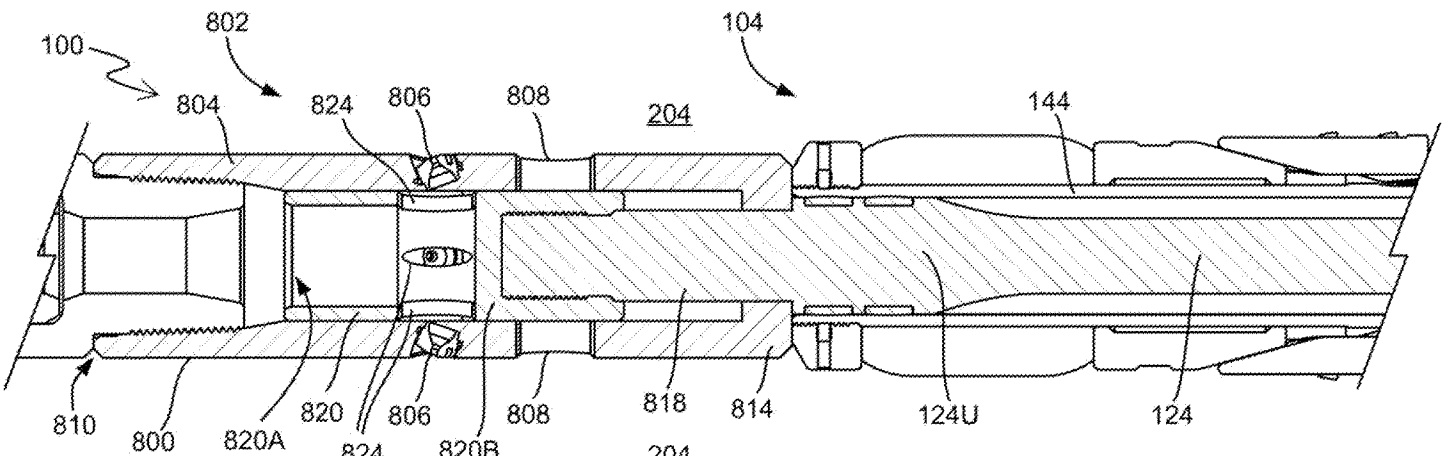
FIG. 34B illustrates the tool sub of FIG. 34A, wherein the selector valve opens the jetting nozzles and closes the fracturing ports.

FIGS. 34A and 34B illustrate a BHA 100 comprising an abrasive jet/fracturing sub 800 having an internal selector valve 802, according to still another embodiment. In this embodiment, the abrasive jet/fracturing sub 800 comprises a sub housing 804, preferably lined or otherwise hardened to lessen the effect of erosion treatment fluids and abrasives. The housing 804 is ported to have one or more jetting nozzles 806, and one or more treatment fracturing ports 808. In the example of FIGS. 34A and 34B, the jetting nozzles 806 are uphole of the treatment fracturing ports 808.

The housing 804 also comprises an uphole opening 810 coupled a tool sub, and a downhole wall 814 having a bore 816 at the center thereof for receiving a rod 818 slidingly passing therethrough. In this embodiment, the downhole wall 814 of the housing 804 has a diameter substantively larger than that of the uphole seal portion 124U of the coupling mandrel 124, and the bore 816 has a diameter substantively smaller than that of the uphole seal portion 124U of the coupling mandrel 124 such that the housing 804, when moving downhole, may engage the coupling mandrel 124 and the second assembly 104 and push them downhole.

The housing 804 receives therein a ported frac sleeve 820 axially moveable therein between a jetting position (FIG. 34A) and a fracturing position (FIG. 34B), forming the selector valve 802 for selectively using the jetting nozzles 806 or the treatment fracturing ports 808. The frac sleeve 820 has an outer diameter the same as or slightly smaller than the inner diameter of the housing 804, and is ported with one or more selector ports 824 that are aligned with the treatment fracturing ports 808 when the frac sleeve 820 is at the fracturing position, and aligned with the jetting nozzles 806 when the frac sleeve 820 is at the jetting position.

The frac sleeve 820 comprises an open uphole end 820A in fluid communication with the tool subs uphole thereof, and a closed downhole end 820B coupled to the rod 818. The rod 818 slidingly passes through the bore 816 of the housing 804, and is concentrically coupled to the uphole seal portion 124U of the coupling mandrel 124. Dependent upon the choice of materials, the rod 818 can be coupled to the coupling mandrel 124 through suitable connections, such as through a threaded connection (not shown).

As shown in FIG. 34A, the selector valve 802 is at the fracturing state when the frac sleeve 820 is at the fracturing position delimited by the frac sleeve 820 seating against the downhole wall 814 of the housing 804. The selector ports 824 are aligned with the treatment fracturing ports 808, and the jetting nozzles 806 are sealably blocked by the frac sleeve 820. Fracturing may be conducted.

As shown in FIG. 34B, the selector valve 802 is at the jetting state when the frac sleeve 820 is at the jetting position delimited by the housing 804 engaging the uphole seal portion 124U of the coupling mandrel 124. The selector ports 824 are aligned with the jetting nozzles 806, allowing fluid to be flushed therethrough from the BHA 100 into the tool annulus 204.

Similar to the embodiment of FIG. 23, in this embodiment, the actuator sleeve 144 also comprises an uphole-facing annular delimit shoulder (See FIG. 23, although the delimit shoulder is not shown in FIG. 34B) on the inner surface thereof at a position about the downhole end of the stop nut when the frac sleeve 820 is at the jetting position, for preventing the frac sleeve 820 from shifting to the fracturing position.

Alternatively, the housing 804 and the frac sleeve 820 may comprise a recess and a matching extrusion (not shown), respectively, similar to those of the embodiment of FIGS. 28A to 28D, for preventing the frac sleeve 820 from shifting to the fracturing position.

In an alternate embodiment the treatment port is implemented through an alignment, and misalignment, of the first and second assemblies. Treatment fluid can still be directed down either the conveyance string or the tool annulus. As in the first embodiment, the first and second assemblies telescope uphole and downhole for alignment of various seals and ports for alternately enabling bi-directional fluid treatment, flushing or BHA fluid bypass. Again, the first and second assemblies enable and deactivate a bypass or pressure equalization so as to isolate the wellbore below the BHA during treatment operations. The second and third assemblies enable a releasable packer and manipulation of the BHA between run-in, setting the packer and pull-up modes.

Figure 35:
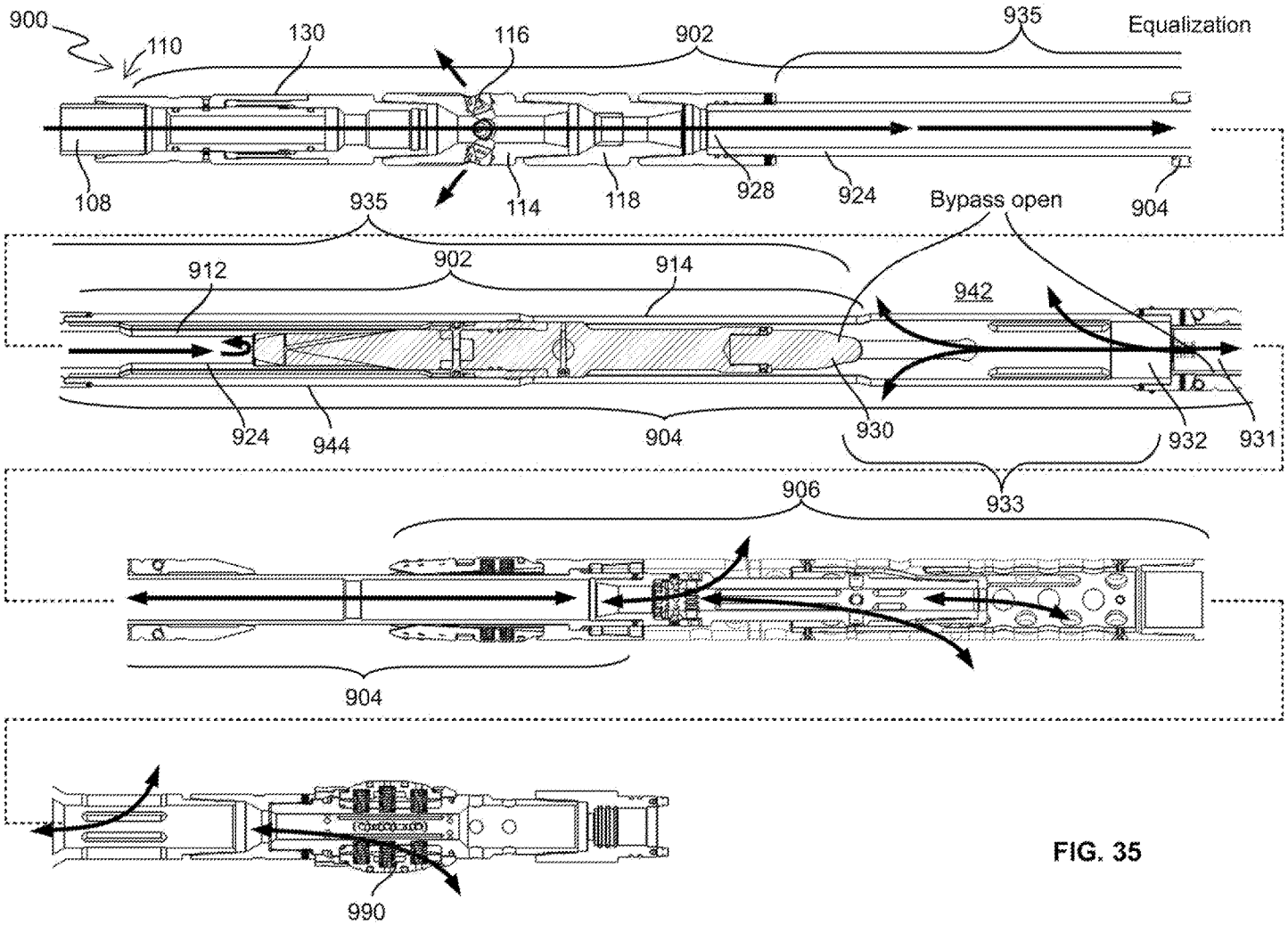
FIGS. 35 through 43 are cross-sectional views of a BHA according to another embodiment having a tubular first flow control assembly telescopically coupled to a second packer and a third anchor assembly, the first and second assemblies forming a selector valve. More particularly.

Turning to FIG. 35, BHA 900 comprises, from an uphole end to a downhole end, a first flow control assembly 902 that is axially and moveably coupled to a second intermediate packer assembly 904, which in turn is axially and moveably coupled to a third downhole anchor assembly 906. The third downhole anchor assembly 906 includes an anchor housing or J-slot guide housing 170. The arrangement and operation of the second and third assemblies 904,906 is basically the same as that described in the earlier embodiment. Again, the third assembly 906 may be further coupled to an end unit, such as that having a casing collar locator (CCL).

Figure 36:
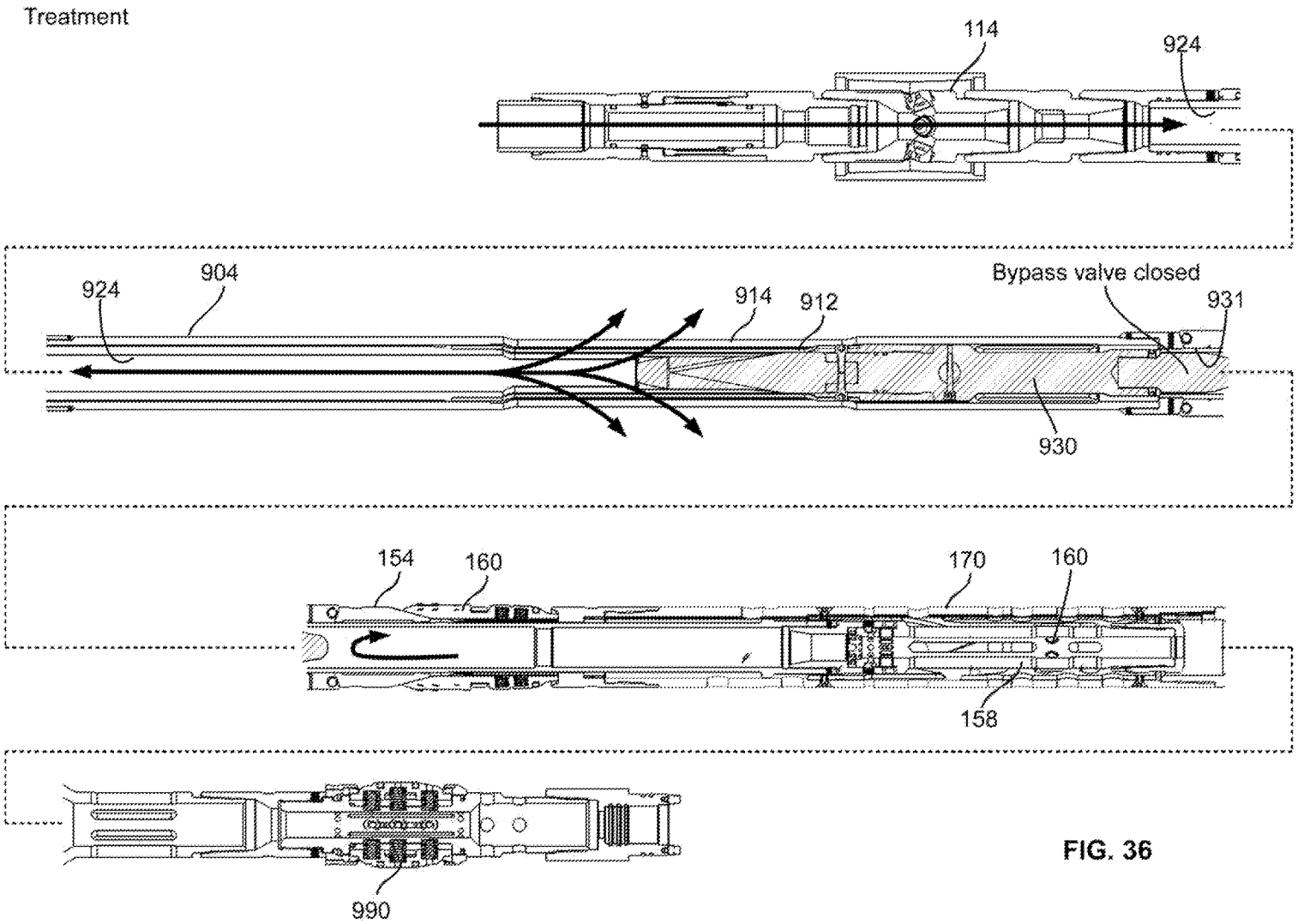

As shown in FIG. 35, the BHA is telescopically extended, the packer and slips being released, and the bypass valve being open for fluid flow through the BHA. In FIG. 36, the BHA is shown telescopically collapsed, the slips and packer being set and the bypass valve being closed such as when in-place for delivering treatment fluid to the wellbore above the packer. In this case, both the bypass valve closes and a first treatment port 912 in the first assembly 902 is aligned with a second treatment port 914 in the second assembly 904. The first treatment port 912 is formed in the side wall of the mandrel. The second treatment port 912 is formed in the side wall of the second assembly.

Figure 37:
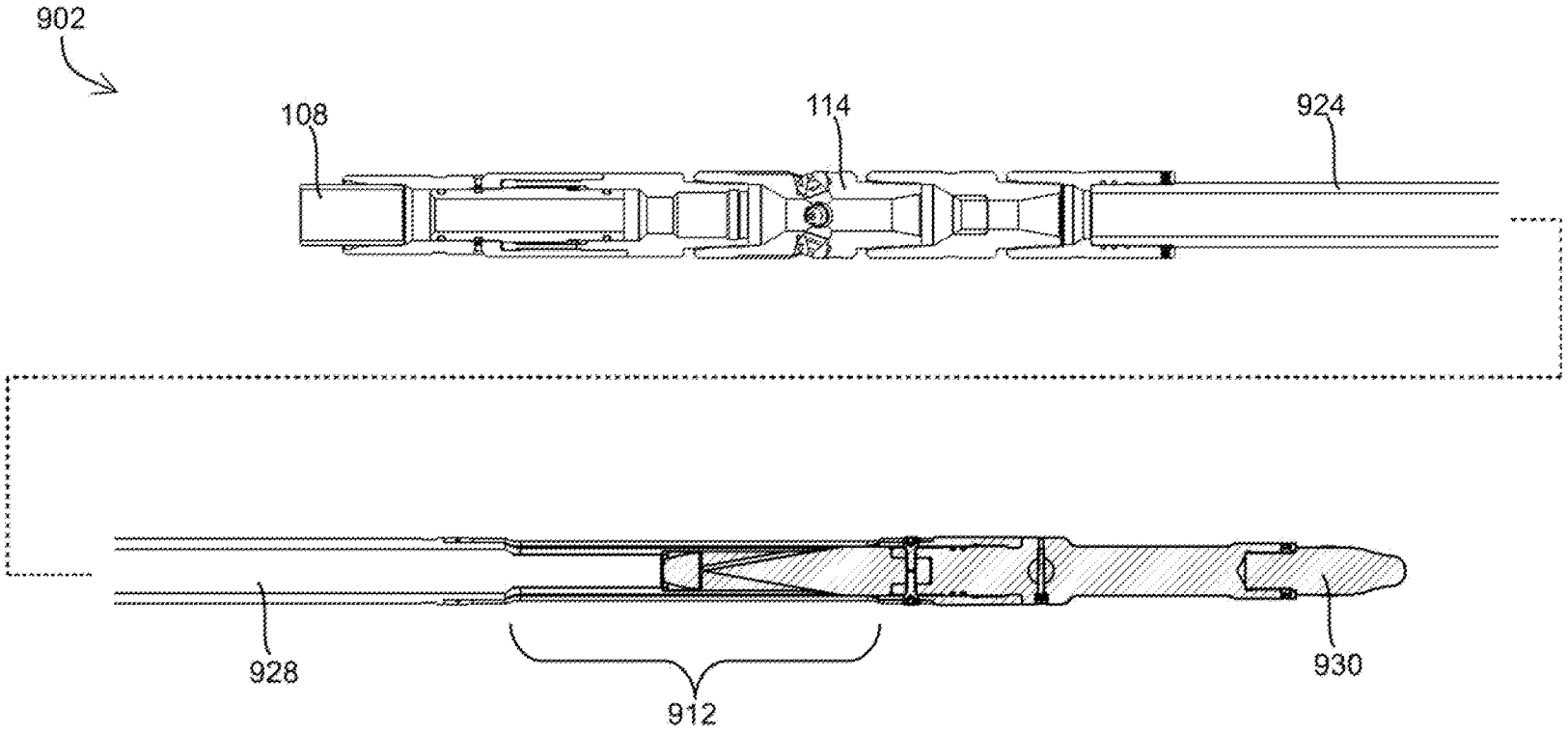
Figure 38:
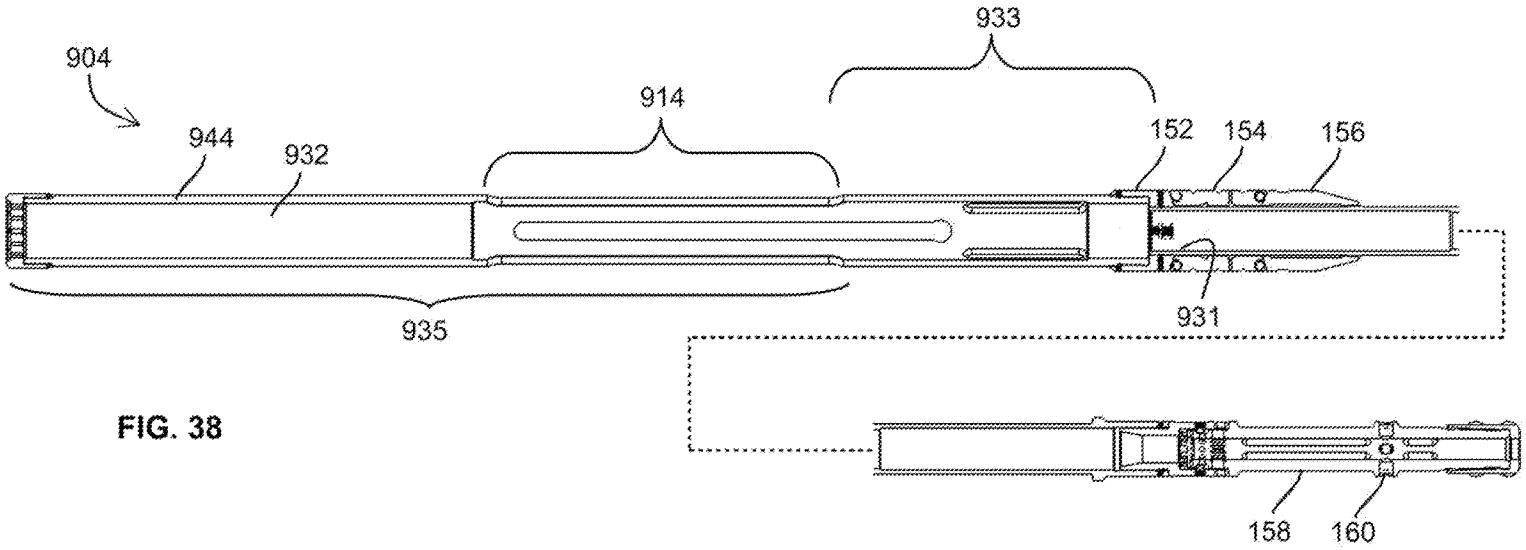
Figure 39:
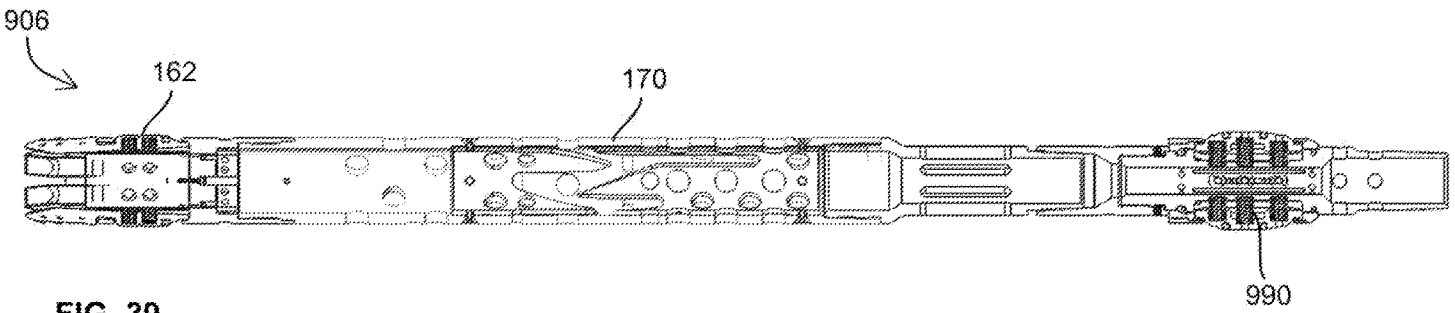

As shown in the BHA 900 of FIG. 35 and the components shown in FIGS. 37, 38 and 39, the flow control assembly 902 is secured to a conveyance string of coiled tubing 108 at an uphole end 110 thereof, and can further comprise a plurality of tool subs coupled one to another, including an emergency release sub 130), a fluid jetting assembly or jet sub 114 having one or more nozzles 116, and a ball seat 118. The ball seat is an emergency fluid blocking sub should the selector valve fail open and the jet sub is required. If used, the ball would need to be reverse circulated out of the well before treatment fluids could be reintroduced. The tool subs are in fluid communication with each other and to the coiled tubing 108 such that treatment fluid may be delivered from the surface via the coiled tubing 108 to the jet sub 114. Treatment fluid can be delivered through the nozzles 116, or to the balance of the first assembly 902 as described below.

In this embodiment, the balance of the first assembly 902, downhole of the fluid jetting assembly 114, is a tubular mandrel 924 having a first bore 928 for delivering treatment fluid to the second assembly 904. A downhole plug 930 is fit to the mandrel as a bypass valve for alternately blocking and opening a passage in the second bore 932 of the second assembly 904. The first assembly's plug 930 seals to a valve seat 931 the second bore 932 of the second tubular sleeve 944 of the second assembly 904 as it moves therealong. The bypass valve plug 930 alternately seals the second bore 932 downhole of the second treatment port 914.

Fluid from the first assembly is controlled through the selector valve formed between the mandrel 924 of the first assembly 902 and a second tubular sleeve 944 of the second assembly 904. The second tubular sleeve 944 comprises a downhole bypass portion 933 and an uphole treatment portion 935. The tubular mandrel 924 of the first assembly comprises the first treatment port 912 uphole of the plug 930 for opening the first bore 928 to an annulus between the tubular mandrel 924 and the second assembly 904. The treatment portion 935 of the second assembly comprises an intact uphole tubular portion 935, used to block the first fluid port 912 to close the selector valve and a ported downhole portion 933 having the second fluid port for opening the selector valve.

As shown in FIG. 35, when the first assembly 902 and tubular mandrel 924 is in an uphole position relative to the second assembly 904 the first fluid port 912 of the first assembly 902 moves uphole into the intact tubular portion 935, the side wall of the second tubular sleeve 944 blocking the first treatment port 912 of the first assembly 902 within the second assembly 904 and preventing treatment fluid from accessing the tool annulus 942. Further, as the first treatment port 912 is shifted uphole to a blocked position uphole of the second treatment port 914, the plug 930 is also displaced uphole, opening the bypass valve and establishing an equalization fluid flow path between the tool annulus and the BHA along the second bore 932 and downhole of the packer 154.

Accordingly, as shown, with the selector valve closed, fluid delivered downhole can flow though the jet sub for perforation of the completion string thereabout. This is typically employed if there are no sliding sleeves or if a sleeve has failed closed. The bypass valve is open for fluid communication of the tool annulus 924 uphole of the BHA 900 and the second and third assemblies 904,906 and the wellbore downhole of the BHA.

As shown in FIG. 36, when the first assembly 902 and tubular mandrel 924 is in a downhole position relative to the second assembly 904, the plug 930 engages the valve seat 931 of the second bore 932, closing the bypass valve. The first treatment port 912 of the first assembly 902 also moves downhole to align with the second treatment port 914, opening the selector valve for enabling treatment fluid to flow from the tubular mandrel's first bore 928 to the tool annulus 942 and vice versa. The tool annulus 924 uphole of the BHA 900 is isolated from the second and third assemblies 904,906 and the wellbore downhole of the BHA.

Accordingly, as shown, with the selector valve open, fluid delivered downhole though the conveyance string 108 can flow though the treatment fluid ports 912,914 to access the tool annulus 924 and open ports in a ported sleeve sub, is so positioned. Alternatively, or used in sequence, flushing fluid can be provided either down the conveyance string 108 and up the tool annulus 924, or down the annulus 924 and up the conveyance string 108.

Figure 40:
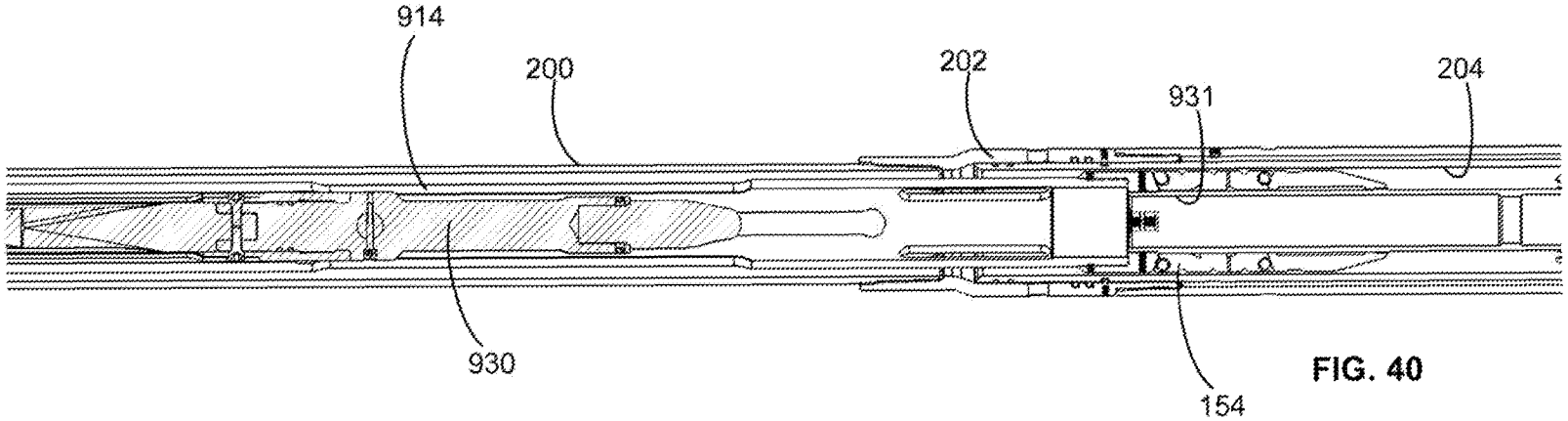
Figure 41:
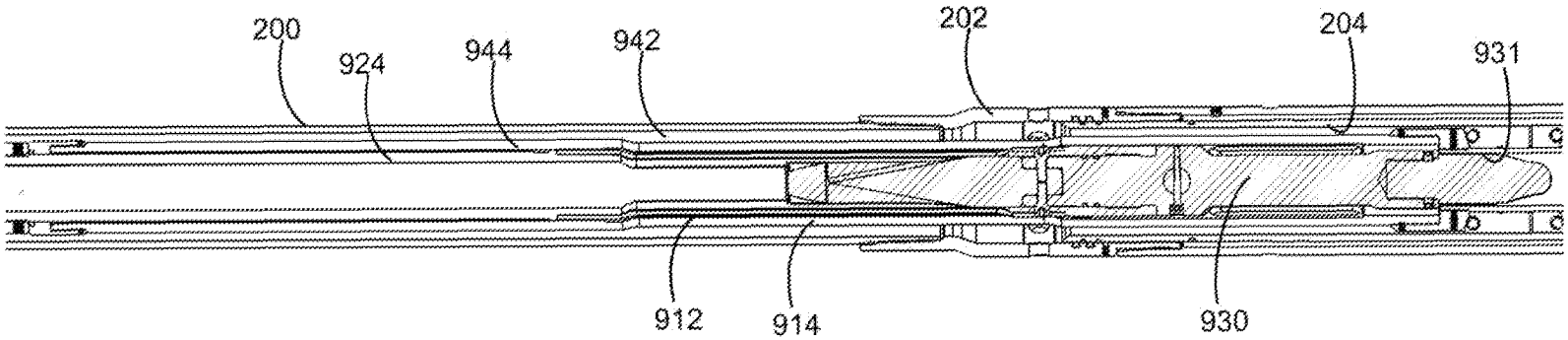
Figure 44:
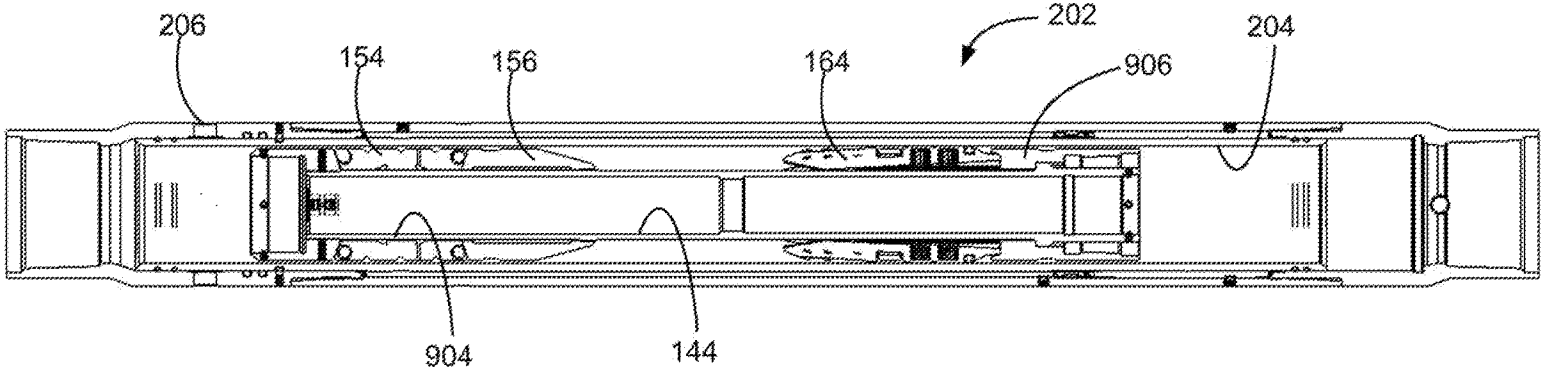
FIG. 44 illustrates an unset packer and slip portion of the second and third assemblies positioned within the sleeve of a ported sub.
Figure 45:
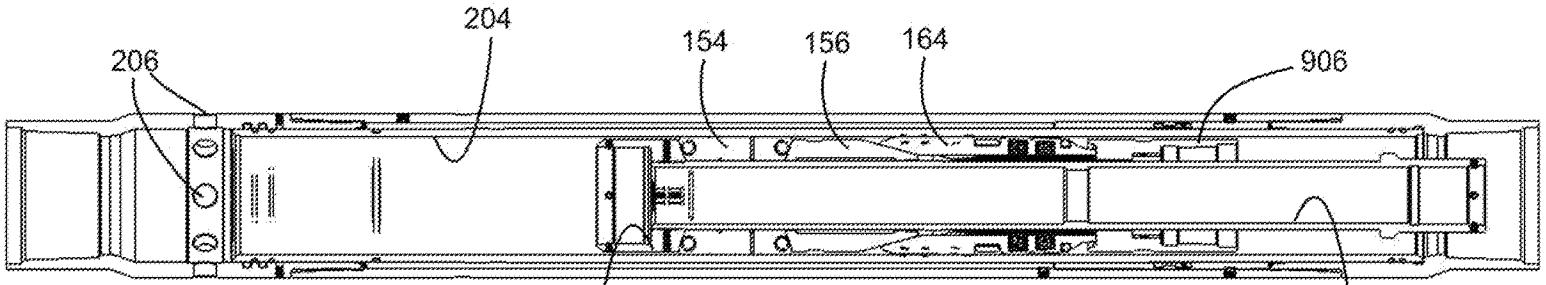
FIG. 45 illustrates the resettable packer and slip portion of the second and third assemblies of FIG. 44 both set to engage the sleeve with the BHA shifted downhole to open the ports of the ported sub.

As shown in FIGS. 40 and 41, the BHA 900 is shown positioned in a completion string 200 having one or more ported sleeve subs 202. In FIGS. 40 and 44, the resettable packer is in run-in mode and the packer 154 is not set to engage sleeve 204. Sleeve ports 206 of the ported sleeve sub 202 remain closed. In FIGS. 41 and 45, the packer 154 is set to engage sleeve 204 and the BHA has been shifted downhole to open the ported sleeve sub 202. The selector valve is open with first and second fluid ports 912,194 aligned for fluid flow to the tool annulus 924 and through sleeve ports 206 to the wellbore.

Figure 42:
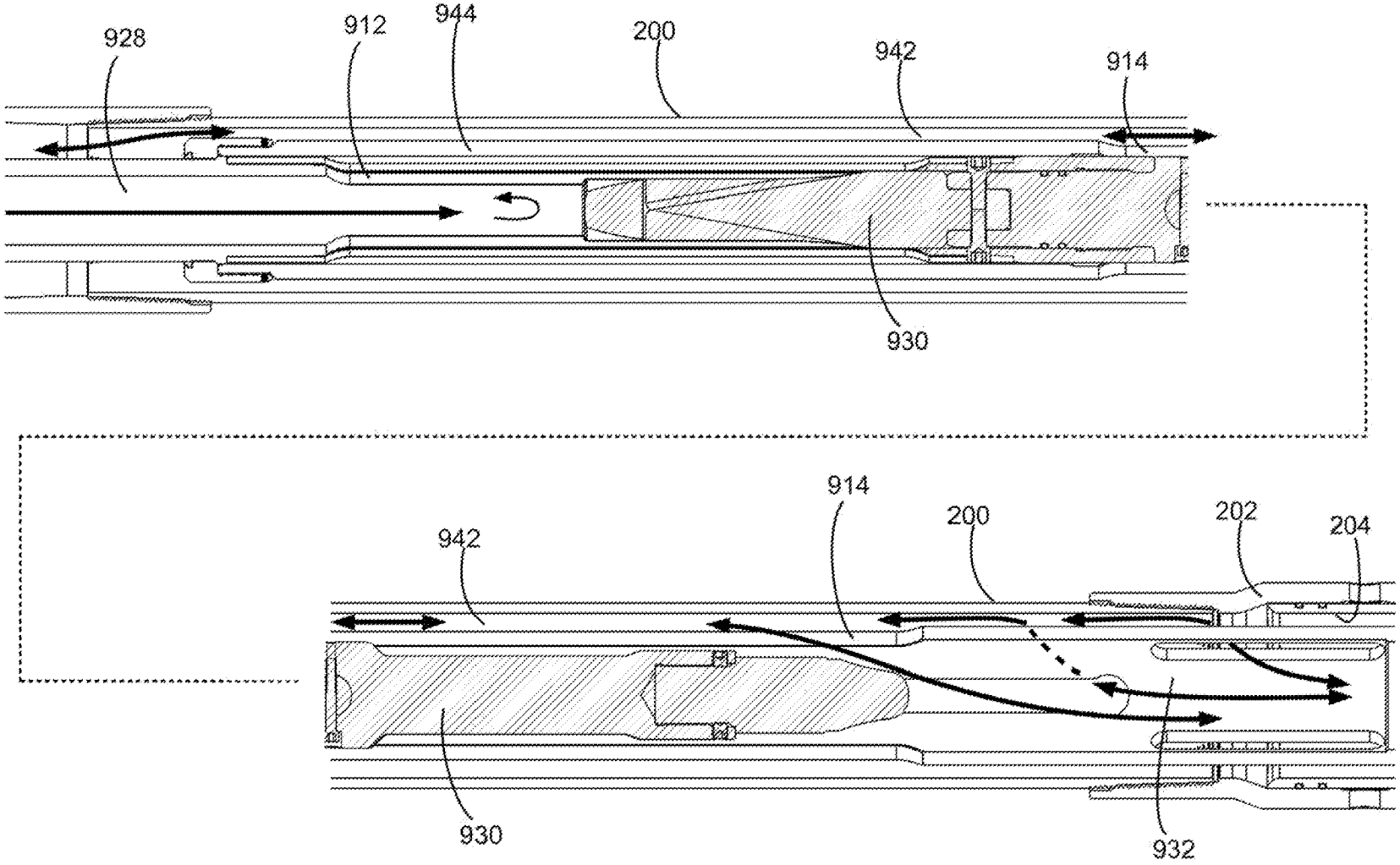

With reference to FIG. 42, with the BHA 900 shown in position in the completion string 200, the bypass valve is open, the selector valve is closed and fluid can move freely between the tool annulus 924 and the second bore 932. Fluid in the conveyance string in the first bore 928 is blocked from exiting or entering at the fluid ports 912,914.

Figure 43:
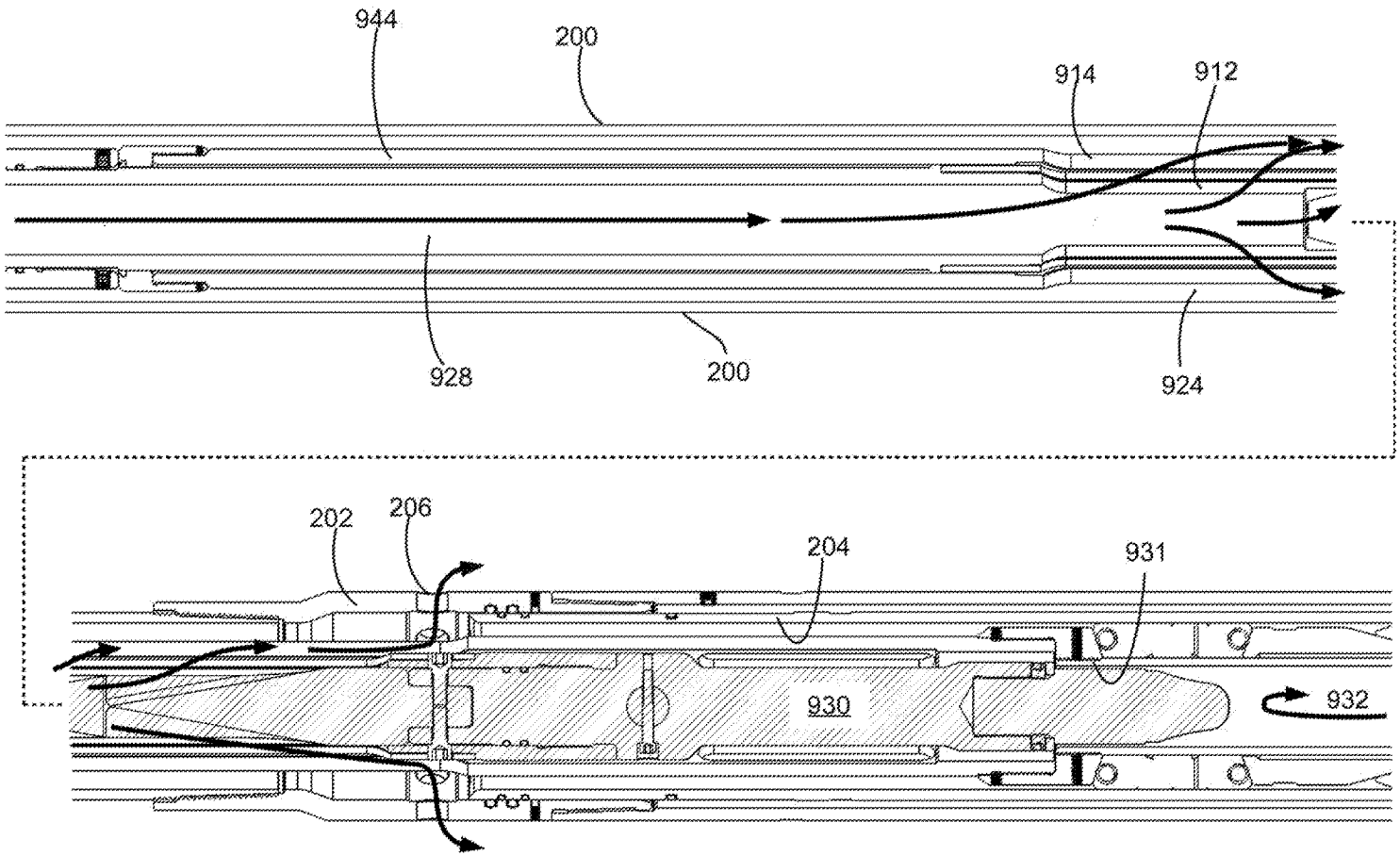

With reference to FIG. 43, with the BHA 900 shown in position in the completion string 200, the bypass valve is closed with the plug 930 engaged at the valve seal 931 of the second bore 932. The selector valve is open and fluid is shown moving freely between the tool annulus 924 and the first bore 928. Fluid in the conveyance string can flow through the first bore 932 can flow though fluid ports 912,914, into the tool annulus and through the ported sleeve sub ports 206 to the wellbore thereout.

Figure 46:
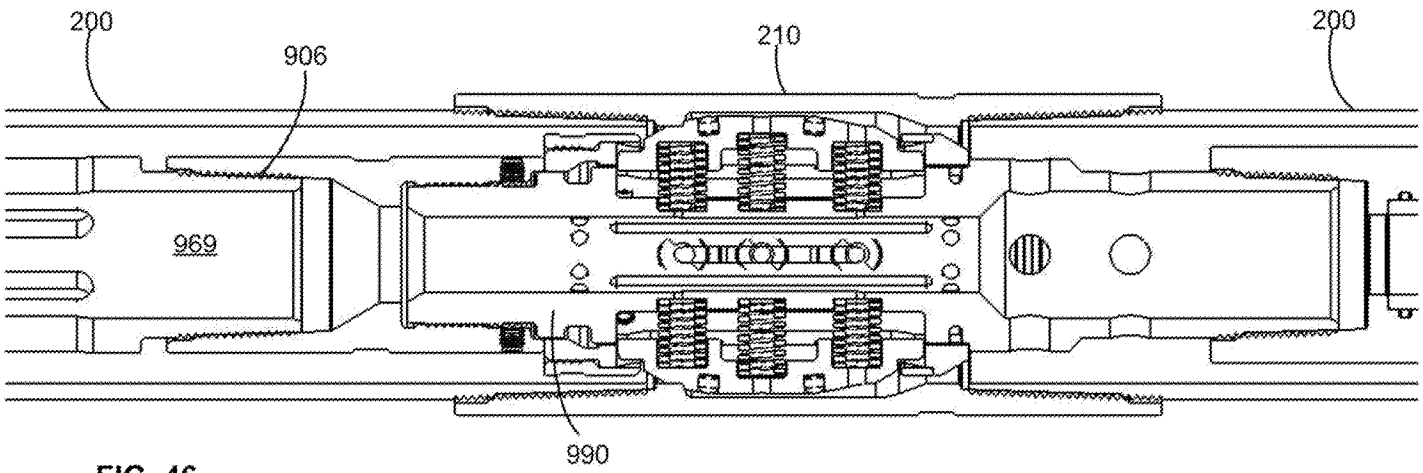
FIG. 46 illustrates a collar locator having engaged a collar for having positioned the packer and slips of FIG. 44 within the sleeve.

With reference to FIG. 46 and FIG. 44, a collar locator 990 is shown located and engaged at a collar 210. The collar locator 990 is connected at a downhole end of the third assembly 906. The collar locator 990 positions the anchor and packer at the ported sleeve sub 202, as illustrated in the partial representation in FIG. 44. The structure of the collar locator 990, being downhole of the operational fluid paths can occupy a significant portion of the third bore 969 of the third assembly, enabling use of high radial force biasing for secure and locator engagement and indication at collar locations. Thus the collar locator 990 repeatedly locates the BHA at the desired location in the completion string 200.

Figure 47:
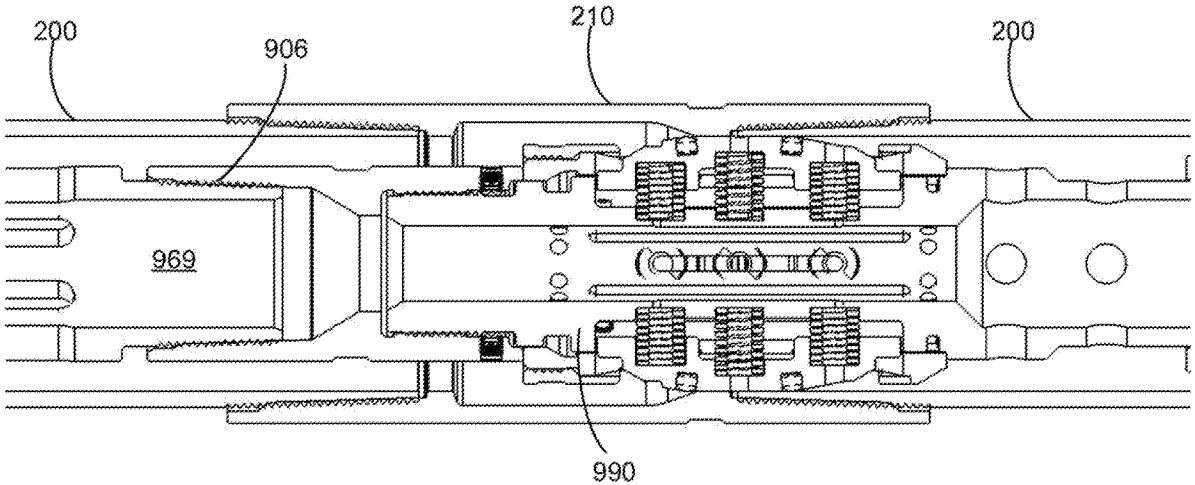
FIG. 47 illustrates the collar locator of FIG. 46 having being disengaged from the collar upon a downhole shift of the BHA to open the ports of the ported sub according to FIG. 45.

With reference to FIG. 47 and FIG. 45, the collar locator 990 is shown shifted commensurate with the BHA when the sleeve 204 of the ported sleeve sub 202 is shifted.

Figure 48A:
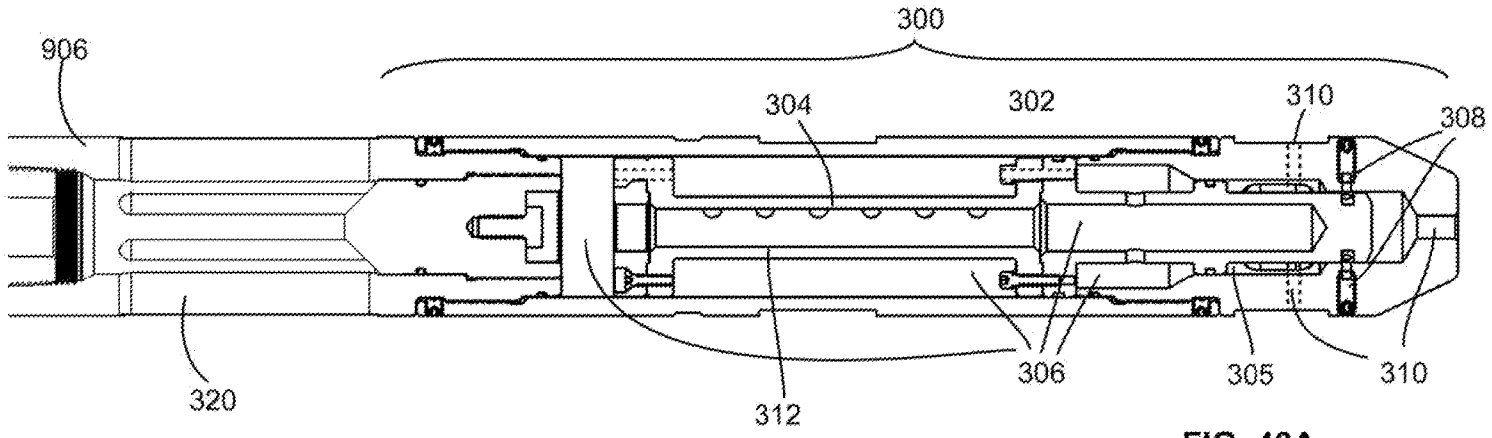
FIG. 48A is a cross-sectional view of a toe sub for ingestion of trapped toe fluid upon a downhole shifting of a set BHA.

Turning to FIG. 48A, a toe sub 300 is provided. The toe sub accepts a bolus of trapped liquid downhole of the BHA during downhole shifting. When the packer is set to the completion string, such as at the deepest ported sleeve sub, liquid in the remaining completion string below the BHA is trapped, and a rise in pressure as the BHA encroaches on the remaining volume therebelow can result in such as substantial increase in pressure, and significant resisting uphole forces, that prevents further downhole movement. Accordingly, the toe sub receives the volume of fluid that is displaced by the shifting BHA.

The toe assembly or sub 300 comprises a toe housing 302, an inner piston 304 assembly having piston face 305 and chamber 306. The piston 304 is temporarily retained with shear screws 308. The housing is fit with one or more fluid ingress ports 310 to place the downhole fluid pressure in contact with piston face 305. The chamber is initially charged with gas at a relatively low pressure, such as air a standard atmospheric pressure. Accordingly, the shear screws 308 are set to release at threshold pressure equivalent to the downhole hydrostatic pressure plus a pressure increment. Thus the shear screws 308 remain intact during the run-in to the toe and do not prematurely release, only shearing when the BHA is shifting.

Figure 48B:
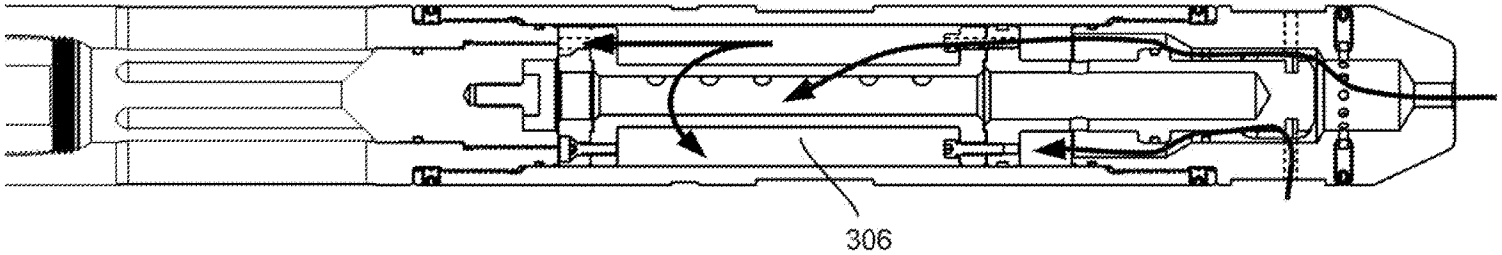
FIG. 48B illustrates the response of the internal piston of the toe sub of FIG. 48A so as accept the liquid and enable downhole shifting of the BHA.

As shown in FIG. 48B, an increase in fluid pressure at the toe generates sufficient force at piston face 305 to exceed the resistance of the shear screws. Piston 304 shifts and opens chamber 306 to the influx of liquid permitting the BHA to continue shifting. The liquid enters the chamber. The structure of the piston 304 is minimized to maximize chamber volume including utilizing a hollow piston rod 312. The piston 304 is ported throughout to control the ingress of liquid and avoid hydraulic hammer effects.

Further, a ported sub 320 can be provided downhole of the collar locator 990 of FIG. 47 and uphole of the toe sub 300 so as to shed debris that could otherwise interfere with continued and reliable collar locator operation.

Figure 49A:
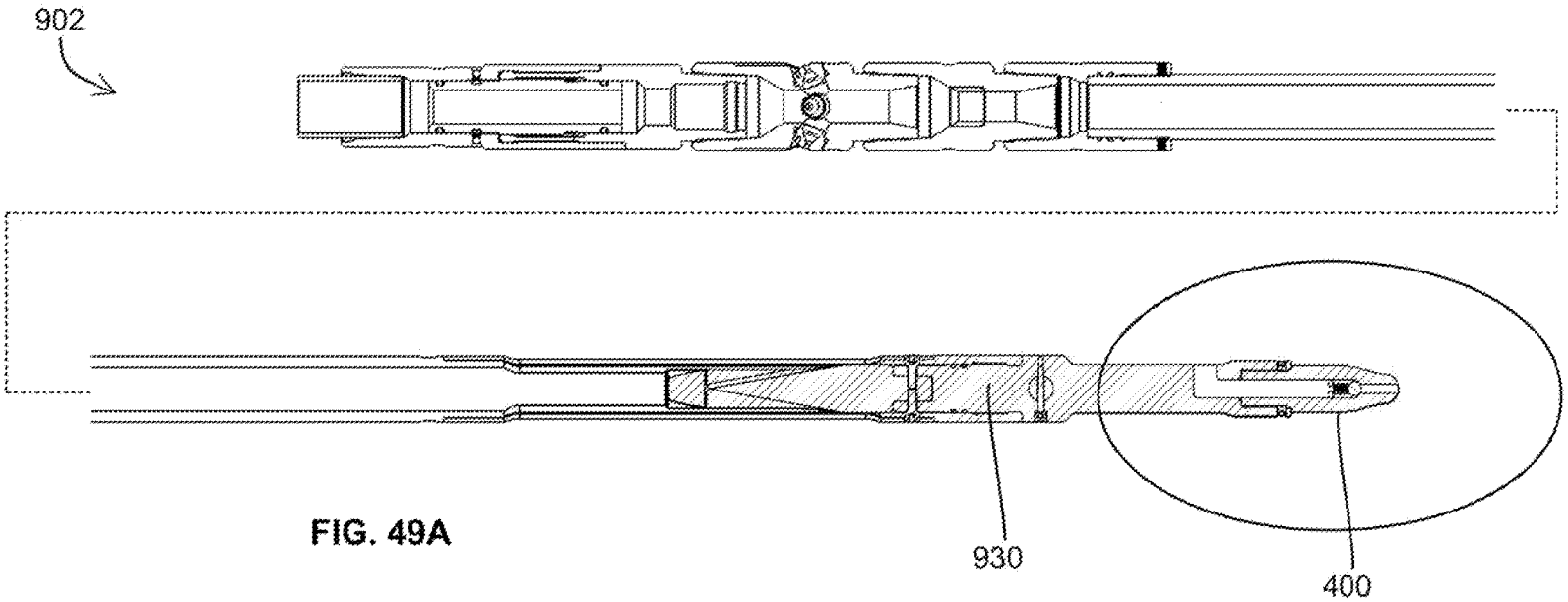
FIG. 49A is a cross sectional view of the first assembly according to FIG. 35, the bypass valve plug being fit with a check valve.
Figure 49B:
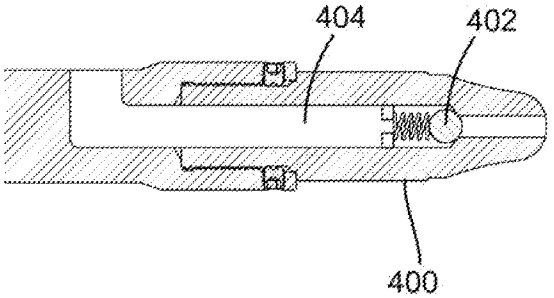
FIG. 49B is a close-up view of the check valve portion of the plug of FIG. 49A.

With reference to FIG. 49A, a check valve 400 can be provided in the instance where the wellbore pressure below the bypass valve is higher than the hold-down force provided by the conveyance string. A biased check ball 402 can be provided in passage 404 for release uphole of the plug 930. The check valve 400 could be subject to failure due to debris and is applied only in specified differential pressure circumstances.

Throughout the BHA, the second and third assemblies are also ported or perforated for relief of debris from the various components. As shown in FIG. 39, the guide housing 170 is perforated and a sub between the guide housing 170 and the collar locator 990 is also ported. The collar locator of FIGS. 46 and 47 are also provided with debris relief ports. With reference to FIG. 42, one can also see debris relief ports provided immediately uphole of the bypass valve seat to maximize flushing of debris above the packer.

The embodiments of the invention for which an exclusive property or privilege is claimed are defined as follows:

1. A downhole treatment tool deployed on a tubular conveyance string to access a completion string in a wellbore and forming a tool annulus between the treatment tool and completion string, the treatment tool comprising:

a first assembly having a first bore fluidly connected to the conveyance string for receipt of treatment fluid therefrom;

a second assembly supporting a packer for releasably sealing to the completion string; and a third assembly supporting a packer actuator thereon, the second assembly telescopically movable within the third assembly for forming a resettable packer with the second assembly's packer, the resettable packer releasably sealable to the completion string; and a bypass valve between the first and second assembly, the first assembly telescopically movable with the second assembly for alternately closing and opening the bypass valve, wherein closing of the bypass valve sets the packer to the completion string and directs the treatment fluid through a treatment port of the first assembly uphole of the resettable packer to the tool annulus, and opening of the bypass valve resets the packer and bypasses treatment fluid about the resettable packer between the completion string and the packer.

2. The treatment tool of claim 1 wherein the packer actuator can further comprise an anchor for releasably anchoring to the completion string.

3. The treatment tool of claim 1 wherein the first assembly can further comprise a mandrel extending downhole to telescopically engage a second bore of the second assembly and form the bypass valve therebetween.

4. The treatment tool of claim 1 wherein:

the first assembly is an uphole flow control assembly;

the second assembly is a tubular uphole packer assembly; and the third assembly is a tubular uphole downhole anchor assembly supporting an anchor for releasably anchoring to the completion string, the packer assembly being telescopically movable within the anchor assembly for forming a resettable packer releasably sealable to the completion string, the second assembly being in fluid communication with the flow control assembly.

5. The treatment tool of claim 4 wherein the bypass valve further comprises a plug situate on the flow control assembly and a valve seat in a second bore of the packer assembly.

6. The treatment tool of claim 4 wherein:

the packer assembly comprises an actuator tubular having a second bore, the flow control assembly further comprises a mandrel telescopically received within the second bore, and the bypass valve further comprises a plug located on the mandrel and a valve seat located in the second bore, engagement of the plug and the valve seat blocking the fluid bypass about the resettable packer.

7. The treatment tool of claim 6 wherein the anchor assembly comprises a guide tubular having a third bore for receiving the actuator tubular and telescopically movable therein for actuating and releasing the resettable packer.

8. The treatment tool of claim 7 wherein:

the guide tubular further comprises a slot housing having guide slots therein, and the actuator tubular further comprises a slider having a pin thereon, the pin engageable with the guide slots for delimiting the telescopic movement between at least setting and releasing the resettable packer.

9. The treatment tool of claim 8 wherein the slider is rotatable to enable the pin to rotate while telescopically engaging the guide slots.

10. The treatment tool of claim 9 wherein the guide slots:

delimit downhole telescopic movement of the actuator tubular to prevent setting of the resettable packer, enable uphole movement to release the resettable packer, and enable downhole telescopic movement of the actuator tubular to set the resettable packer.

11. The treatment tool of claim 1 further comprising a selector valve for opening and closing the treatment port, the selector being open when the bypass valve is closed.

12. The treatment tool of claim 1 wherein the completion string further has one or more ported sleeve subs having sleeves, each ported tubular having a locator collar spaced downhole thereof, the treatment tool further comprising a collar locator located downhole of the third assembly for locating the resettable packer at the sleeve uphole thereof.

13. The treatment tool of claim 1 wherein flow control assembly further comprises a fluid jetting assembly uphole of the treatment port.

14. The treatment tool of claim 13 wherein the flow control assembly further comprises:

a selector valve for opening and closing the treatment port, the selector valve being open when the bypass valve is closed for flowing treatment fluid therethrough and the selector valve being closed when the bypass valve is open for flowing treatment fluid through the fluid jetting assembly.

15. The treatment tool of claim 14 wherein the first assembly further comprises a mandrel extending between the second assembly and the treatment port, the mandrel telescopically movable in the second assembly for opening and closing the bypass valve and telescopically movable in the first assembly for closing and opening the selector valve.

16. The treatment tool of claim 13 wherein first assembly further comprises a ball seat between the fluid jetting assembly and the treatment port for isolation of the treatment port from the treatment fluid.

17. The treatment tool of claim 1 further comprising a selector valve, wherein:

the second assembly comprises an actuator tubular having a second bore, the first assembly further comprises a mandrel telescopically received within the second bore and a treatment port housing having a selector sliding sleeve movable therein for alternately opening and closing the selector valve for alternately flowing and blocking treatment fluid through the treatment port, the bypass valve further comprises a plug located on the mandrel and a valve seat located in the second bore, engagement of the plug and the valve seat blocking the fluid bypass about the resettable packer, and the selector sliding sleeve is connected to the mandrel.

18. The treatment tool of claim 17 wherein a downhole displacement of the first assembly closes the bypass valve and opens the selector valve.

19. The treatment tool of claim 1 further comprising a selector valve wherein the first assembly is telescopically movable within the second assembly to open or close the selector valve for flowing or blocking treatment fluid to the tool annulus respectively.

20. The treatment tool of claim 19 wherein flow control assembly further comprises a fluid jetting assembly uphole of the selector valve.

21. The treatment tool of claim 1 further comprising a selector valve between the first assembly and the second assembly, wherein:

the second assembly comprises an actuator tubular having selector sleeve having a second bore and a selector port formed therein for fluid communication between the second bore and the tool annulus, the first assembly further comprises a mandrel telescopically received within the second bore, the first bore extending therealong and having the treatment port formed therein for fluid communication between the first bore and the second bore, wherein the first assembly is telescopically movable within the second assembly to open and close the selector valve from a first misaligned position to block the flow of treatment fluid from treatment port and a second aligned position where the treatment port aligns with the selector port for fluid communication from the first bore of the tool annulus.

22. The treatment tool of claim 21 wherein the selector valve is uphole of the bypass valve, downhole displacement of the first assembly opening the selector valve and closing the bypass valve.

23. A downhole treatment tool deployed on a tubular string to access a wellbore comprising:

an uphole flow assembly having a fluid bore fluidly connected to the tubular string for deployment in the wellbore, the flow assembly having a fluid discharge port between the fluid bore and the wellbore;

a downhole resettable packer assembly connected to the flow assembly and having an uphole actuator sleeve supporting a packer and a downhole anchor housing, the actuator sleeve telescopically movable within the anchor housing between an anchored position and a released position;

a coupling mandrel extending downhole from the flow assembly for delimited telescopic connection to the actuator sleeve of the resettable packer assembly and forming a valve therebetween, the coupling mandrel having an uphole valve, an intermediate flow-by portion and a downhole coupling stop, and the actuator sleeve having an uphole seat and a downhole sleeve stop, the coupling mandrel movable in the actuator sleeve to operate the uphole valve between at least an open position and a closed position wherein in the opening position the uphole valve is released from the uphole seat to open fluid communication in an annular passage between the actuator sleeve and the flow-by portion and establish fluid communication about the resettable packer; and in the closed position, the uphole valve is engaged with the uphole seat to close fluid communication about the resettable packer.

24. The downhole treatment tool of claim 23 wherein the flow assembly has a downhole shoulder for engaging an uphole shoulder of the actuating sleeve in the closed position.

25. The downhole treatment tool of claim 23 wherein:

the coupling mandrel is movable in the actuator sleeve to further operate the valve between the open position and a released position wherein the coupling's stop engages the sleeve's stop to actuate the resettable packer assembly to the released position.

26. The downhole treatment tool of claim 23 wherein:

the coupling's stop is spaced a first length from the uphole valve; and the actuating sleeve's uphole seat is spaced a second length from the sleeve's stop, the first length being longer than the second length so that in the closed position a downhole shoulder of the flow assembly engages an uphole shoulder of the actuating sleeve and the uphole valve engages the uphole seat to close the valve, the coupling's stop being spaced downhole from the sleeve's stop; and in the open position the uphole valve is disengaged from uphole seat to open the valve and the coupling's stop remains spaced downhole from the sleeve's stop.

* * * * *